US007796902B2

(12) United States Patent
Watanabe et al.

(10) Patent No.: US 7,796,902 B2
(45) Date of Patent: Sep. 14, 2010

(54) IMAGE FORMING CONDITION ADJUSTMENT CONTROL FOR IMAGE FORMING APPARATUS

(75) Inventors: Naoto Watanabe, Atsugi (JP); Tatsuya Niimi, Numazu (JP); Hitoshi Ishibashi, Kamakura (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/382,506

(22) Filed: Mar. 18, 2009

(65) Prior Publication Data

US 2009/0238591 A1 Sep. 24, 2009

(30) Foreign Application Priority Data

Mar. 18, 2008 (JP) ..... 2008-070096

(51) Int. Cl.
*G03G 15/00* (2006.01)

(52) U.S. Cl. ..... 399/49; 399/46

(58) Field of Classification Search ..... 399/46, 399/49, 50, 51, 55
See application file for complete search history.

(56) References Cited

U.S. PATENT DOCUMENTS 5,860,038 A * 1/1999 Kato et al. ..... 399/49
6,792,220 B2 * 9/2004 Randall et al. ..... 399/49
7,228,081 B2 6/2007 Hasegawa et al.
7,251,420 B2 7/2007 Fujimori et al.
2005/0207766 A1 9/2005 Hasegawa et al.
2006/0002724 A1 1/2006 Fujimori et al.
2008/0136685 A1 6/2008 Takahashi

FOREIGN PATENT DOCUMENTS

JP 2004-083859 3/2004
JP 2004-184583 7/2004

* cited by examiner

*Primary Examiner*—Hoang Ngo
(74) *Attorney, Agent, or Firm*—Harness, Dickey & Pierce, P.L.C.

(57) ABSTRACT

An image forming apparatus includes a charge unit, an exposure unit, an exposure voltage detector, a development unit, and a concentration detector. The exposure voltage detector detects a potential of latent image formed as a test pattern on an image carrier. The concentration detector detects concentration of developed test pattern. The image forming apparatus further includes an exposure power controller, an exposure ratio controller, a charging voltage controller, a development bias voltage controller, and an image forming condition adjustment controller. A suitable image forming condition is computed using test patterns formed by changing combinations of charging voltage, exposure power, and exposure duty. The charging voltage is changed in two levels or more. The exposure power is changed in three levels or more. The exposure duty per unit area is changed in two levels or more.

13 Claims, 33 Drawing Sheets

IMAGE FORMING CONDITION ADJUSTMENT CONTROL FOR IMAGE FORMING APPARATUS

CROSS-REFERENCE TO RELATED APPLICATIONS

This application claims priority under 35 U.S.C. 119(a) to Japanese Patent Application No. 2008-070096 filed on Mar. 18, 2008 in the Japan Patent Office, the entire contents of which are hereby incorporated by reference herein.

BACKGROUND OF THE INVENTION

1. Field of the Invention

The present disclosure generally relates to an image forming apparatus that can adjust an image forming condition at a given timing.

2. Description of the Background Art

Typically, image forming apparatuses using electrophotography (e.g., copier, laser beam printer) may need image forming condition adjustment at certain times (e.g., when power is turned ON, after a given time elapses, after a given number of sheets is printed). Image forming condition adjustment may be as follows:

A photoconductor is exposed with a light beam to form latent images while changing an exposing potential for the latent images, and the exposing potential of latent images is detected by a potentiometer; toner patterns are developed on the photoconductor, and detected by an photosensor (hereinafter also "P sensor"); based on detection result obtained by the potentiometer and the concentration sensor, the image forming condition (such as for example exposure power, developing bias voltage, or the like) is adjusted so that the image concentration can be set within a target range constantly.

In such image forming condition adjustment, a characteristic change of latent image potential on the photoconductor relative to the exposure power can be detected, and then a charging voltage and an exposure power can be set to a suitable level by a feedback control using the detection result. Such characteristic change of latent image potential on the photoconductor may be referred to "light attenuation characteristic," hereinafter.

The light attenuation characteristic of photoconductor may vary depending on such conditions as, for example, use environment, the degree of electrostatic fatigue of the photoconductor, and a thickness of a layer composing the photoconductive layer. Further, in actual apparatuses, several factors that affect the light attenuation characteristic may occur simultaneously or concurrently. Such factors may be abrasion of the surface layer of photoconductor, the degree of electrostatic fatigue of photoconductor, and change of use environment. Accordingly, the light attenuation characteristic of photoconductor may vary under complexed effect of the use environment, the degree of electrostatic fatigue of photoconductor, and photoconductive layer thickness, for example. Accordingly, it becomes difficult to predict a characteristic change of latent image potential formed on the photoconductor relative to the exposure power just based on data of used hours, number of printed sheets, etc. Accordingly, it is important to detect a characteristic change of latent image potential on the photoconductor relative to the exposure power, and to feedback detected results to the image forming condition. Such process may be referred to as an image forming condition adjustment control.

In view of such change of light attenuation characteristic of photoconductor, a related method is described in JP-2004-184583-A for correcting or adjusting an image forming condition.

In such related method, an exposure unit emits a laser beam from a semiconductor laser under a control of a laser control unit. Specifically, the laser beam is emitted by setting a laser emission power at a maximum light intensity. A potential of the photoconductor, which is exposed to such laser beam, is detected by an electrometer, and an output signal of the electrometer is referred to as a residual potential Vr of the photoconductor.

In a normal situation, a potential detected after conducting a charge process, an exposure process, a development process, a transfer process, a cleaning process, and then a de-charging process is referred to as a residual potential Vr.

Because the electrometer is disposed between an exposure unit (or an exposure area) and a development unit (or an development area), a potential after irradiating light having maximum light intensity is referred to as a residual potential Vr instead of the normal residual potential detected after the de-charging process. If the residual potential Vr exceeds a reference value, the difference between the residual potential Vr and the reference value is added to a given charging voltage Vd. A potential obtained by adding the difference to the charging voltage Vd is referred as a target potential.

It is to be noted that the reference value is a residual potential on the photoconductor when the photoconductor is charged by a given charging voltage Vd and then exposed by a light having maximum light intensity under an initial condition.

When forming each of color images, a power supply circuit is adjusted so that a charging voltage Vd for each of photoconductors, applied by a charge unit, can be set to the target potential for each of the photoconductors for each color in parallel.

Further, a laser emission power of a semiconductor laser is adjusted by a laser control unit and then a laser beam is directed onto the photoconductor, which is irradiated by the laser beam, to expose the photoconductor.

Specifically, the laser emission power is adjusted so that an exposure potential, which is a difference between an exposure voltage VL (a surface potential of the photoconductor after exposure) and the target potential can be set to a desirable exposure potential.

A power supply circuit is adjusted to supply a given development bias voltage Vb to a development unit, which includes a black color development unit, a cyan color development unit, a magenta color development unit, and a yellow color development unit, for example. In such adjustment, the power supply circuit is adjusted to supply a given development bias voltage, which can set a desirable development potential between the development bias voltage Vb and the exposure voltage VL.

A description is now given of the conventional correction method for correcting a difference between the residual potential Vr and the reference value.

Firstly, a description is given of the exposure power when the residual potential Vr is measured with reference to FIGS. 1A and 1B.

FIGS. 1A and 1B show relations of the exposure power Lp and the exposure voltage VL when the charging voltage Vd is changed from 600V to 800V to 900V. As shown in FIGS. 1A and 1B, the surface potential of photoconductor reaches a potential saturation point at a given value of the exposure power Lp. The potential saturation point is a condition in which the surface potential of the photoconductor does not substantially change even when the exposure power Lp exceeds a given value.

In FIG. 1A, the surface potential of photoconductor at the potential saturation point changes depending on the charging voltage Vd (i.e., exposure power Lp corresponding to potential saturation point vary depending on values of the charging voltage Vd). By contrast, in FIG. 1B, the surface potential of photoconductor at the potential saturation point does not change greatly between different values of the charging voltage Vd (i.e., exposure power Lp corresponding to potential saturation point does not vary greatly among different values of the charging voltage Vd).

In FIGS. 1A and 1B, the horizontal axis represents an exposure energy ($\mu J/cm^2$), and the exposure energy can be read as the exposure power Lp. When measuring the residual potential Vr, an exposure power Lp is set to a given level so that a value of the exposure voltage VL (surface potential of the photoconductor after exposure) does not change when the charging voltage Vd is changed within a given range set for an image forming process. Such given level of exposure power Lp is referred to as an exposure power Lpα, which is not dependent on a charging voltage, which may be referred to as a charging-non-dependent exposure power Lpα, hereinafter.

In case of FIG. 1A, the exposure energy or exposure power Lp is set to 0.35 $\mu J/cm^2$ or more, and in case of FIG. 1B, the exposure energy or exposure power Lp is set 0.40 $\mu J/cm^2$ or more. Typically, a photoconductor reaches a potential saturation point when the photoconductor is exposed by the charging-non-dependent exposure power Lpα.

A description is now given of the correction method of light attenuation characteristic of photoconductor when the light attenuation characteristic changes due to electrostatic fatigue of photoconductor, with reference to FIG. 2.

FIG. 2 shows the correction method when the light attenuation characteristic changes for the photoconductor of FIG. 1B. In FIG. 2, the exposure power Lp is set to 0.45 $\mu J/cm^2$.

Before the electrostatic fatigue of photoconductor (initial condition: see a solid line in FIG. 2), an initial residual potential Vrα has a smaller value, and a good level of exposure potential can be set between the initial residual potential Vrα and an initial charging voltage Vdα (see an initial exposure potential Potα, shown by a solid arrow line in FIG. 2).

After electrostatic fatigue of photoconductor (see a dashed line in FIG. 2), a post-fatigue residual potential Vrβ of the photoconductor becomes higher than the initial residual potential Vrα. Therefore, a post-fatigue exposure potential becomes smaller compared to the initial stage exposure potential (see a post-fatigue exposure potential Potβ shown by a dashed arrow line in FIG. 2).

Accordingly, after such fatigue occurs, an exposure potential which is same as the initial condition can be obtained by increasing the charging voltage Vd, in which the charging voltage Vd is increased for a value computed by an equation of "post-fatigue residual potential Vrβ−initial residual potential Vrα." Such modified charging voltage is referred to as a corrected charging voltage Vdγ. With such a process, a required exposure potential can be obtained (see a corrected exposure potential Potγ shown by a broken arrow line in FIG. 2).

As such, by correcting the charging voltage Vd, the light attenuation characteristic of photoconductor, which is shown by a dashed curve line in FIG. 2 (a relation of the exposure voltage VL relative to the exposure power Lp), can be obtained, by which a same exposure potential can be obtained for the initial condition and the post-fatigue condition.

When correcting the charging voltage Vd, the residual potential Vr is measured using the charging-non-dependent exposure power Lpα for the following reason.

For the purpose of explanation, a given level of exposure power Lp is set, in which a value of the exposure voltage VL changes when the charging voltage Vd changes. For example, the exposure power Lp is set to 0.15 $\mu J/cm^2$ for the purpose of explanation with reference to FIG. 2.

As shown in FIG. 2, even if a photoconductor is exposed with an exposure power set smaller than the charging-non-dependent exposure power Lpα, the post-fatigue exposure voltage VLβ, which is an exposure voltage when the electrostatic fatigue of photoconductor occurs, becomes higher than the initial exposure voltage VLα, which is an exposure voltage at the initial condition, as similar to a relation of the post-fatigue residual potential Vrβ and the initial residual potential Vrα.

Hereinafter, the charging voltage Vd is increased by a value computed by an equation of "post-fatigue stage exposure voltage VLβ−initial exposure voltage VLα" and such increased charging voltage Vd is referred to as a corrected charging voltage Vdδ (Vdδ=Vd+VLβ−VLα). Then, the photoconductor set to the corrected charging voltage Vdδ is exposed by the same exposure power (0.15 $\mu J/cm^2$), and an exposure voltage corresponding to such photoconductor is referred to as a corrected exposure voltage VLγ.

The corrected exposure voltage VLγ becomes higher than the post-fatigue stage exposure voltage VLβ. When the corrected exposure voltage VLγ becomes higher than the post-fatigue stage exposure voltage VLβ, a corrected exposure potential "Vdδ-VLγ" becomes smaller than an exposure potential "Vd-VLα" for the initial condition. Accordingly, under an image forming condition using the same exposure power (e.g., 0.15 $\mu J/cm^2$), an exposure potential for the post-fatigue stage may not become same as an exposure potential for the initial condition.

However, if the photoconductor is exposed using the charging-non-dependent exposure power Lpα (e.g., 0.45 $\mu J/cm^2$), the corrected exposure potential may become same as the post-fatigue residual potential Vrβ, which is an exposure potential before correction.

Accordingly, an exposure potential can be increased for an amount corresponding to an increased value for the charging voltage Vd, by which a required exposure potential can be obtained.

With such a configuration, an exposure potential corresponding to a given exposure power can be set to a level substantially same as the exposure potential at the initial condition. Therefore, when correcting the charging, voltage Vd, the charging-non-dependent exposure power Lpα, which does not change a value of the exposure voltage VL even though the charging voltage Vd changes, must be used.

Further, in the conventional correction method to be described hereinafter, a residual potential Vr that a surface potential of photoconductor becomes saturated may be used to obtain a good level of solid image and halftone image. If the residual potential Vr changes due to a value change of the charging voltage Vd, a suitable correction cannot be conducted. Therefore, to obtain a suitable value of the residual potential Vr, the charging-non-dependent exposure power Lpα may be used.

An image forming apparatus may be used to form the solid image and also the halftone image described above. Accordingly, when the light attenuation characteristic of photoconductor changes, an image forming condition (such as for example exposure power, developing bias voltage, or the like) may need to be adjusted so that the halftone image can also be formed appropriately.

A description is now given of the conventional correction method to obtain a good level of solid image and halftone image.

As above described with reference to FIG. 2, after correcting the charging voltage Vd in view of the photoconductor fatigue or the like, a process control is conducted to compute the exposure power Lp, which can form a good level of solid image and halftone image. This is explained with reference to FIG. 3.

FIG. 3 shows the light attenuation characteristic of photoconductor, exposed for solid image and for halftone image. In FIG. 3, a solid curve line is for the solid image exposure, and a dashed curve line is for the halftone image exposure.

When the halftone image is exposed, an exposure power same as the solid image is used while setting a shorter exposure time per unit area compared to the solid image. Therefore, in the halftone image, each one of exposed dots may have an exposure potential same as the solid image.

However, a potentiometer measures a surface potential of the photoconductor with a given size area, but not each one of exposed dots. Specifically, the potentiometer measures the surface potential of the photoconductor as an average potential value of the given size area. Accordingly, as shown in FIG. 3, even though a same exposing light intensity is used, a halftone image exposure voltage VLh, which is an exposure voltage for halftone image exposure, becomes higher than a solid image exposure voltage VLf, which is an exposure voltage for solid image exposure. Consequently, the halftone image exposure voltage VLh becomes closer to the charging voltage Vd compared to the solid image exposure voltage VLf.

To obtain a good level of solid image and halftone image, the exposure power may be adjusted in view of a desirable photo-induced discharge characteristic. The photo-induced discharge characteristic is defined as an exposure potential ratio (PotB)/(PotA) under a condition that a charging voltage is set at a constant, in which the exposure potential (PotA) is for solid image exposure, and the exposure potential (PotB) is for halftone image exposure. By setting the photo-induced discharge characteristic at a given constant value, a halftone image concentration relative to a solid image concentration can be set in a given range.

In FIG. 3, the photo-induced discharge characteristic of 0.7 is used for adjustment. Further, an exposure duty for solid image may be set to 100%, and an exposure duty for halftone image may be set to 50%, for example.

To obtain a good level of solid image and halftone image, a suitable exposure power Lp is computed based on the halftone image exposure voltage VLh.

At first, the exposure duty of 50% is set (if an apparatus can use pulse number of 64 value for adjustment, the exposure duty of 50% corresponds to 32 value).

Then, when a measurement of the residual potential Vr is conducted, a potential that the photo-induced discharge characteristic becomes 0.7 times of a given reference value for the photo-induced discharge characteristic is defined as a light intensity adjustment target potential Vg.

Specifically, the light intensity adjustment target potential Vg corresponds to an exposure potential PotG that can be computed with an equation of "maximum exposure potential PotM×0.7." The maximum exposure potential PotM is shown as a solid curved arrow line in FIG. 3, and the PotG is shown as a dashed arrow line in FIG. 3.

As shown as a dashed line in FIG. 3, if the exposure duty is decreased to 50%, a detection result of the halftone image exposure voltage VLh (exposure voltage for exposure duty 50%) may not be saturated, which is different when the residual potential Vr (or the solid image exposure voltage VLf) is measured. Further, when the exposure power Lp is changed, the halftone image exposure voltage VL can be changed, by which the exposure power Lp can be precisely adjusted because the photoconductor has sensitivity in a given area.

The exposure power Lp is adjusted at the exposure duty of 50%, and an exposure power Lp at which the halftone image exposure voltage VLh becomes the light intensity adjustment target potential Vg is computed.

In the example shown in FIG. 3, the exposure power Lp is computed about 0.35 $\mu J/cm^2$. Then, the computed exposure power Lp is used to measure the solid image exposure voltage VLf for solid image (exposure duty 100%). Then, a development potential, which is required to obtain a desirable toner adhesion amount, is added to the solid image exposure voltage VLf to determine a development bias voltage Vb. Further, a surface skin potential is added to the development bias voltage Vb to determine the charging voltage Vd.

After determining a suitable exposure light intensity (exposure power Lp) to obtain a suitable solid image and halftone image when the charging voltage Vd is set at a given value, the solid image exposure voltage VLf computed based on the suitable exposure light intensity has a relation of VLf≈Vr. If the relation of VLf≈Vr is set, even if the charging voltage is computed again as a charging voltage Vd', a relation of Vd'≈Vd can be obtained. Accordingly, if a suitable exposure light intensity can be set for Vd, such suitable exposure light intensity can be also set for Vd'.

In a case of FIG. 1B, for example, if the residual potential Vr is detected when the exposure power Lp=0.2 $\mu J/cm^2$, the residual potential Vr may change greatly due to an effect of a given value of the charging voltage Vd.

If the charging voltage Vd for halftone image control is set to −600V, and the exposure power that corresponds to the photo-induced discharge characteristic of 0.7 for the charging voltage of −600V is 0.15 $\mu J/cm^2$, the solid image exposure voltage VLf may become about −250V based on a graph of FIG. 1B, and becomes higher than the residual potential Vr of 200V for about 50V in a negative polarity.

Then, to obtain a desirable exposure potential by conducting a last process for correction process, the charging voltage is corrected by about 50V, by which the charging voltage Vd'=−650V can be obtained.

As such, if the solid image exposure voltage VLf is greatly different from the residual potential Vr, the charging voltage Vd computed based on the residual potential Vr, and the charging voltage Vd' computed at a last process for correction process based on the solid image exposure voltage VLf becomes greatly different values. Accordingly, the exposure power Lp=0.2 $\mu J/cm^2$ may not be a suitable exposure light intensity when to detect the residual potential Vr. Therefore, as for the photoconductor having the light attenuation characteristic shown in FIG. 1B, a greater exposure power (e.g., charging-non-dependent exposure power Lpα) of 0.45 $\mu J/cm^2$ may be required as above described. If such a greater exposure power is used for detecting the residual potential Vr when the photo-induced discharge characteristic is 0.7, a suitable exposure light intensity (or exposure power) for a charging voltage Vd of −600 V when detecting the residual potential Vr may become 0.32 $\mu J/cm^2$.

Further, as above described, the exposure power Lp may be adjusted so that a relation of "exposure potential×0.7" is obtained under the exposure duty of 50%. If such adjusted exposure power is used under the exposure duty of 100% when to measure the exposure voltage VL, the exposure voltage VL for solid image may become substantially same as the residual potential Vr.

Therefore, if one exposure power, set against an exposure power Lp that can set a surface potential of photoconductor to a saturated-condition, corresponds to a condition of the photo-induced discharge characteristic of 0.7, then the photo-induced discharge characteristic for the exposure duty 50% may become 0.7 times of the photo-induced discharge characteristic for the exposure duty 100%.

When the solid image exposure (or exposure duty 100%) is conducted, a range of exposure power, which may not change a surface potential of photoconductor even if the exposure power is changed a little, is used for an image forming operation. For example, as for the photoconductor of FIG. 3, the range of exposure power may be set from 0.35 $\mu J/cm^2$ to 0.43 $\mu J/cm^2$ under a condition that the charging voltage is −800V, in which the surface potential of photoconductor changes little if the exposure power changes within such range.

For example, if the exposure power is set to 0.36 $\mu J/cm^2$ and than the exposure power changes a little such as for example to 0.35 $\mu J/cm^2$, the surface potential of photoconductor changes little as indicated by the profile for the solid image exposure voltage VLf shown in FIG. 3.

Because an image forming process can be conducted using the exposure power having such range, if a solid image exposure is conducted using a suitable exposure power, the exposure potential may not change so much even if the exposure power is changed. In other words, because a sensitivity of the surface potential of photoconductor against a change of the exposure power can be set smaller, the exposure power for solid image exposure may not be adjusted precisely.

Accordingly, the exposure duty is decreased to 50% so that a sensitivity of the surface potential of photoconductor against a change of the exposure power can be set. Because an exposure time can be set to half for a same exposure power, and a light intensity can be set to half, a sensitivity of the surface potential of photoconductor can be set effectively as indicated by VLh. As such, a level of exposure power may be adjusted to a given level.

As such, in a conventional image forming apparatus, the residual potential Vr is detected, and then the exposure power Lp is adjusted based on the detection result of the residual potential Vr. Based on the adjusted exposure power Lp, the development bias voltage Vb and the charging voltage Vd can be computed to conduct an image forming condition adjustment control. With such image forming condition adjustment control, a good level of solid image and halftone image may be formed even if a latent image potential characteristic may change relative to the exposure power applied to the photoconductor.

However, in the conventional image forming condition adjustment control, to detect the residual potential Vr, the exposure power Lp may need to be set to a greater value so that the exposure voltage VL may not change even if the charging voltage Vd is changed, and so that the surface potential of photoconductor after the exposure becomes a saturated condition. In the conventional method, such greater exposure power may be obtained by setting a laser emission power of a semiconductor laser to a maximum value, by which the residual potential Vr may be detected.

However, such high-powered laser emission of the semiconductor laser may not be desirable for the service life or durability of laser and photoconductor. Further, if a linear velocity of photoconductor is increased to attain a higher productivity, a laser output used for detecting the residual potential Vr may also need to be set to a greater value, which is not desirable for the laser and photoconductor from a viewpoint of workload.

Further, a growing market demand for higher productivity and higher image quality (or higher density writing) may need to be addressed. Such demand for higher productivity and higher image quality may be met by rotating a polygon scanner at a higher speed, but such configuration may increase noise level of the polygon scanner, increase electrical power consumption, and decrease durability of the polygon scanner.

Alternatively, such demand for higher productivity and higher image quality may be met by using a light source having multiple beams. For example, Vertical Cavity Surface Emitting Laser (VCSEL) having two-dimensional array may be used as a light source. Such VCSEL can reduce electrical power consumption greatly compared to a conventional end-face emitting laser, and light sources can be integrated in a two-dimensional array with a greater number. Such multiple beam configuration can achieve higher productivity (higher linear velocity of photoconductor) and can reduce the rotation speed of polygon scanner.

However, such plane-emission laser array may have lower emission output, and deteriorate if the emission output is increased. If the emission output becomes smaller, an exposure power such that the exposure voltage VL may not change even when the charging voltage Vd is changed cannot be obtained. Further, an exposure power that can set the surface potential of photoconductor after exposure to a saturated condition cannot be obtained. Such exposure power may not be suitable for an image forming condition adjustment control using the residual potential Vr.

SUMMARY

In one aspect of the invention, an image forming apparatus includes a charge unit, an exposure unit, an exposure voltage detector, a development unit, and a concentration detector. The charge unit charges a surface of a latent image carrier. The exposure unit irradiates the charged surface of a latent image carrier using a light beam to form a latent image on the latent image carrier. The latent image is formed as a test pattern. The exposure voltage detector detects a potential of the latent image formed on the latent image carrier. The development unit, including a developer carrier carrying a developer having toner, develops the latent image as a toner image by supplying the toner to the latent image on the latent image carrier using a potential difference between the latent image carrier and the developer carrier. The concentration detector detects an image concentration of test pattern developed as the toner image. The image forming apparatus further includes an exposure power controller, an exposure ratio controller, a charging voltage controller, a development bias voltage controller, and an image forming condition adjustment controller. The exposure power controller controls an exposure power emitted by the exposure unit. The exposure ratio controller controls an exposure duty per unit area exposed by the exposure unit. The charging voltage controller controls a charge bias voltage applied to the charge unit to set a surface potential of the latent image carrier at a given charging voltage after a charging process. The development bias voltage controller controls a development bias voltage, which is a surface potential of the developer carrier. The image forming condition adjustment controller adjusts an image forming condition based on detection results of the exposure voltage detector and the concentration detector. The charging voltage controller changes a charging voltage in two levels or more. The exposure power controller changes the exposure power in three levels or more. The exposure ratio controller changes the exposure duty per unit area in two levels or more. The test pattern is formed under image forming conditions using combinations set by 2×3×2 levels or more, to obtain a suitable, combination of the charging voltage, the exposure power, and the development bias voltage.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1A:
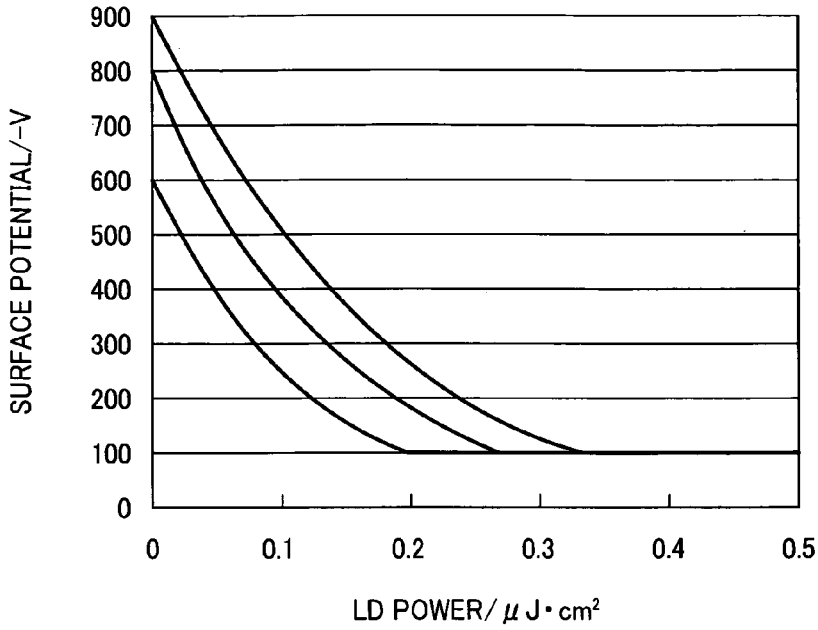
FIGS. 1A and 1B show relations of an exposure power and a surface potential of photoconductor, in which levels of charging voltage is changed.
Figure 1B:
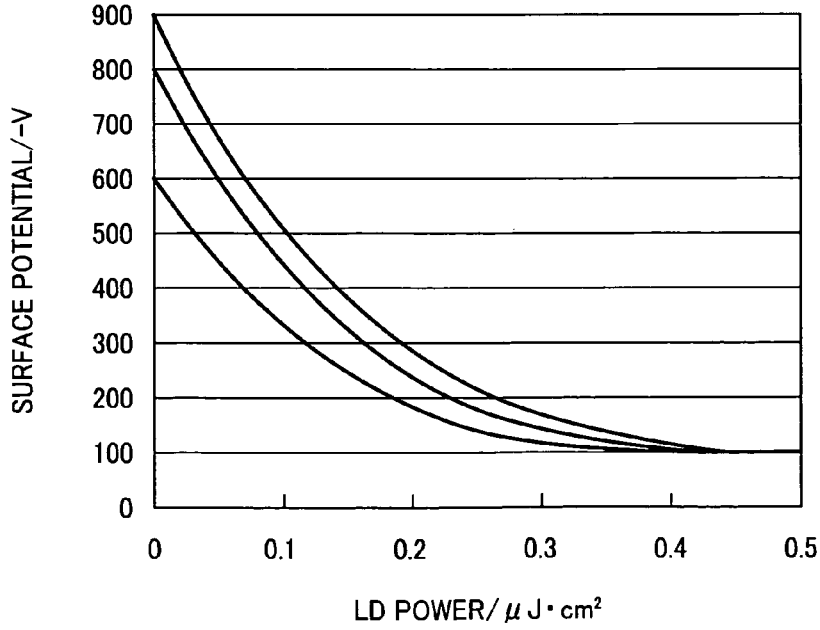
Figure 2:
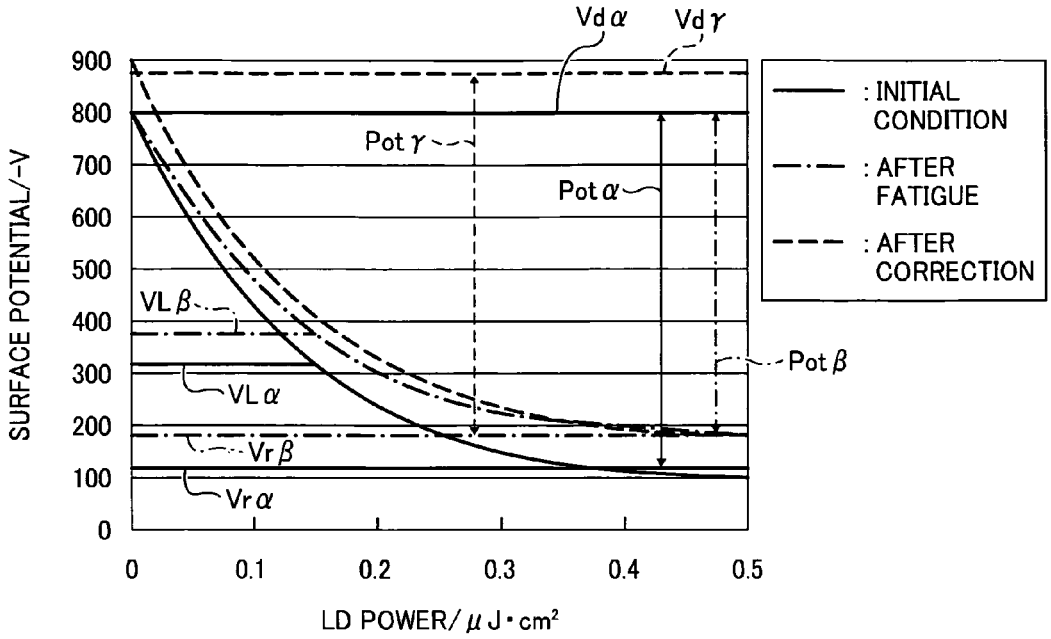
FIG. 2 shows a correction method when the light attenuation characteristic changes for photoconductor.
Figure 3:
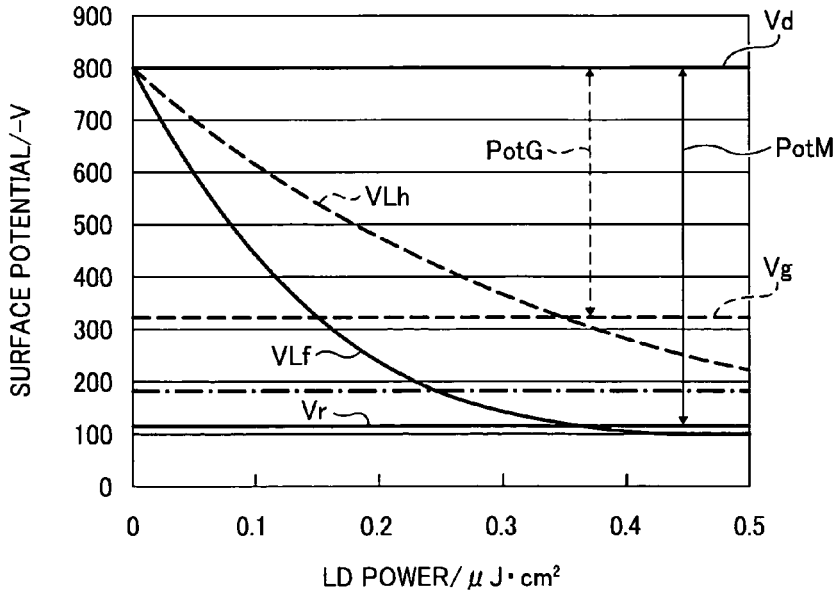
FIG. 3 shows a light attenuation characteristic of photoconductor, exposed for solid image and for halftone image.

The accompanying drawings are intended to depict example embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXAMPLE EMBODIMENTS

A description is now given of example embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an example embodiment is described with reference to accompanying drawings. The image forming apparatus may employ electrophotography, for example, and may be used as a copier, a printer, a facsimile, or a multi-functional apparatus, but not limited thereto.

Figure 4:
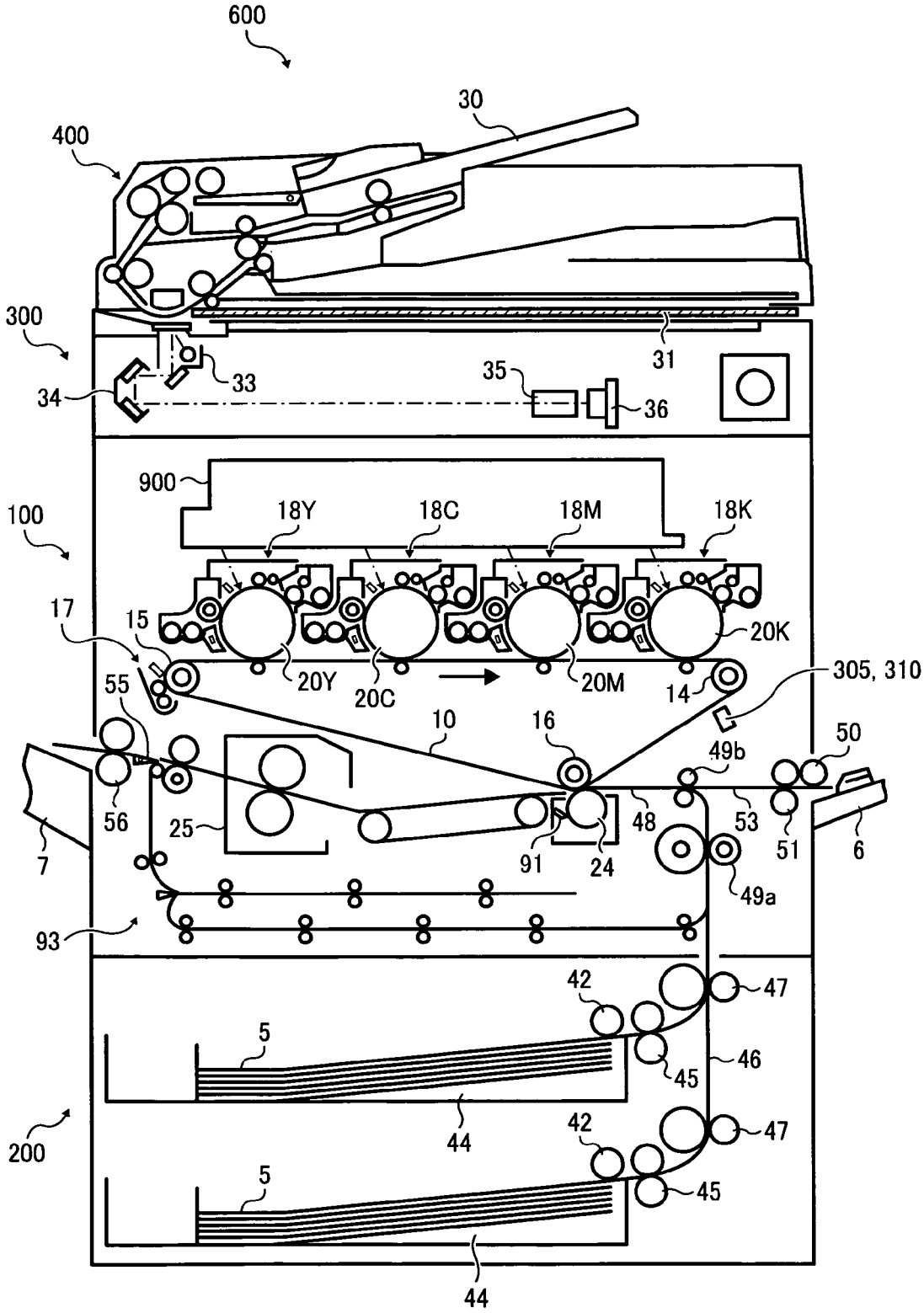
FIG. 4 shows a schematic configuration of image forming apparatus according to an exemplary embodiment.

FIG. 4 illustrates a schematic configuration of an image forming apparatus 600 according to an exemplary embodiment. The image forming apparatus 600 may be a copier, a printer, a facsimile, and a multi-functional apparatus, for example. When the image forming apparatus 600 is used as a printer or a facsimile, the image forming apparatus 600 conducts an image forming process using image data received from an external device, such a personal computer. The image forming apparatus 600 can produce full-color image, for example.

The image forming apparatus 600 may include an image forming unit 100, a sheet feed unit 200, a scanner 3, and an automatic document feeder (ADF) 400, for example. The image forming unit 100 may be placed over the sheet feed unit 200, the scanner 300 may be placed on the image forming unit 100, and the ADF 400 may be placed over the scanner 300, for example. The ADF 400 feeds document to the scanner 300, and the scanner 300 scan images of document. The sheet feed unit 200 stores recording medium (hereinafter, transfer sheet 5) to be transported to the image forming unit 100. The image forming unit 100 also includes a manual feed tray 6, and a sheet ejection tray 7. The manual feed tray 6 is used to feed the transfer sheet 5 manually, and the sheet ejection tray 7 is used to stack the transfer sheet 5 ejected from the image forming unit 100 after an image is formed on the transfer sheet 5.

Figure 5:
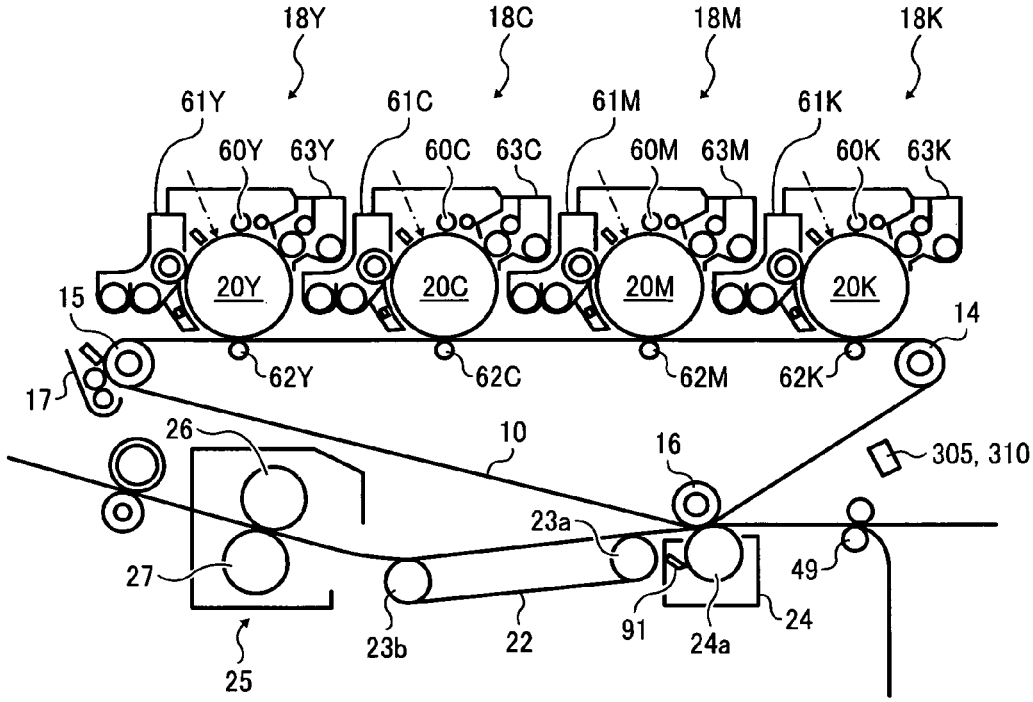
FIG. 5 shows an expanded view of an intermediate transfer unit used in the image forming apparatus of FIG. 4.

FIG. 5 shows an expanded view of the image forming unit 100. The image forming unit 100 includes an intermediate transfer belt 10 as an intermediate transfer belt, which is an endless belt. The intermediate transfer belt 10 can be made from a material (e.g., polyimide resin) having a good level of strength, which can prevent positional deviation caused by an elongation of belt. Further, the intermediate transfer belt 10 includes carbon black, dispersed in the belt and used as a resistance adjuster, so as to attain stable transfer performance, by which higher image quality can be obtained reliably under a relatively wide range of temperature/humidity environment. The intermediate transfer belt 10 having such dispersed carbon black may be appeared as black in color. The intermediate transfer belt 10 may be extended by a first support roller 14, a second support roller 15, and the third support roller 16. One of the support rollers 14, 15, and 16 can be rotated as a drive roller, driven by a motor (used as a driver), so that the intermediate transfer belt 10 can be rotated in a clockwise direction in FIG. 5.

As shown in FIG. 5, the image forming unit 100 may include image forming engines 18Y, 18C, 18M, and 18K for forming color images of yellow (Y), magenta (M), cyan (C), and black (K), respectively. The image forming engines 18Y, 18C, 18M, and 18K are disposed along the intermediate transfer belt 10 extended by the first support roller 14 and the second support roller 15. Hereinafter, Y, M, C, and K may represent yellow, cyan, magenta, and black, respectively. Further, a sensor unit 305 is disposed over the intermediate transfer belt 10 between the first support roller 14 and the third support roller 16 to detect an image concentration patch formed on the intermediate transfer belt 10. The image concentration patch may be a toner image formed on the intermediate transfer belt 10 and used for determining an image forming condition.

Figure 6:
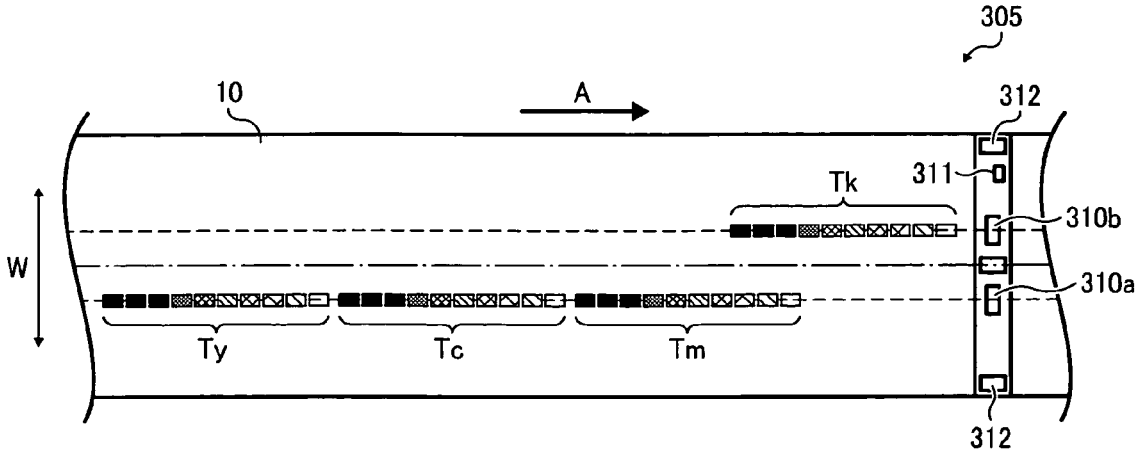
FIG. 6 shows a schematic view an intermediate transfer belt used in the image forming apparatus of FIG. 4 and gray-scale image patterns formed on the intermediate transfer belt.

FIG. 6 shows a schematic configuration around the sensor unit 305 and the intermediate transfer belt 10. As shown in FIG. 6, the sensor unit 305 includes an image concentration sensor 310. The image concentration sensor 310 may be referred as a concentration detector. Specifically, the sensor unit 305 includes two image concentration sensors 310, for example, in a direction parallel to a belt width direction W of the intermediate transfer belt 10, which is also parallel to an axis direction of the photoconductor 20. Further, toner patterns of each color are formed on the intermediate transfer belt 10 as described later. In FIG. 6, ten (10) toner patterns are formed for each color, but eighteen (18) toner patterns are formed for each color in an exemplary embodiment, for example.

Further, as shown in FIG. 6, toner patterns are formed at two positions in the belt width direction W of the intermediate transfer belt 10, wherein the two positions corresponds to the two image concentration sensors 310. The two image concentration sensors 310 may be referred to a first sensor 310*a* and a second sensor 310*b*. The first sensor 310*a* is used to detect non-black color toner patterns: magenta toner patterns Tm, cyan toner patterns Tc, and yellow toner patterns Ty sequentially formed at a first position on the intermediate transfer belt 10. The second sensor 310*b* is used to detect black toner patterns Tk formed at a second position on the intermediate transfer belt 10.

Figure 7:
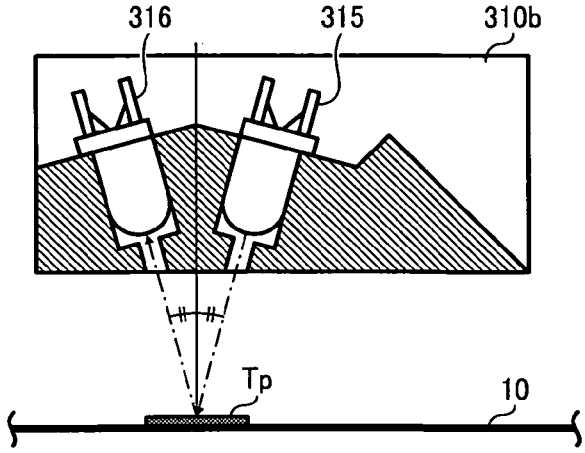
FIG. 7 shows a schematic configuration of a second sensor of a sensor unit used in the image forming apparatus of FIG. 4.
Figure 8:
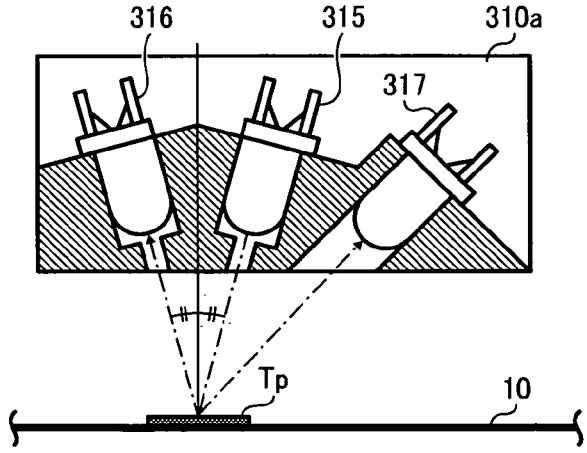
FIG. 8 shows a schematic configuration of a first sensor of a sensor unit used in the image forming apparatus of FIG. 4.

FIG. 7 illustrates a schematic configuration of the second sensor 310*b*, and FIG. 8 illustrates a schematic configuration of the first sensor 310*a*, such sensors are used to detect a toner pattern Tp.

Figure 9:
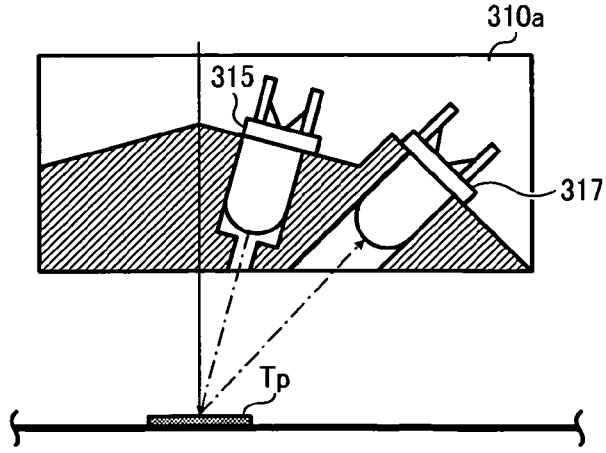
FIG. 9 shows a schematic configuration of diffuse-reflection type sensor usable as a first sensor.

Specifically, the second sensor 310*b* used for detecting a black toner pattern may include an LED (light emitting diode) 315 and a regular reflection light receiving element 316 as shown in FIG. 7, thereby the second sensor 310*b* is used as a regular-reflection type sensor. The first sensor 310*a* used for detecting non-black color toner pattern(s) may include an LED 315, a regular reflection light receiving element 316, and a diffuse reflection light receiving element 317 as shown in FIG. 8, thereby the first sensor 310*a* is used as a regular/diffuse-reflection type sensor. As shown in FIG. 9, a diffuse-reflection type sensor including the LED 315 and the diffuse reflection light receiving element 317 can be used to detect non-black color toner pattern(s). The LED 315, used as a light emitting element, may include a GaAs (gallium arsenide) infrared emission diode having a peak-emission wavelength $\lambda p$ of 950 nm (nanometer), and the light receiving element may include Si (silicon) phototransistor having a light-sensitive peak wavelength of 800 nm. Further, the first sensor 310*a* and second sensor 310*b* are disposed at a position distanced from a face of the intermediate transfer belt 10 by 5 mm (i.e., a detection distance is set to 5 mm), for example.

As shown in FIG. 4, the optical writing unit 900 is disposed over the image forming engines 18Y, 18C, 18M, and 18K. The optical writing unit 900 emits a laser beam to the photoconductors 20Y, 20C, 20M, and 20K (used as image carrier) to write a latent image on the photoconductors 20Y, 20C, 20M, and 20K. The laser beam, emitted by a laser unit and a laser control unit, may be generated based on image information of document scanned by the scanner 300. The laser unit may be a plane emission laser, an end face emission laser, or an LED array, but not limited these.

Figure 10:
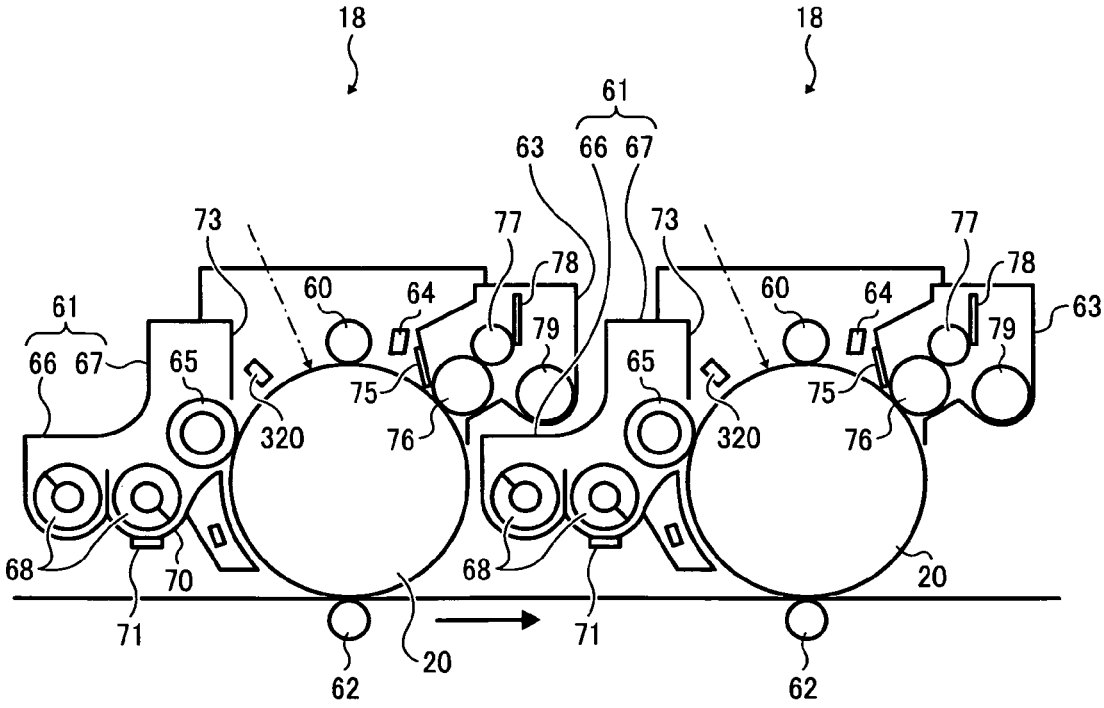
FIG. 10 shows an expanded view of image forming units used in the image forming apparatus of FIG. 4.

A description is now given of a configuration of the image forming engines 18Y, 18C, 18M, and 18K. Because the image forming engines 18Y, 18C, 18M, and 18K have similar configuration one to another, the image forming engine 18K for forming black toner image is described with reference to FIG. 10. FIG. 10 shows a configuration of the image forming engines 18M and 18K, which are adjacent each other. In FIG. 10, reference characters for color "M" and "K" are omitted.

The image forming engine 18 includes the photoconductor 20, a charge unit 60, a development unit 61, a photoconductor cleaning unit 63, and a de-charge unit 64. Further, a first-stage transfer unit 62 faces the photoconductor 20 via the intermediate transfer belt 10.

The charge unit 60 may be a charge roller that contacts the photoconductor (i.e., contact-type charger), which uniformly charges a surface of the photoconductor 20 by applying a charge voltage. The charge unit 60 can employ a non-contact charge unit such as for example scorotron charger.

Further, the development unit 61 may use two-component developer including magnetic carrier and non-magnetic toner. The development unit 61 can also use one-component developer including toner at least. The development unit 61 includes an agitation section 66 and a development section 67, encased in a casing 70. In the agitation section 66, two-component developer (hereinafter, "developer") is agitated and transported, and supplied on a development sleeve 65 (used as a developer carrier). The agitation section 66 includes two screws 68 placed in a parallel direction, and further includes a separation wall between the two screws 68. The separation wall has openings at its both end portions so that the developer can be communicated to and from spaces provided with the two screws 68. Further, the casing 70 includes a toner concentration sensor 71 to detect toner concentration of the developer in the development unit 61.

In the development section 67, toner in the developer is carried on the development sleeve 65, and then the toner is transferred from the development sleeve 65 to the photoconductor 20. The development section 67 includes the development sleeve 65 facing the photoconductor 20 through an opening of the casing 70. The development sleeve 65 includes magnets fixed inside the development sleeve 65. Further, a doctor blade 73 is disposed over the development sleeve 65. The doctor blade 73 and the development sleeve 65 may be disposed with a given gap (e.g., 0.35 mm).

In the development unit 61, the developer is agitated and transported by the two screws 68, and supplied to the development sleeve 65. The developer can be carried on the development sleeve 65 as magnetic brushes with an effect of the magnets. The developer on the development sleeve 65 is further transported with a rotation of the development sleeve 65, and the amount of developer can be regulated by the doctor blade 73. The developer removed by the doctor blade 73 is returned to the agitation section 66.

As such, the developer formed as the magnetic brushes on the development sleeve 65 can be transported to a development area facing the photoconductor 20. In the development area, a development electric field is formed between the development sleeve 65 and the photoconductor 20 with an effect of a development bias voltage applied to the development sleeve 65. Toner in the developer is transferred to a latent image formed on the photoconductor 20 with an effect of the development electric field. Accordingly, the latent image on the photoconductor 20 can be developed as a toner image. After such toner transfer at the development area, the developer passed the development area is separated from the development sleeve 65, and returned to the agitation section 66. When toner concentration in the agitation section 66 becomes lower by repeating such development process, the toner concentration sensor 71 detects such low toner-concentration condition, and new toner may be supplied to the agitation section 66 based on the detection result detected by the toner concentration sensor 71.

The first-stage transfer unit 62 may employ a primary transfer roller, which presses the intermediate transfer belt 10 to the photoconductor 20. The first-stage transfer unit 62 may be a roller type, or other type, such as for example, a conductive fur brush, a non-contact corona charger, but not limited these.

The photoconductor cleaning unit 63 includes a cleaning blade 75, wherein a leading edge of the cleaning blade 75 is pressed against the photoconductor 20. The cleaning blade 75 may be made of polyurethane rubber, for example. Further, the photoconductor cleaning unit 63 also includes a fur brush 76, made of a conductive material, which contacts the photoconductor 20 to enhance a cleaning performance. Toner removed from the photoconductor 20 by the cleaning blade 75 and the fur brush 76 can be stored in the photoconductor cleaning unit 63.

The de-charge unit 64 may employ a de-charge lamp, which emits light to the photoconductor 20 to re-set a surface potential of the photoconductor 20 for a next image forming operation.

Further, the image forming engine 18 includes a potentiometer 320, which faces the photoconductor 20 (see FIG. 10). The potentiometer 320 detects a surface potential of the photoconductor 20. The potentiometer 320 may have a longer side which is parallel to an axis direction of the photoconductor 20, wherein such longer side may also be parallel to a longer side of the image concentration sensor 310 (i.e., the belt width direction W in FIG. 6).

The image forming engine 18 may have following specific configurations, for example. The photoconductor 20 has a diameter of 60 mm, and the photoconductor 20 has a linear velocity of 282 mm/s. The development sleeve 65 has a diameter of 25 mm, and the development sleeve 65 rotates at a linear velocity of 564 mm/s. A charge amount of toner in the developer, to be supplied to the development area, is preferably set to minus 10 μC/g to minus 30 μC/g. A development gap between the photoconductor 20 and the development sleeve 65 is set from 0.5 mm to 0.3 mm (the smaller the development gap, the better the development efficiency). The photoconductor 20 has a photoconductive layer having a thickness of 30 μm. The optical writing unit 900 includes a beam unit, in which a beam spot diameter is 52×55 μm, and a light intensity is about 0.075 mW. For example, when the charge unit 60 uniformly charges the photoconductor 20 at −700 V, and the optical writing unit 900 emits a laser beam to form a latent image, the latent image has a potential of −250 V. Then, a development bias voltage is set to −550 V to obtain a development potential of 300 V. Such conditions for image forming processes can be changed based on a detection result of a potential control process.

In the image forming engine 18, the charge unit 60 uniformly charges the surface of the photoconductor 20, which is rotating in a given direction. Then, the optical writing unit 900 emits a laser beam onto the photoconductor 20 to write a latent image on the photoconductor 20, in which the laser beam is generated based on image information scanned by the scanner 300. Then, the development unit 61 develops the latent image as a toner image. The toner image is then primary transferred to the intermediate transfer belt 10 by the first-stage transfer unit 62. After the primary transfer process, the photoconductor cleaning unit 63 removes residual toner from the surface of the photoconductor 20, and the surface of the photoconductor 20 is de-charged by the de-charge unit 64 to prepare the photoconductor 20 for a next image forming operation.

As shown in FIG. 5, a second-stage transfer 24 unit is disposed at a position facing the third support roller 16. The second-stage transfer unit includes a secondary transfer roller 24*a*. When the toner image is secondary transferred from the intermediate transfer belt 10 to the transfer sheet 5, the secondary transfer roller 24*a* is pressed against the intermediate transfer belt 10 extended by the third support roller 16. The second-stage transfer unit 24 may employ the secondary transfer roller 24*a*, or other devices, such as for example a transfer belt, a non-contact transfer charger. Toner adhered on the secondary transfer roller 24*a* may be cleaned by a cleaning device 91, which contacts the secondary transfer roller 24*a*.

Further, a transport belt 22, looped by rollers 22*a* and 23*b*, is disposed in the downstream of the transport direction of the transfer sheet 5 relative to the secondary transfer roller 24*a*. The transfer sheet 5 is transported to the fixing unit 25 by the transport belt 22. The fixing unit 25 fixes the toner image on the transfer sheet 5. The fixing unit 25 includes a heat roller 26 and a pressing roller 27 pressed against the heat roller 26.

Further, a belt cleaning unit 17 is disposed at a position facing the second support roller 15 via the intermediate transfer belt 10. The belt cleaning unit 17 removes toner remaining on the intermediate transfer belt 10 after the toner image is transferred from the intermediate transfer belt 10 to the transfer sheet 5.

Further, as shown in FIG. 4, the image forming unit 100 includes a transport route 48, through which the transfer sheet 5 is fed from the sheet feed unit 200 to the secondary transfer roller 24*a*, and then guided to the sheet ejection tray 7. Further, a transport roller 49*a*, a registration roller 49*b*, and an ejection roller 56 are disposed along the transport route 48. Further, a switchover claw 55 is disposed at the downstream of the transport route 48 to change a transport direction of the transfer sheet 5 after fixing the toner image on the transfer sheet 5. For example, the transfer sheet 5 may be transported to the sheet ejection tray 7 or a sheet reverse unit 93. The sheet reverse unit 93 reverses faces of the transfer sheet 5, and then feeds the face-reversed transfer sheet 5 to the secondary transfer roller 24*a* again. Further, the image forming unit 100 includes a manual feed route 53, which may connect the manual feed tray 6 and the transport route 48. A feed roller 50 and a separation roller 51 are disposed at the upstream of the manual feed route 53 to feed the transfer sheet 5, set on the manual feed tray 6, one by one.

The sheet feed unit 200 includes sheet trays 44, a sheet feed roller 42, a separation roller 45, a sheet feed route 46, and a transport roller 47. The sheet trays 44 store a given volume of the transfer sheet 5. The sheet feed roller 42 and the separation roller 45 feed the transfer sheet 5 one by one, stored in the sheet trays 44, to the sheet feed route 46 having the transport roller 47. The sheet feed route 46 is connected to the transport route 48 in the image forming unit 100.

Figure 11:
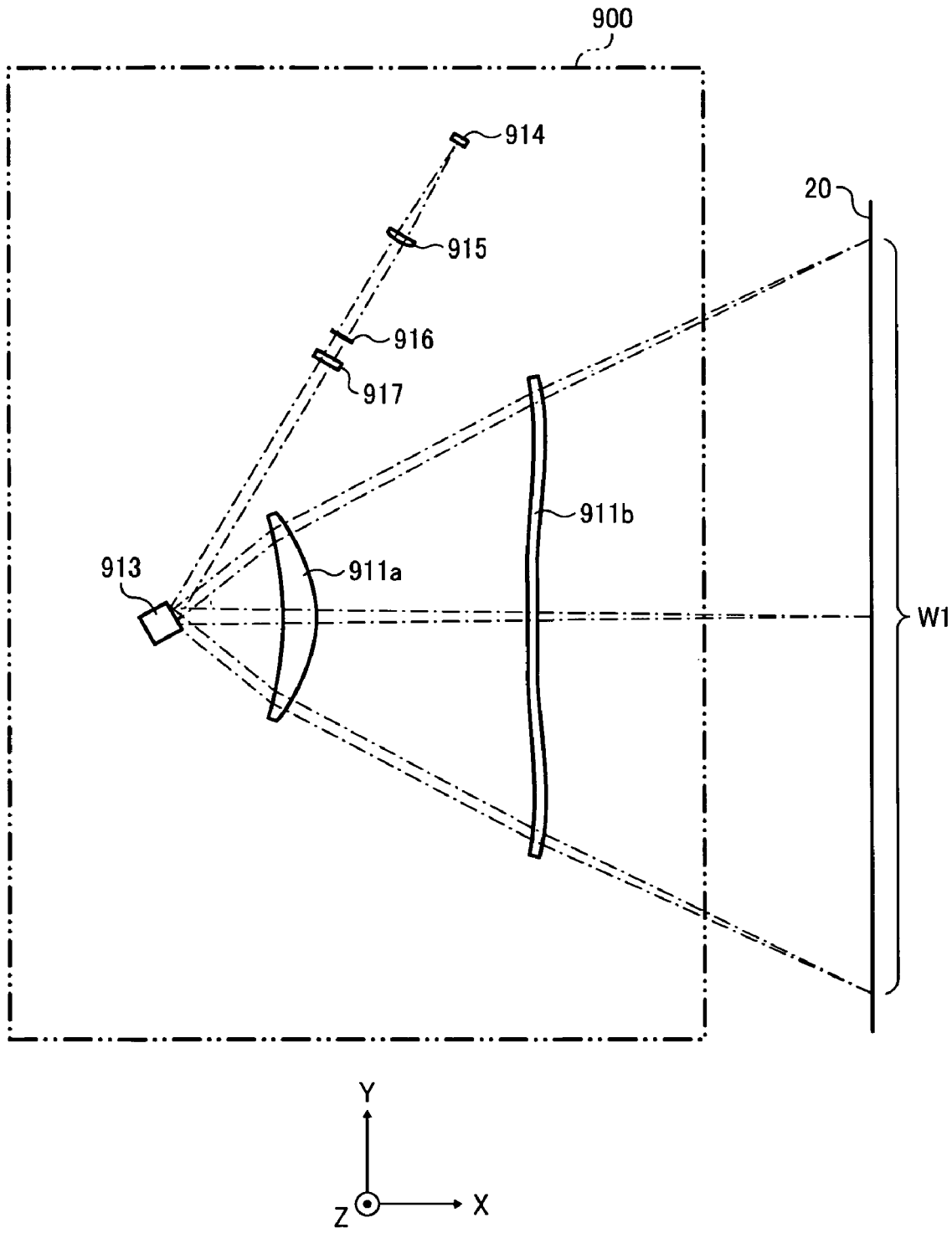
FIG. 11 shows a schematic configuration of an optical system for an exposure unit used in the image forming apparatus of FIG. 4.
Figure 12:
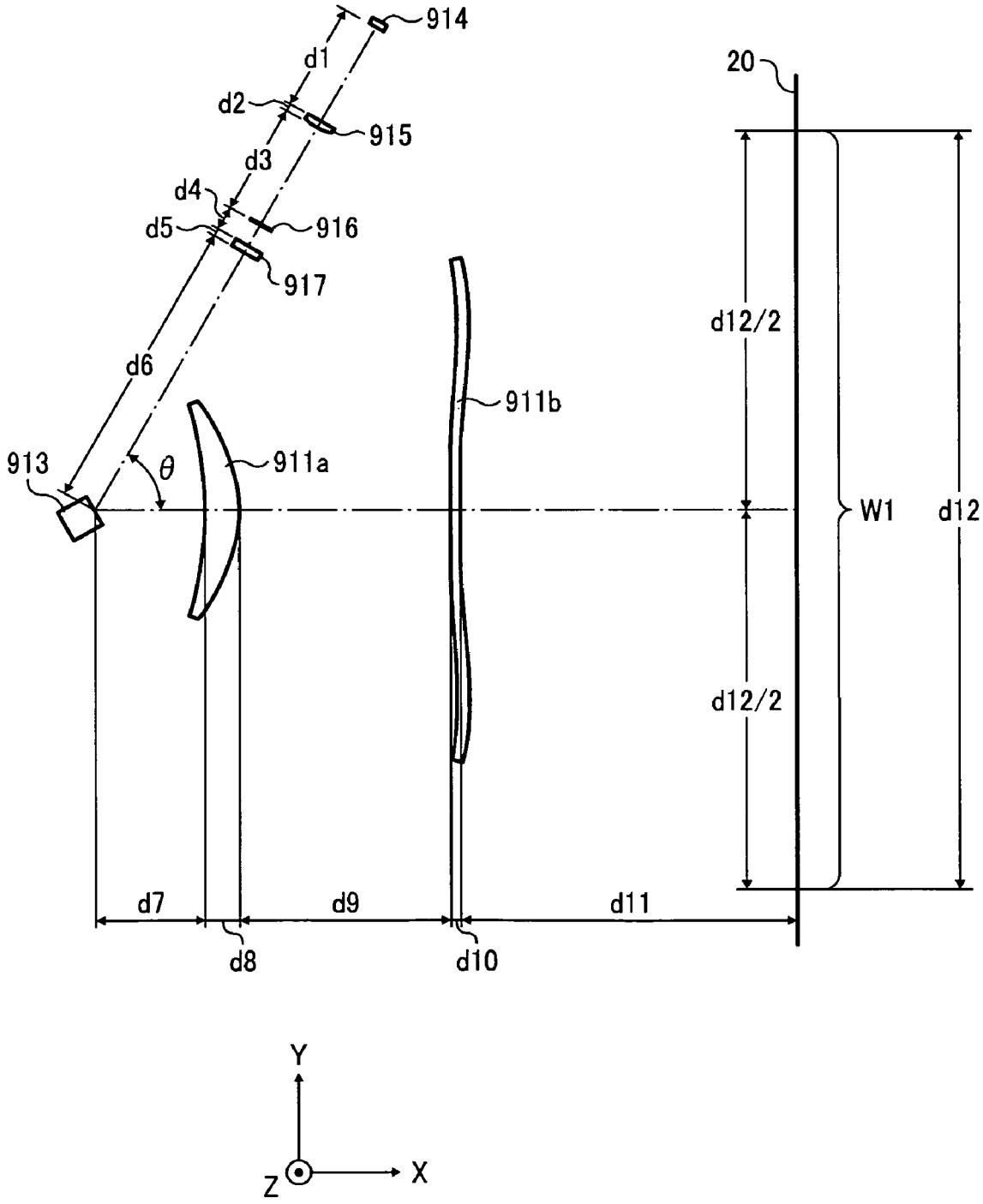
FIG. 12 shows distances between optical devices in the exposure unit of FIG. 11.

A description is now given of the optical writing unit 900 with reference to FIG. 11 and FIG. 12. The optical writing unit 900 includes a light source 914, a coupling lens 915, an aperture member 916, a cylindrical lens 917, a polygon mirror 913, a polygon motor, and two scan lenses 911*a* and 911*b*, for example. The cylindrical lens 917 is used to form image, the polygon mirror 913, driven by the polygon motor, is used to deflect a light beam.

The coupling lens 915 may be a glass lens having a focal length of 46.5 mm and a thickness of 3.0 mm (d2 in FIG. 12), for example. The coupling lens 915 can convert a light flux emitted from the light source 914 as a substantially parallel light.

The aperture member 916 may have an opening portion shaped in a rectangular shape or an elliptical shape to regulate a beam diameter of light flux coming from the coupling lens 915. Such opening may have a width of 5.8 mm in a main scanning direction and a width of 1.22 mm in a sub-scanning direction, for example. The opening portion will be described in detail later with a light intensity monitoring system to be described later.

The cylindrical lens 917 may be a glass lens having a focal length of 106.9 mm and a thickness of 3.0 mm (d5 in FIG. 12), for example. The cylindrical lens 917 focuses the light flux passing through the opening portion of the aperture member 916 on a deflection mirror face of the polygon mirror 913 in a sub-scanning direction.

The polygon mirror 913 may have four deflection mirror faces, which may rotate about its axis at a constant velocity. Such polygon mirror 913 may have an inscribed circle having a radius of 7 mm.

The scan lens 911*a* may be a resin lens having a center thickness of 13.50 mm along the light axis (d8 in FIG. 12), for example.

The scan lens 911*b* may be a resin lens having a center thickness of 3.50 mm along the light axis (d10 in FIG. 12), for example.

Optical elements disposed along a light path between the light source 914 and the polygon mirror 913 may be called as a coupling optical system. For example, the coupling optical system includes the coupling lens 915, the aperture member 916, and the cylindrical lens 917.

Optical elements disposed along a light path between the polygon mirror 913 and the photoconductor 20 may be called as an optical scan system. For example, the optical scan system includes the scan lenses 911*a* and 911*b*.

The optical scan system has a lateral magnification of 0.97-magnification in a sub-scanning direction, for example. Further, the optical writing unit 900 as a whole has a lateral magnification of 2.2-magnification in a sub-scanning direction, for example.

In an exemplary embodiment, a beam spot diameter formed on the surface of the photoconductor 20 may be set to 52 μm in a main scanning direction, and 55 μm in a sub-scanning direction as a target beam spot diameter, for example.

Further, a distance between the light source 914 and the coupling lens 915 (d1 in FIG. 12) is 46.06 mm, a distance between the coupling lens 915 and the aperture member 916 (d3 in FIG. 12) is 47.69 mm, a distance between the aperture member 916 and the cylindrical lens 917 (d4 in FIG. 12) is 10.32 mm, and a distance between the cylindrical lens 917 and the polygon mirror 913 (d6 in FIG. 12) is 128.16 mm, for example.

Further, a distance between the polygon mirror 913 and a first face (or light-entering face) of the scan lens 911*a* (d7 in FIG. 12) is 46.31 mm, a distance between a second face (or light-outgoing face) of the scan lens 911*a* and a first face (or light-entering face) of the scan lens 911*b* (d9 in FIG. 12) is 89.73 mm, and a distance between a second face (or light-outgoing face) of the scan lens 911*b* and the surface of the photoconductor 20 (d11 in FIG. 12) is 141.36 mm, for example. The light beam scans the surface of the photoconductor 20.

Further, an effective scanning width W1 (d12 in FIG. 12) on the photoconductor 20 is 323 mm. Further, an angle θ in FIG. 12 is 60 degrees, for example.

Figure 13:
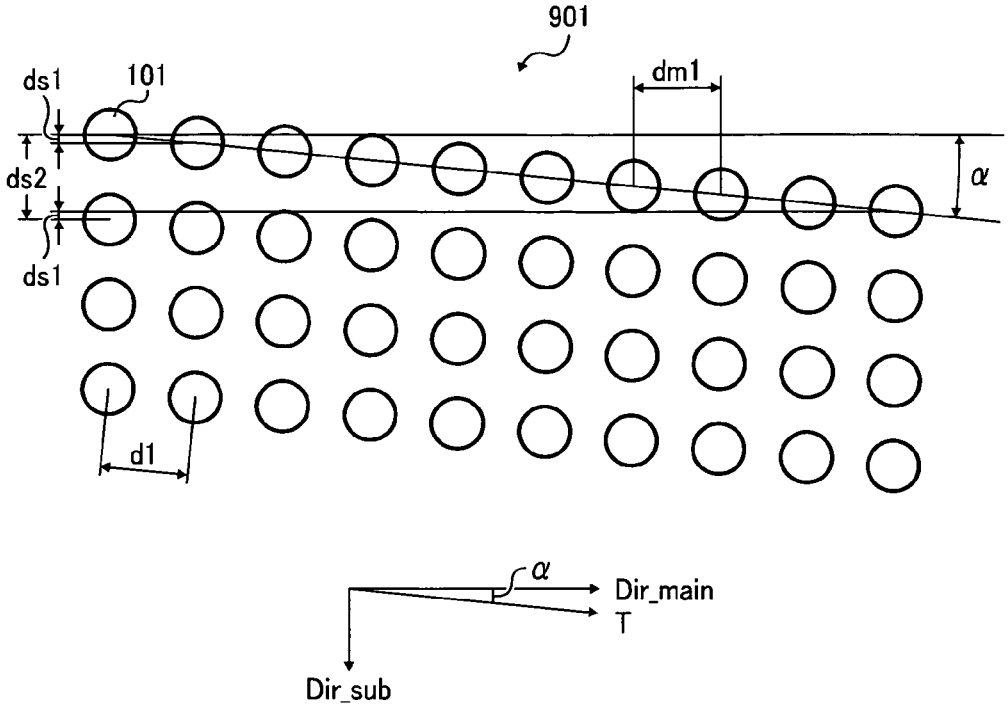
FIG. 13 shows a schematic configuration of light source of two-dimensional array.

As shown in FIG. 13, the light source 914 may include a second-dimensional array 901. The second-dimensional array 901 may include a plurality of the light-emitting members 101 on one substrate. For example, forty light-emitting members 101 may be installed on one substrate. In the second-dimensional array 901, ten light-emitting members 101 are arranged in a main scanning direction or a first direction (hereinafter refer to "Dir_main direction") as one row, and such a row is disposed four times in a sub-scanning direction or a second direction (hereinafter refer to "Dir_sub direction"), in which light-emitting members 101 are disposed with a same interval to adjacent light-emitting members 101, and four rows are disposed with a same interval in the Dir_sub direction. Further, as shown in FIG. 13, the light-emitting members 101 in one row may be inclined in a third direction (hereinafter refer to "T direction") with an inclined angle α. Accordingly, forty light-emitting members 101 are arranged two-dimensionally in the T direction and Dir_sub direction.

Further, for example, an interval of adjacent rows is 24.0 μm in the Dir_sub direction (ds2 in FIG. 13), and each of the light-emitting members 101 have an interval of 24.0 μm in the T direction (d1 in FIG. 13). Further, when each of the light-emitting members 101 is orthogonally projected on a phantom line extending in the Dir_sub direction, the light-emitting members 101 has an interval of 2.4 μm (ds1 in FIG. 13). Accordingly, relations of ds2=d1 and ds2=ds1×M is defined.

Figure 14:
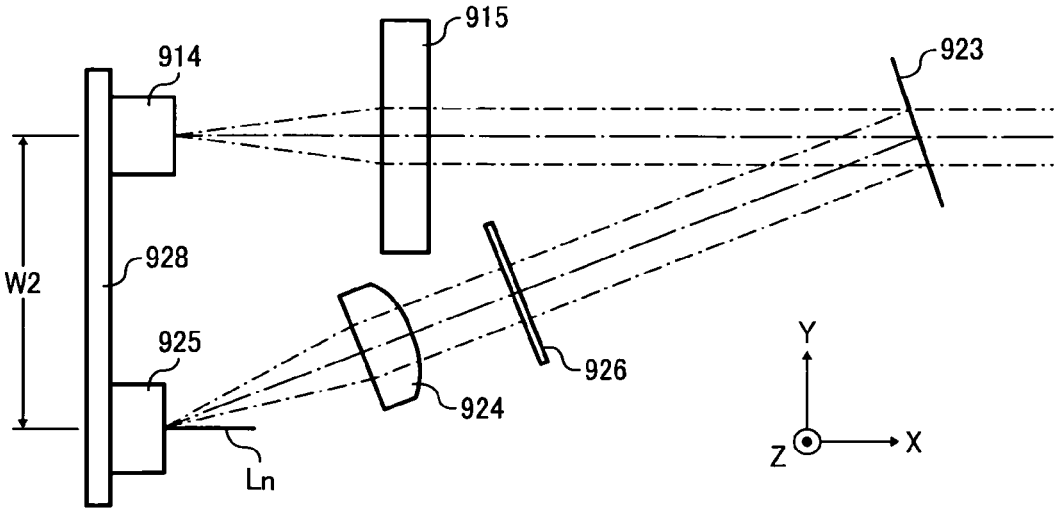
FIG. 14 shows a schematic configuration of a monitoring unit for monitoring light.

A description is now given of a light intensity monitoring system, which detects light intensity of light beam emitting from the light source 914 with reference to FIG. 14. The light intensity monitoring system includes the light source 914, the coupling lens 915, a first opening plate 923, a second opening plate 926, an imaging lens 924, a photodiode 925, and a substrate 928.

Figure 15A:
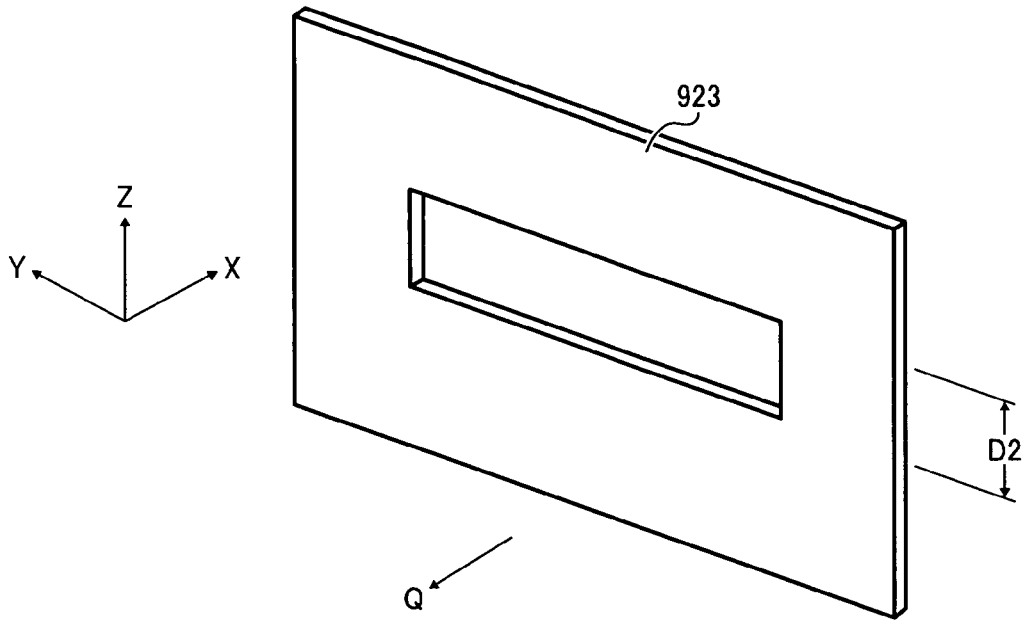
FIG. 15A shows a perspective view of a first plate having a first opening.

As shown in FIG. 15A, the first opening plate 923 has an opening portion, which is used to regulate a beam diameter of light flux coming from the coupling lens 915. The first opening plate 923 is disposed at a given position so that a maximum light intensity of light flux can pass through a substantially center portion of the opening portion. Further, a reflection member is disposed around the opening portion of the first opening plate 923.

The first opening plate 923 is slanted from a phantom plane, which is perpendicular to a light progressing direction of light flux coming from the coupling lens 915, so that light flux reflected on the reflection member disposed around the opening portion can be used as light flux for monitoring. Accordingly, the first opening plate 923 allows a light flux portion having maximum light intensity to pass through the opening portion of the first opening plate 923, and the first opening plate 923 reflects a light flux portion having smaller light intensity as a light flux for monitoring. A direction of such reflected light flux may be referred to "Q direction." Accordingly, the first opening plate 923 may be used as a light-splitting optical device.

Figure 15B:
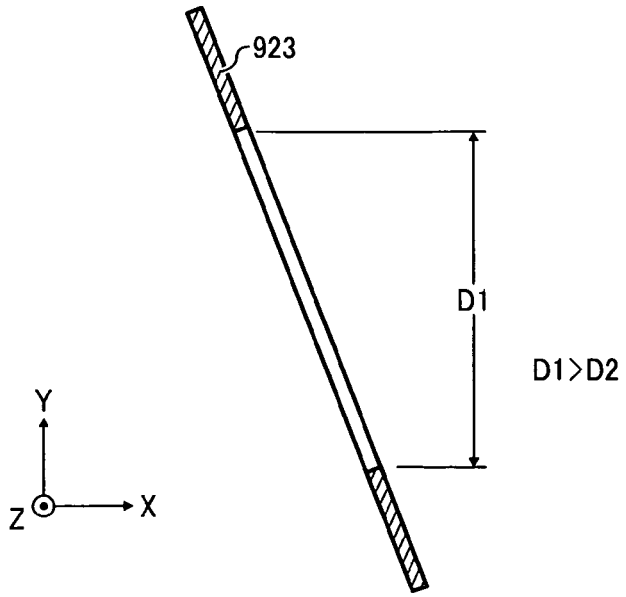
FIG. 15B shows a cross-sectional view of the first plate cut at X-Y plane.

As shown in FIGS. 15A and 15B, the opening portion of the first opening plate 923 has a width D2 of 1.28 mm in a sub-scanning direction (Z-axis direction) and a width D1 of 5.8 mm in a main scanning direction (Y-axis direction), which means the width D1 is set greater than the width D2 (D1>D2). FIG. 15B shows a X-Y cross-sectional view of the first opening plate 923 cut at a center of the opening portion in the Z-axis direction.

Figure 16:
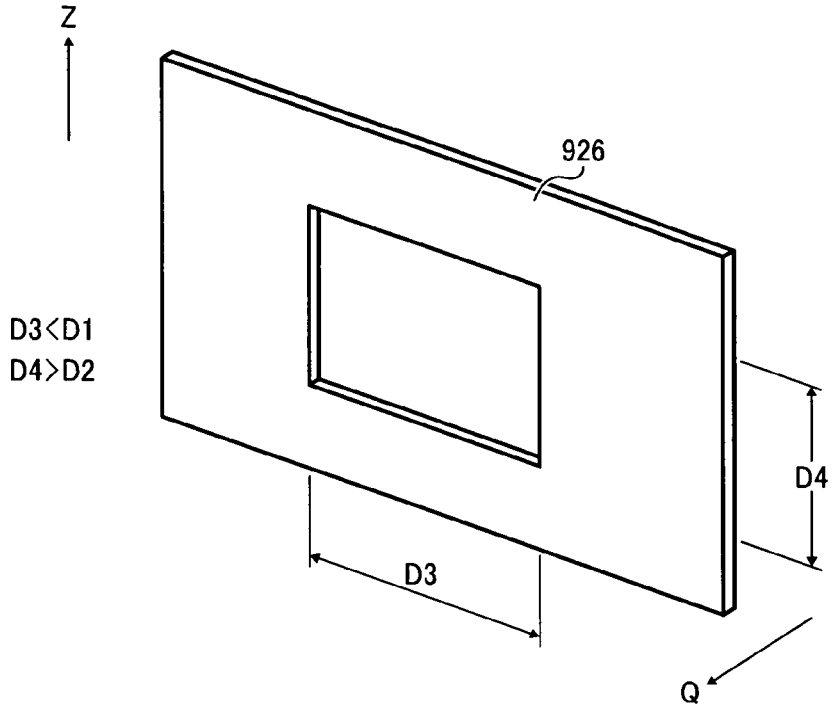
FIG. 16 shows a perspective view of a second plate having a second opening.
Figure 17A:
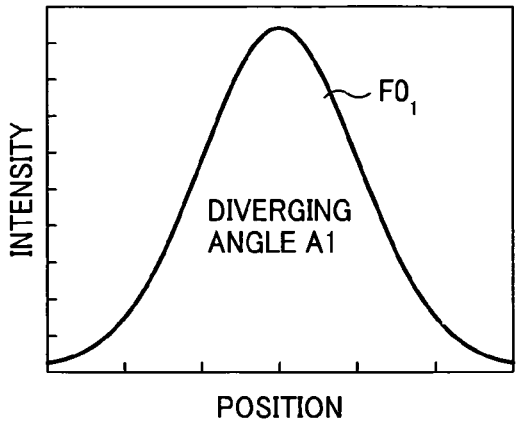
FIG. 17A shows a light intensity profile having light flux $F0_1$.
Figure 17B:
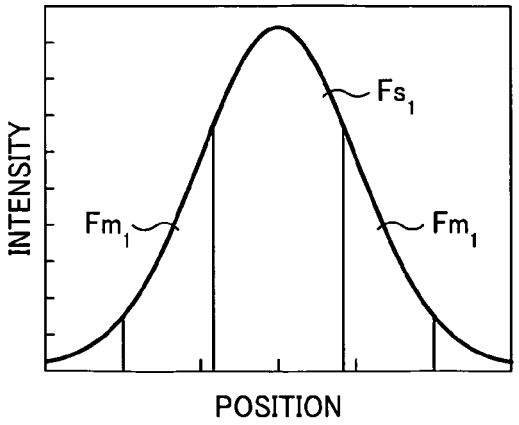
FIG. 17B shows light flux distribution passed through the first plate having the first opening.

The second opening plate 926 is disposed at a position corresponding to a light path of light flux for monitoring reflected by the first opening plate 923. As shown in FIG. 16, the second opening plate 926 has an opening portion to regulate a beam diameter of light flux for monitoring. Accordingly, the second opening plate 926 may be used as a light-limiting device.

Further, the second opening plate 926 is disposed at a position near a focus point of the coupling lens 915. Accordingly, if the light flux for monitoring includes multiple beams, main light beam of each of light flux can be guided to the second opening plate 926, and each of light flux can be shaped in a similar shape.

The opening portion of the second opening plate 926 has a width D4 of 3.25 mm in a sub-scanning direction (Z-axis direction), and a width D3 of 3.8 mm in a direction perpendicular to Z-axis direction, which means the width D3 is set smaller than the width D1 (D3<D1), and the width D4 is set greater than the width D2 (D4>D2).

For example, as shown in FIGS. 44A and 44B, when the light source 914 outputs a light flux $F0_1$ having a diverging angle A1, a light flux portion $Fs_1$ of the light flux $F0_1$ passes through the opening portion of the first opening plate 923, and a light flux portion $Fm_1$ passes through the opening portion of the second opening plate 926.

Figure 18A:
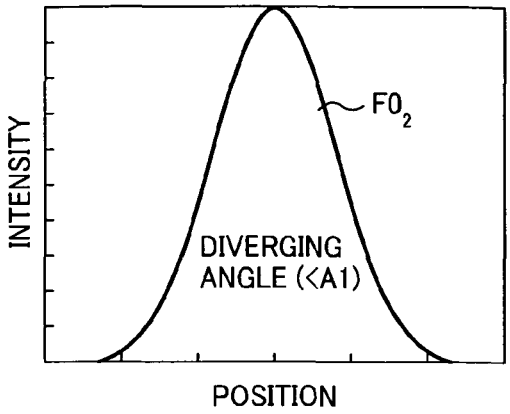
FIG. 18A shows a light intensity profile having light flux $F0_2$.
Figure 18B:
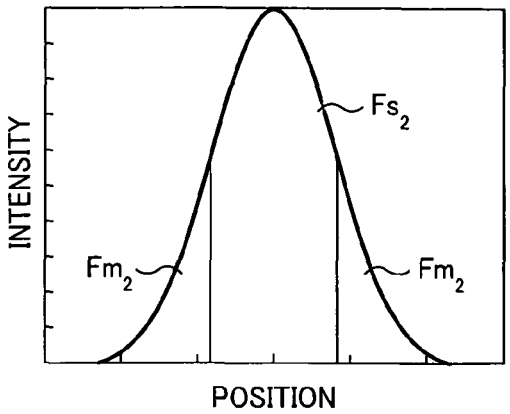
FIG. 18B shows light flux distribution passed through the first plate having the first opening.

Further, as shown in FIGS. 18A and 18B, when the light source 914 outputs a light flux $F0_2$, which may have a higher peak intensity at the center of the of light intensity profile compared to the light flux $F0_1$ and a diverging angle A2 smaller than the diverging angle A1 (A2<A1), a light flux portion $Fs_2$ of the light flux $F0_2$ passes through the opening portion of the first opening plate 923, and a light flux portion $Fm_2$ of the light flux $F0_2$ passes through the opening portion of the second opening plate 926.

Figure 19A:
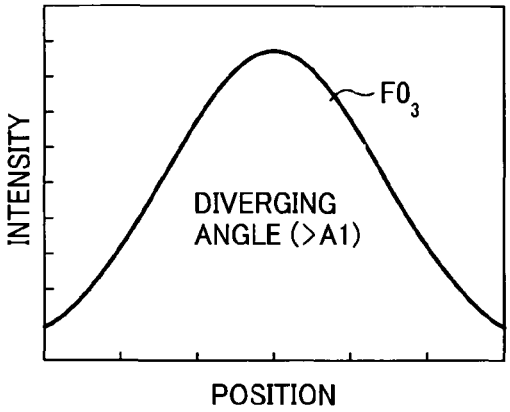
FIG. 19A shows a light intensity profile having light flux $F0_3$.
Figure 19B:
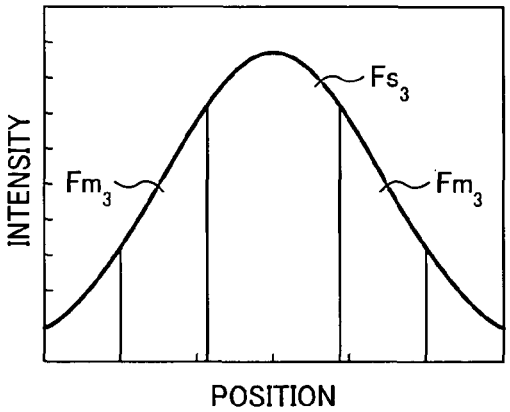
FIG. 19B shows light flux distribution passed through the first plate having the first opening.

Further, as shown in FIGS. 19A and 19B, when the light source 914 outputs a light flux $F0_3$, which may have a less sharp light intensity profile than the light flux $F0_1$ and a diverging angle A3 greater than the diverging angle A1 (A3>A1), a light flux portion $Fs_3$ of the light flux $F0_3$ passes through the opening portion of the first opening plate 923, and a light flux portion $Fm_3$ passes through the opening portion of the second opening plate 926.

Figure 20:
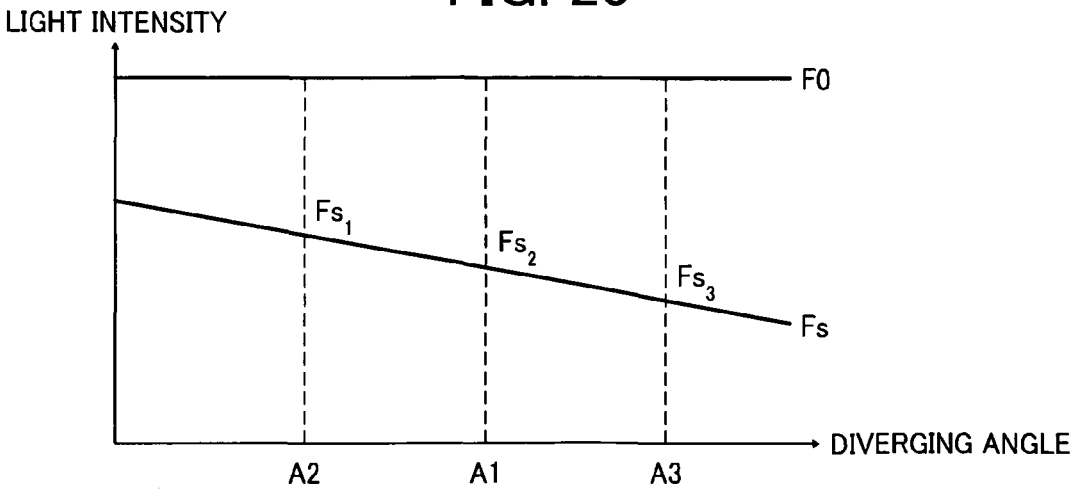
FIG. 20 shows a relation of light intensity of light flux F0 and light flux Fs and diverging angles of light, in which the light intensity of light flux F0 is set at constant.

If the light source 914 outputs light flux (light flux F0) having a greater diverging angle, light intensity of light flux (light flux Fs) passing through the opening portion of the first opening plate 923 decreases as shown in FIG. 20, for example, in which it is assumed that the light intensity of light flux F0 is constant even if the diverging angle changes.

Figure 21:
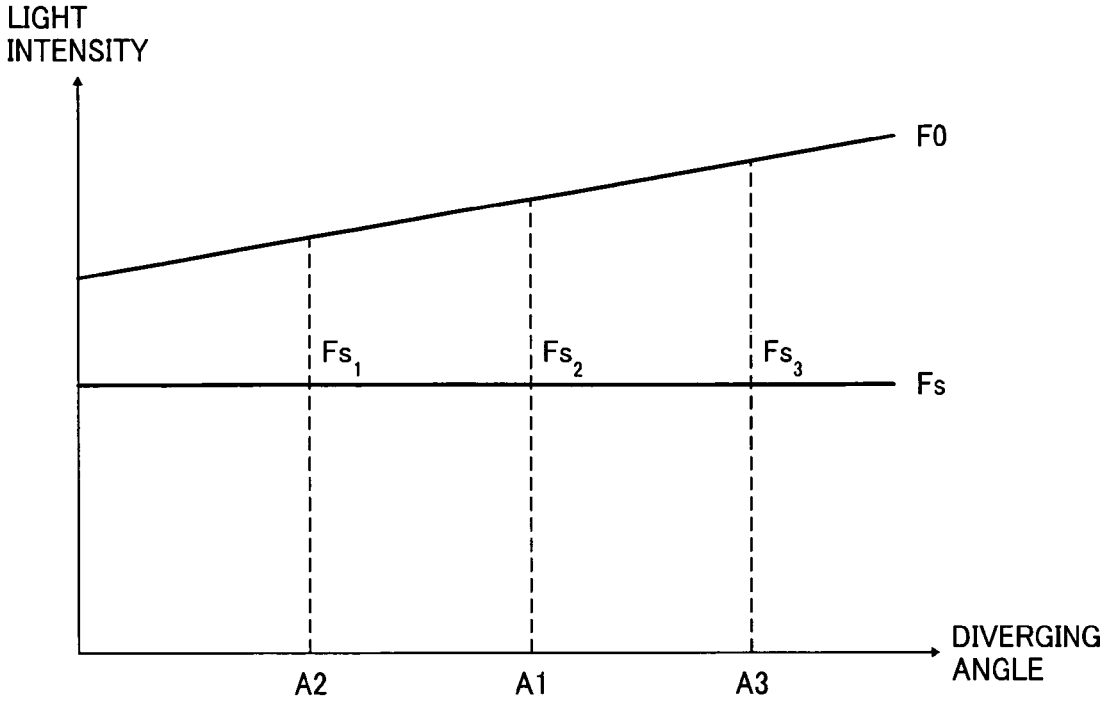
FIG. 21 shows a relation of light intensity of light flux F0 and light flux Fs and diverging angles of light, in which the light intensity of light flux Fs is adjusted at constant.

Accordingly, to keep the light intensity of the light flux Fs at a constant level, a light intensity of the light flux F0 may be set greater if a diverging angle of the light flux F0 becomes greater than a designed diverging angle value (e.g., A1), and a light intensity of the light flux F0 may be set smaller if a diverging angle of the light flux F0 becomes smaller than a designed diverging angle value (e.g., A1) as shown in FIG. 21.

Figure 22:
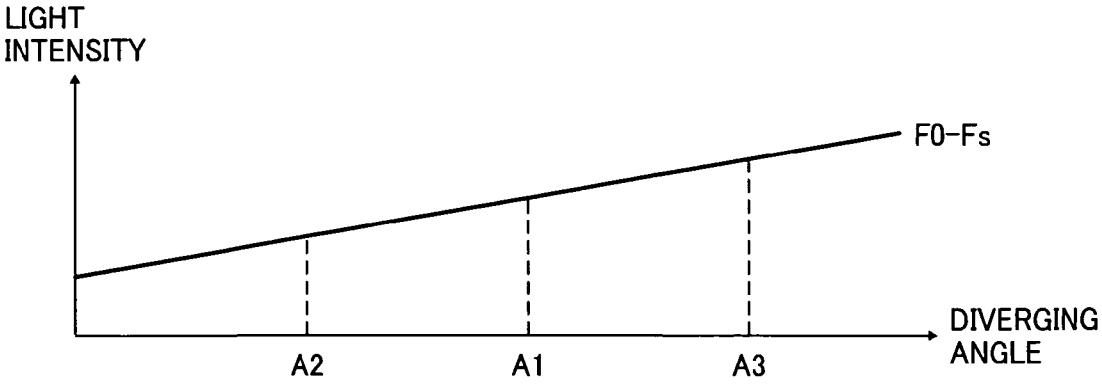
FIG. 22 shows a relation of light intensity of light flux reflected by the first plate and diverging angles of light flux F0.

In such a configuration, a light intensity of light flux reflected by the first opening plate 923 (i.e., light flux corresponding a difference of "F0−Fs") becomes greater when the diverging angle of the light flux F0 becomes greater as shown in FIG. 22.

When the second opening plate 926 is not disposed, the light flux of "F0−Fs" is received by the photodiode 925.

If an exposure power is adjusted using a typically or conventional automatic exposure power control or Auto Power Control (hereinafter, referred to APC control), a light intensity of light flux F0 is set further smaller when the diverging angle of light flux F0 becomes A3 (A3>A1); and a light intensity of light flux F0 is set further greater when the diverging angle of light flux F0 becomes A2 (A2<A1). As such, a light intensity of the light flux Fs may deviate from the above-mentioned constant level. Accordingly, the APC control may not be conducted precisely.

Figure 23:
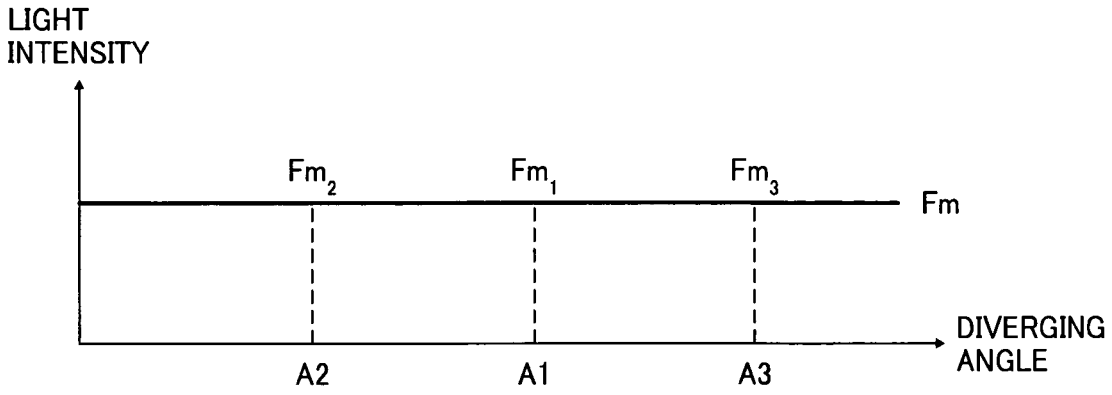
FIG. 23 shows a relation of light intensity of light flux received by a photodiode and diverging angles of light flux F0.

In an exemplary embodiment, light flux for monitoring is reflected by the first opening plate 923, and the second opening plate 926 is disposed at a position corresponding to a light path of the light flux for monitoring, by which the light flux for monitoring reflected by the first opening plate 923 is shaped in a given shape. With such a configuration, as shown in FIG. 23, a light intensity of light flux (light flux Fm) received by the photodiode 925 can be kept at a constant level as similar to light intensity of the light flux Fs even if the diverging angle of the light flux F0 changes.

Further, the opening portion of the first opening plate 923 and the opening portion of the second opening plate 926 have relations of "D3<D1" and "D4>D2." With such a configuration, even if the diverging angle of the light flux F0 changes greatly, a ratio of "light intensity of light flux Fs/light intensity of light flux Fm" can be kept at a substantially constant level.

Further, if the width D4, which corresponds to a sub-scanning direction, of the opening portion of the second opening plate 926 is set greater, light intensity (i.e., light intensity of light flux Fm) received by the photodiode 925 can be increased.

Figure 24:
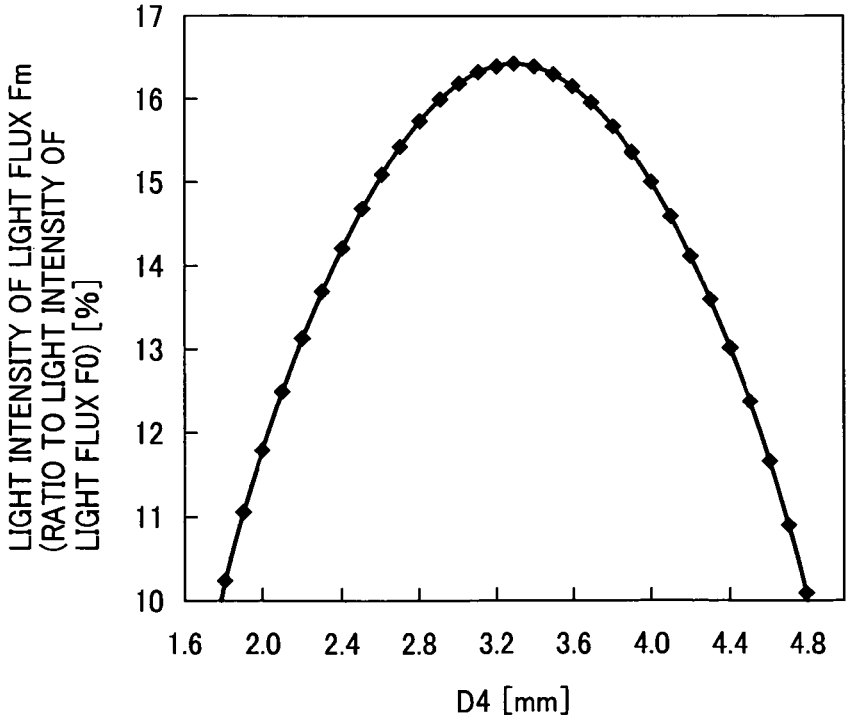
FIG. 24 shows a relation of light intensity of light flux Fm and D4 when a ratio of "light intensity of light flux Fs/light intensity of light flux Fm" is set at constant.

FIG. 24 show a relation of the width D4 and the light intensity of light flux Fm when a ratio of "light intensity of light flux Fs/light intensity of light flux Fm" is set at a constant level. As shown in FIG. 24, when the width D4 is increased, the light intensity of light flux Fm can be increased, but when the width D4 exceeds a given value, the light intensity of light flux Fm decreases. Such condition may occur because the width D3 needs to be decreased to kept the ratio of "light intensity of light flux Fs/light intensity of light flux Fm" if the width D4 is increased too great.

When the width D4 is in a range of 1.4 to 3.7 times of the width D2, the light intensity of light flux Fm exceeds 10% of the light intensity of light flux F0. For example, when the light source 914 emits a light beam having a light intensity of 1 mW, the photodiode 925 receives a light having a light intensity of 0.1 mW or greater. In such a configuration, an output signal of the photodiode 925 has a good level of S/N ratio (signal/noise ratio) and a response time, which means that the S/N ratio may not be decreased and the response time may not be delayed. Accordingly, light intensity can be detected precisely. In an exemplary embodiment, D3=3.8 mm and D4=3.25 mm are set to maximize the light intensity of light flux Fm shown in FIG. 24.

Figure 25:
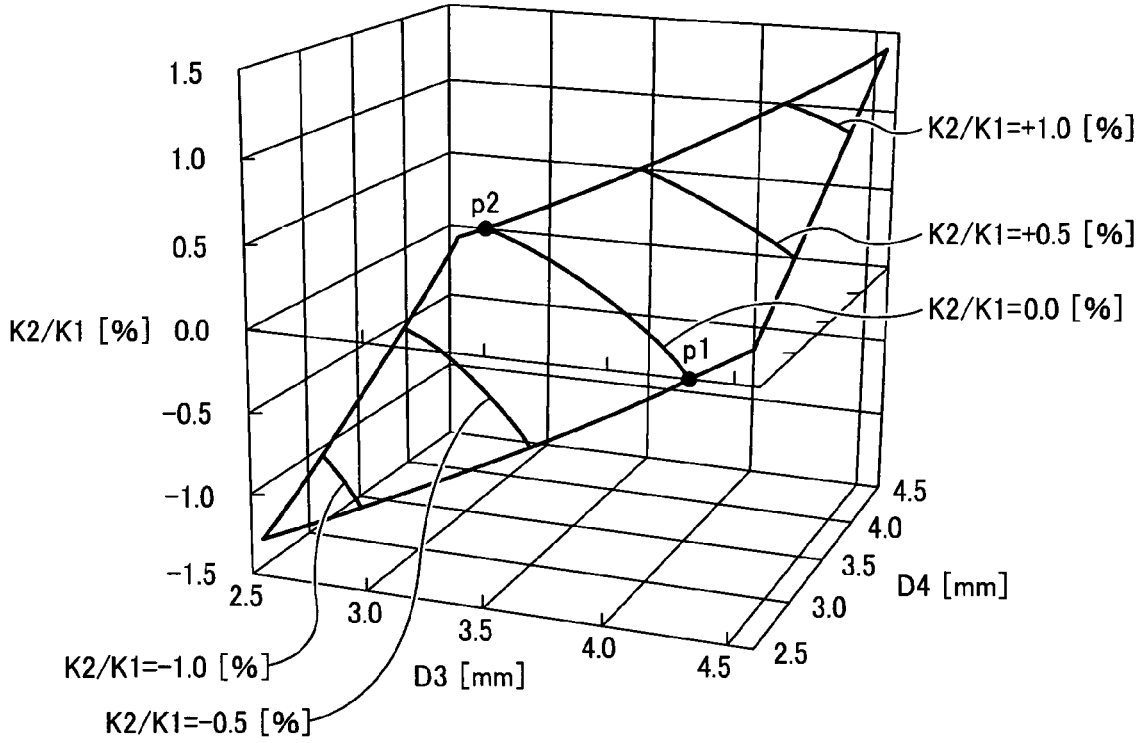
FIG. 25 shows profiles showing a relation of D3, D4, and K2/K1.

Further, FIG. 25 shows a relation of the width D3 and D4, and (K2/K1). K1 is a ratio of "light intensity of light flux Fs/light intensity of light flux Fm" when the diverging angle of light flux F0 is set to a given diverging angle (for example, A1), and K2 is a ratio of "light intensity of light flux Fs/light intensity of light flux Fm" when the diverging angle of light flux F0 changes isotropically in a main scanning direction and in a sub-scanning direction from the given diverging angle.

As can be seen in FIG. 25, when D3 is set at a constant and D4 is increased, K2/K1 becomes greater. Further, when D4 is set at a constant and D3 is decreased, K2/K1 becomes smaller. By using such relation, a combination of D3 and D4 that can keep the ratio of "light intensity of light flux Fs/light intensity of light flux Fm" at a constant level even if the diverging angle of the light flux F0 changes can be obtained, in which K2/K1 becomes 0.0%. As shown in FIG. 25, a profile for K2/K1=0.0%, which connects p1 (D3=4.3 mm, D4=2.5 mm) and p2 (D3=2.7 mm, D4=4.5 mm) can be obtained. Typically, if a light intensity changes 3% or more, uneven image concentration may be observed on a produced image. Accordingly, a change of K2/K1 is preferably set within 3%, by which a detection variation of light intensity due to a change of diverging angle of light flux F0 can be kept within ±3%.

When an diverging angle of light flux emitted from a light source changes isotropically, the light intensity of light flux Fs changes from Ps to Ps+ΔPs, and the light intensity of light flux Fm changes from Pm to Pm+ΔPm. Accordingly, if a change of K2/K1 is preferably set within 3%, a value of [(Ps+ΔPs)/(Pm+ΔPm)]/(Ps/Pm) can be preferably set from 0.97 to 1.03.

When the width D4 is in a range of 1.4 to 3.7 times of the width D2, the photodiode 925 can receive light having a good level of light intensity, and a ratio of "light intensity of light flux Fs/light intensity of light flux Fm" can be kept at a substantially constant even if the diverging angle changes.

For example, even if the diverging angle changes greatly, the light intensity of light flux Fm changes little if the light intensity of light flux Fs can be kept at constant. Accordingly, if the light intensity of light flux F0 is controlled in a manner that the photodiode 925 outputs an output signal having a given constant level output, the light intensity of light flux Fs can be set to a constant level.

The imaging lens 924 is disposed at a position distanced from the second opening plate 926 by 20 mm in "Q direction" to focus the light flux for monitoring passed through the opening portion of the second opening plate 926. The imaging lens 924 may have a focal length of 27 mm, for example.

The photodiode 925 is disposed at a position distanced from the imaging lens 924 by 10.6 mm in "Q direction" to receive the light flux for monitoring coming from the imaging lens 924. The photodiode 925 outputs a signal (photoelectric converted signal) corresponding to received light intensity.

The photodiode 925 has a light receiving face, which may be a square shape having a length of 1.1 mm for each of sides. The light receiving face may receive light at its center.

If the light receiving face of the photodiode 925 has fouling or scratches, and the light receiving face receives light at such scratched portion, received light intensity decreases greatly, by which a correct signal cannot be output. In view of such scratching, the light receiving face of the photodiode 925 can be disposed at a position that is deviated a little from a focus point of the imaging lens 924 in the "Q direction" to set a greater beam diameter on the light receiving face. If the beam diameter on the light receiving face can be set greater, received light intensity may be prevented from decreasing greatly even if the light receiving face has fouling or scratches.

Figure 26:
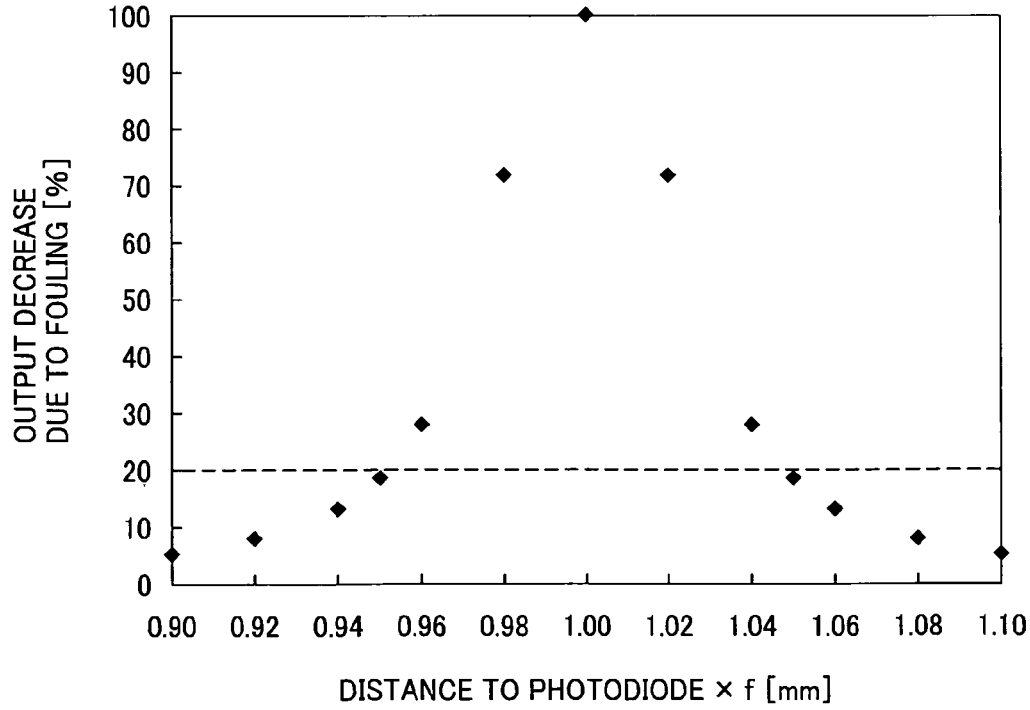
FIG. 26 shows profiles showing a relation of output loss of a photodiode and a distance between a focus lens and a photodiode when fouling adheres a center of light receiving face.

FIG. 26 shows a relation of a distance from the imaging lens 924 to the photodiode 925, and an output loss or decrease of the photodiode 925 when eye-recognizable fouling (having a diameter 50 μm) adheres the center of the light receiving face of the photodiode 925, in which the imaging lens 924 has a focal length "f."

If the distance from the imaging lens 924 to the photodiode 925 is set "f×0.95" or smaller, or "f×1.05" or greater, the output value of the photodiode 925 decreases 20% or less even if fouling (having a diameter ϕ 50 μm) adheres on the center of the light receiving face of the photodiode 925. Such output decrease can be corrected by a light intensity correction of the light source 914, which may be adjustable before shipping. In an exemplary embodiment, the distance from the imaging lens 924 to the photodiode 925 is set to "f×1.06."

Further, if the light flux for monitoring enters the light receiving face of the photodiode 925 perpendicularly, a reflection light reflected from the light receiving face may go back to the light source 914 along the light path of light, which came from the light source 914, by returning in an opposite direction in the light path. In view of such light reflection, as shown in FIG. 14, in an exemplary embodiment, a normal line Ln of the light receiving face at a position receiving the light flux for monitoring is inclined relative to an incoming light direction, by which a reflection light from the light receiving face may not return to the light source 914. Specifically, a light enters the light receiving face with an angle of 10 degrees, for example.

Further, optical devices disposed at a position between the light source 914 and the photodiode 925 has a lateral magnification β of about 0.5 times, and a long side of the second-dimensional array 901 has a length of 0.3 mm, for example. Accordingly, a light coming from the second-dimensional array 901 is projected with a length of 0.3 mm×0.5=0.15 mm on the light receiving face of the photodiode 925.

Typically, a detection sensitivity of photodiode may vary depending on light receiving position. Accordingly, it is preferable to receive light at a center portion of a light receiving face.

Figure 27:
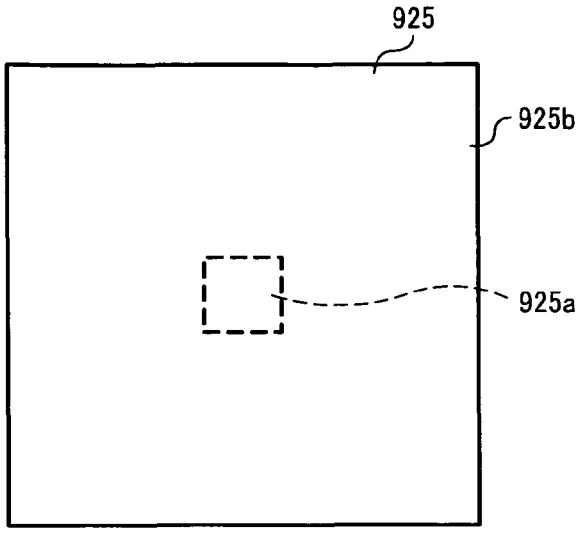
FIG. 27 shows a light receiving face and light receiving area of photodiode.

As shown in FIG. 27, in an exemplary embodiment, the photodiode 925 has a light receiving face 925*b* (e.g., 1.1 mm×1.1 mm) and a light receiving area 925*a*. The light receiving area 925*a* is disposed at the center of the light receiving face 925*b* to receive light, and closer to the center that is less than a half of one side length, for example. Accordingly, if the second-dimensional array 901 has a long side having a length L, and the photodiode 925 has a length L' in a direction of the long side of the second-dimensional array 901, a relation of $(L\times\beta)\leqq(L'\times0.5)$ can be met. With such a configuration, the photodiode 925 can receive light with a constant detection sensitivity.

Further, in an exemplary embodiment, as shown in FIG. 14, the light source 914 and the photodiode 925 can be disposed on the substrate 928, for example.

Figure 28:
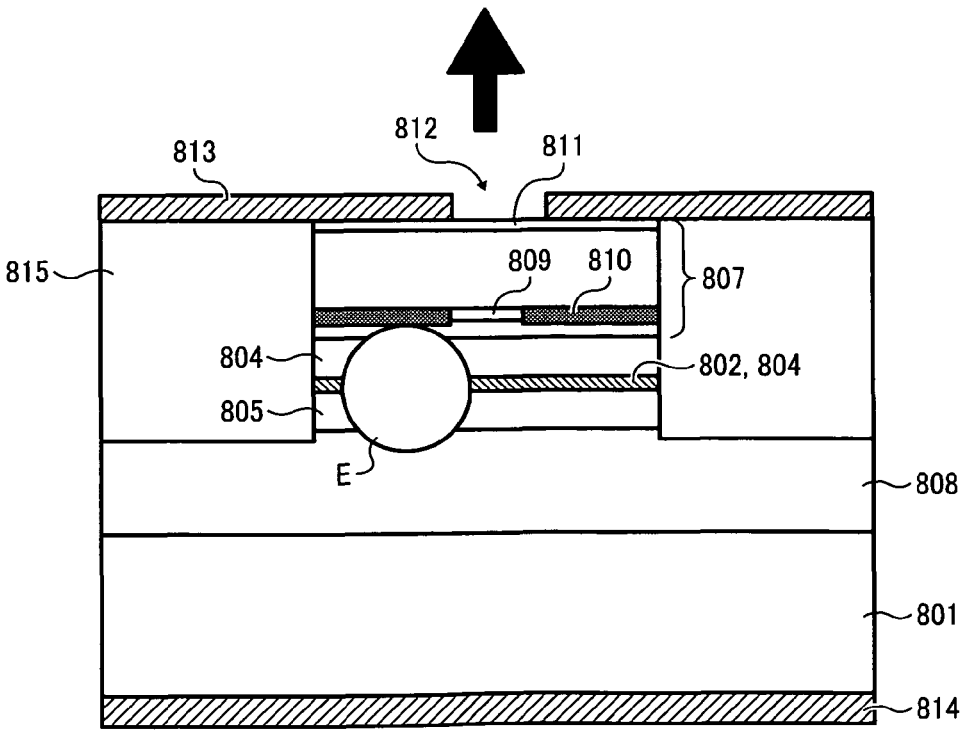
FIG. 28 shows a schematic cross-sectional view of a plane emission laser.
Figure 29:
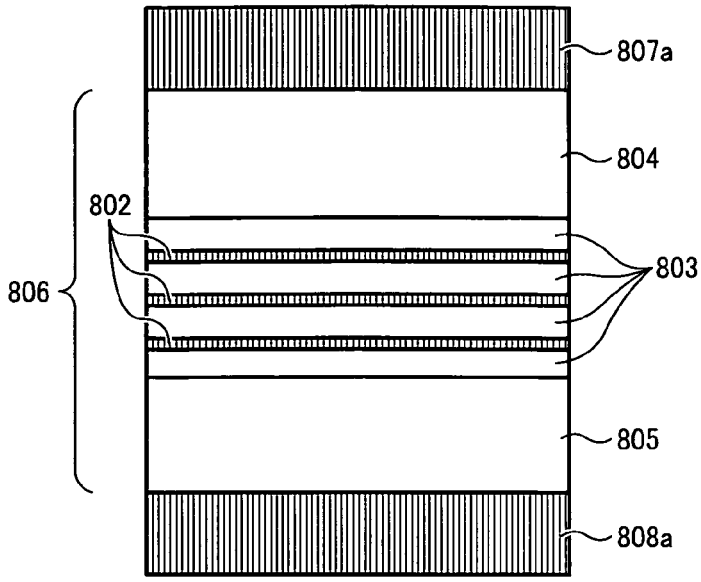
FIG. 29 shows an expanded view of a portion E around active layers.

A description is now given of a plane emission laser array used in an exemplary embodiment with reference to FIGS. 28 and 29. The plane emission laser array can be prepared as below described. Following is an example plane emission laser having a current blocking structure and bandgap wavelength of 780 nm, in which AlAs layer is selectively oxidized. The wavelength can be set in accordance of sensitivity behavior of photoconductor. FIG. 28 shows a schematic cross-sectional view of a plane emission laser, and FIG. 29 shows an expanded view of a portion E around active layers 804 and 805 in FIG. 28.

The plane emission laser may include a n-GaAs substrate 801, a resonator portion 806, a lower reflection mirror 808, and a upper reflection mirror 807, for example. The resonator portion 806 is sandwiched by the lower reflection mirror 808 and the upper reflection mirror 807, and the lower reflection mirror 808 is placed on the n-GaAs substrate 801.

The resonator portion 806 includes active layers of $Al_{0.12}Ga_{0.88}As$ quantum well layer 802/$Al_{0.3}Ga_{0.7}As$ barrier layer 803 stacked alternately, and $Al_{0.6}Ga_{0.4}As$ upper spacer layer 804 and $Al_{0.6}Ga_{0.4}As$ lower spacer layer 805 sandwiching the active layers. The resonator-portion 806 may have a one-wavelength optical thickness. The lower reflection mirror 808 includes 40.5 pairs of n-$Al_{0.3}Ga_{0.7}As$ high refractive index layer/n-$Al_{0.9}Ga_{0.1}As$ low refractive index layer, in which each layer has an optical thickness of λ/4. The upper reflection mirror 807 includes 24 pairs of p-$Al_{0.3}Ga_{0.7}As$ high refractive index layer/p-$Al_{0.9}Ga_{0.1}As$ low refractive index layer.

As shown in FIG. 29, the upper reflection mirror 807 includes a $Al_{0.9}Ga_{0.1}As$ low refractive index layer (thickness: λ/4) 807*a* in the bottom of the upper reflection mirror 807, and the lower reflection mirror 808 includes a $Al_{0.9}Ga_{0.1}As$ low-refractive index layer (thickness: λ/4) 808*a* in the top of the lower reflection mirror 808. Further, the upper reflection mirror 807 includes an AlAs selectively oxidized layer 809 (current injection portion), which is distanced from the resonator portion 806 by λ/4. Further, the upper reflection mirror 807 and the lower reflection mirror 808 may include compositionally graded layers between the refractive index layers to reduce resistance, wherein compositionally graded layer is a layer that compositions changes gradually. Such crystal growth can be conducted by MOCVD (Metal Organic Chemical Vapor Deposition) method or MBE (molecular beam epitaxy) method.

A dry etching method id conducted to form a mesa shape, in which an etching process face is reached to the lower reflection mirror 808, typically. Then, the AlAs selectively oxidized layer 809 having exposed its side face by the etching process is processed by steam to oxidize the side face to form an AlxOy insulating layer (AlxOy current blocking layer 810), by which a current blocking structure can be formed, in which an element drive current can flow only to not-oxidized AlAs portion, which is at the center of the AlAs selectively oxidized layer 809. Then, a $SiO_2$ protective layer is formed on the AlAs selectively oxidized layer 809, and polyimide is added on the etched portion to flatten the layer. A p-GaAs contact layer 811 having a light emitting portion 812 is formed on the upper reflection mirror 807 and an insulating film 815 of polyimide, and a p-individual electrode 813 is formed on the insulating film 815 and the p-GaAs contact layer 811 except the light emitting portion 812, and a n-common electrode 814 is formed on the n-GaAs substrate 801.

In an exemplary embodiment, the mesa portion formed by the dry etching becomes a plane emission laser element. An array arrangement can be formed by making a photomask matched to the array arrangement and a mask for an etching process by a conventional photolithography process, and conducting an etching process. Elements in the array arrangement may be set with an interval of 5 μm or more to separate elements based on electrical condition and space condition. If such interval is too small, an etching process control becomes difficult. Further, the mesa portion may take any shapes, such as circle shape of an exemplary embodiment, elliptical shape, square shape, and rectangular shape, but not limited these. Further, the mesa portion may have a size (e.g., diameter) of 10 μm or more, for example. If the side of mesa portion becomes too small, heat may be accumulated when the element is activated, by which the element may not function properly.

Further, element-to-element interval in a main scanning direction can be set greater, wherein such greater interval may not affect higher density element disposition in a sub-scanning direction, by which heat interference between elements can be reduced, and a wiring space for elements can be secured.

Figure 30:
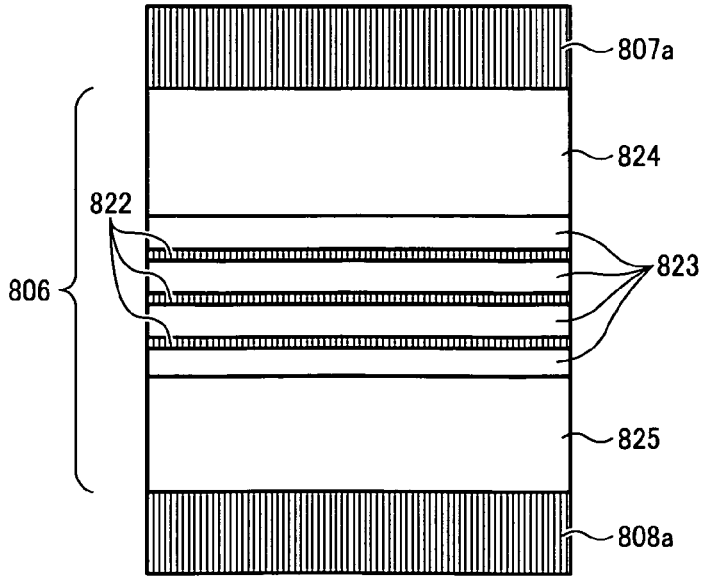
FIG. 30 shows an expanded view of portion E around active layers, in which materials different from materials of FIG. 29 are used.

The plane emission laser having bandgap wavelength of 780 nm can be prepared using another materials. FIG. 30 shows a expanded view of the portion E around the active layers 804 and 805 of FIG. 28, in which materials different from materials of FIG. 29 are used. As shown in FIG. 30, the active layer includes GaInAs quantum well active layer 822 and $Ga_{0.6}In_{0.4}P$ tensile barrier layer 823. The GaInAs quantum well active layer 822 may have three layers having a compressive strain structure and a bandgap wavelength of 780 nm. The $Ga_{0.6}In_{0.4}P$ tensile barrier layer 823 may have four layers matched to a tensile strain structure.

Further, the active layer includes a cladding layer (a spacer layer in an exemplary embodiment) using $(Al_{0.7}Ga_{0.3})_{0.5}In_{0.5}P$ having a wide bandgap to trap electrons. Specifically, the cladding layer includes $(Al_{0.7}Ga_{0.3})_{0.5}In_{0.5}P$ upper spacer layer 824 and $(Al_{0.7}Ga_{0.3})_{0.5}In_{0.5}P$ lower spacer layer 825. Compared to the cladding layer 824 and 825 using AlGaAs to trap carrier, the cladding layer using $(Al_{0.7}Ga_{0.3})_{0.5}In_{0.5}P$ can set a greater bandgap between the cladding layer (824, 825) and the quantum well active layer (822). Other configuration is similar to the configuration in FIG. 29.

Table 1 shows compositions of plane emission type semiconductor laser having bandgap wavelength of 780 nm and 850 nm; in which AlGaAs (spacer layer)/AlGaAs (quantum well active layer) are mainly, used. Table 1 also shows bandgap between spacer layer and well layer, and bandgap between barrier layer and well layer for the plane emission type semiconductor laser using AlGaInP (spacer layer)/GaInPAs (quantum well active layer). The spacer layer is typically a layer set between an active layer and a reflection mirror, and functions as a cladding layer to trap carrier.

TABLE 1

| wavelength | | 780 nm | | 850 nm (Ref.) |
|---|---|---|---|---|
| spacer layer/ quantum well active layer spacer layer | | AlGaAs/ AlGaAs material $Al_{0.6}Ga_{0.4}As$ Eg = 2.0226 (eV) | AlGaInP/ GaInPAs material $(Al_xGa_{1-x})_{0.5}In_{0.5}P$ Eg (x = 0.7) = 2.324 (eV) | AlGaAs/ GaAs material $Al_{0.6}Ga_{0.4}As$ Eg = 2.0226 (eV) |
| active layer | quantum well active layer | $Al_{0.12}Ga_{0.88}As$ Eg = 1.5567 (eV) | GaInPAs (compressive strain) Eg = 1.5567 (eV) | GaAs Eg = 1.42 (eV) |
| | barrier layer | $Al_{0.3}Ga_{0.7}As$ Eg = 1.78552 (eV) | $Ga_xIn_{1-x}P$ (tensile strain) Eg (x = 0.6) = 2.02 (eV) | $Al_{0.3}Ga_{0.7}As$ Eg = 1.78552 (eV) |
| Energy (Eg) difference between spacer layer/well layer | | 465.9 (meV) | 767.3 (meV) | 602.6 (meV) |
| Energy (Eg) difference between barrier layer and well layer | | 228.8 (meV) | 463.3 (meV) | 365.5 (meV) |

As shown in Table 1, the plane emission type semiconductor laser using AlGaInP (spacer layer)/GaInPAs (quantum well active layer) and having bandgap wavelength of 780 nm can set a greater bandgap compared to the plane emission type semiconductor laser using AlGaAs/AlGaAs of 780 nm, and the plane emission type semiconductor laser using AlGaAs/AlGaAs of 850 nm.

Specifically, a bandgap between a cladding layer and an active layer for the semiconductor laser of AlGaInP (spacer layer)/GaInPAs (quantum well active layer) is 767 meV, which is greater than 466 meV of the semiconductor laser of AlGaAs/AlGaAs forming the cladding layer with AlGaAs (Al composition ratio is 0.6). Similarly, a bandgap between a barrier layer and an active layer for the semiconductor laser of AlGaInP (spacer layer)/GaInPAs (quantum well active layer) has a preferable greater bandgap compared to other semiconductor lasers, which means the semiconductor laser of AlGaInP (spacer layer)/GaInPAs (quantum well active layer) can preferably trap carrier.

Further, because the active layer has a compressive strain structure, a band separation of heavy hole and light hole can increase gain greatly. With such configuration, a higher gain can be attained, and a higher output can be attained at a lower threshold value. Such preferable effect may not be attained for plane emission laser using AlGaAs of 780 nm or 850 nm having a lattice constant substantially same as a GaAs substrate. Further, by improving carrier trap property, and obtaining a lower threshold value by a higher gain obtained by strained quantum well active layer, a reflection rate at a light output side DBR can be reduced, and a higher output can be realized.

Further, if the gain can be set greater as in an exemplary embodiment, a decrease of light output due to the temperature increase can be suppressed, by which an element-to-element interval in the array arrangement can be set smaller.

Further, the active layer and the barrier layer may be composed materials without using Al. For example, Al-free active portion (e.g., quantum well active layer and adjacent layer) can reduce an inclusion of oxygen, by which a generation of nonradiative recombination center can be suppressed, by which service lifetime can be extended. Therefore, a writing unit or a light source unit can be re-used.

A description is now given of photoconductor according to an exemplary embodiment. The following is just examples according to an exemplary embodiment of the present invention. Accordingly, other configurations according to an exemplary embodiment of the present invention can be devised.

In an exemplary embodiment, a photoconductor can be prepared as below.

"Synthesis of Titanyl Phthalocyanine Crystal"

At first, titanyl phthalocyanine crystal can be prepared as below using embodiment 1 in JP-2004-83859, for example.

1,3-diiminoisoindoline of 292 part and sulfolane of 1800 part are mixed, and titanium tetrabutoxide of 204 part is dropped to the mixture under nitrogen gas stream. After dropping, the mixture is heated to 180 degrees Celsius, and a reaction temperature is kept from 170 degrees Celsius to 180 degrees Celsius for five hours while agitating the mixture. After the reaction, the mixture is cooled and then filtered to obtain a precipitation. The precipitation is washed by chloroform until the precipitation becomes blue powders, and then washed by methanol for several times, and further washed by hot water of 80 degrees Celsius for several times and dried to obtain pre-purified titanyl phthalocyanine. The pre-purified titanyl phthalocyanine of 60 part is the solved in a 96% sulfuric acid of 1000 part while agitated under 3 degrees Celcius to 5 degrees Celcius, and filtered.

The resultant sulfuric acid solution is then dropped in ice water of 35000 part while agitating to obtain crystal precipitation. The crystal is then filtered, and repeatedly washed by ion-exchange water (pH: 7.0, specific conductance: 1.0 μS/cm) until the washed solution becomes neutral (e.g., after washing, ion-exchange water has pH of 6.8 and specific conductance of 2.5 μS/cm), by which a water-paste of titanyl phthalocyanine pigment is obtained. Then, tetrahydrofuran of 1500 part is added to the water-paste, and agitated by a homomixer (KENIS Ltd., MARK, f model) at a 2000 rpm (revolution per minute) under a room temperature. The agitation is stopped when the paste color changes from navy blue to baby blue (agitation of 20 minutes), and the paste solution is filtered under a reduced pressure to obtain crystal. The crystal is washed by tetrahydrofuran to obtain wet cake of 98 part as pigment. The wet cake is dried for two days under a reduced pressure (5 mmHg) and 70 degrees Celsius to obtain titanyl phthalocyanine crystal of 78 part.

Figure 31:
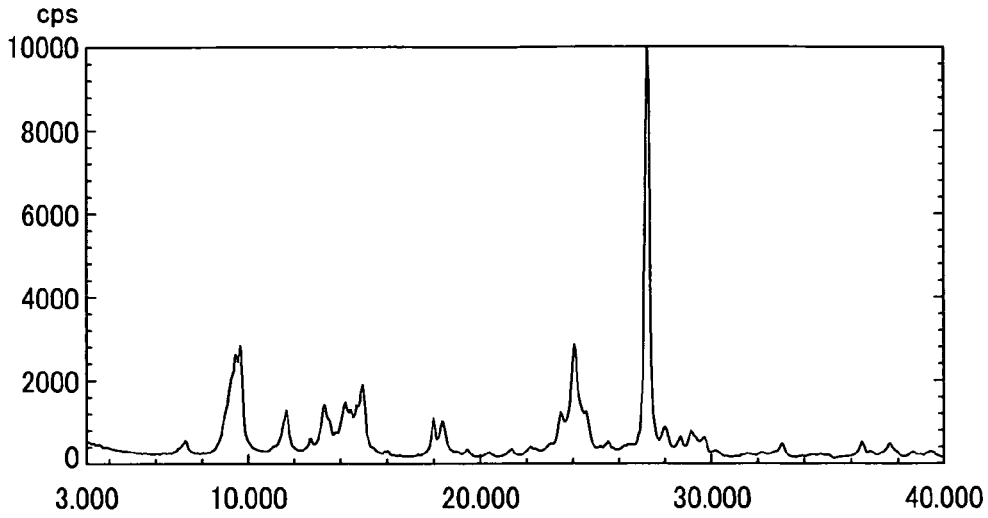
FIG. 31 shows X-ray diffraction spectrum for titanyl phthalocyanine crystal prepared for photoconductor.
Figure 32:
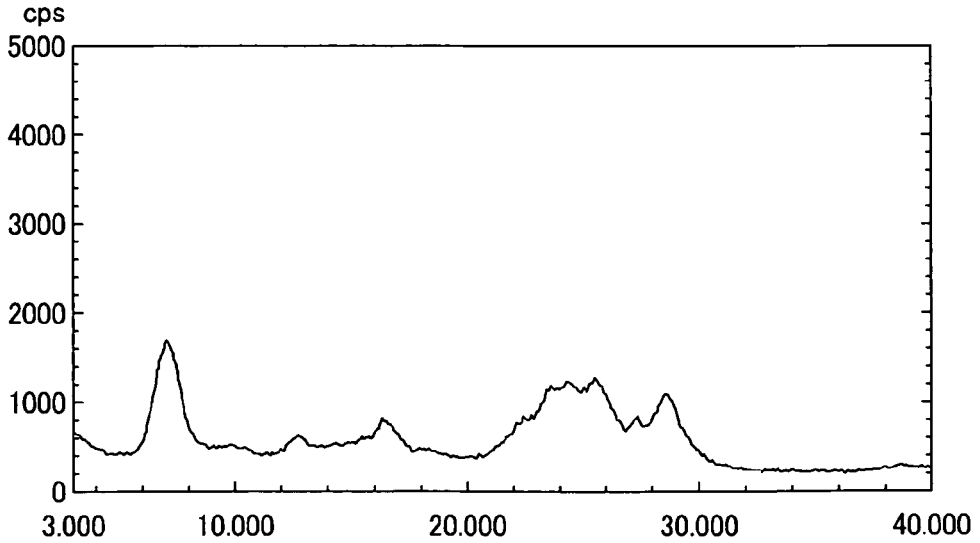
FIG. 32 shows a measurement result of X-ray diffraction spectrum for the titanyl phthalocyanine powder of water-paste.

The titanyl phthalocyanine powder is measured for X-ray diffraction spectrum by using X-ray diffractometer (Rigaku Corporation: RINT1100). The titanyl phthalocyanine powder has a maximum peak at Bragg angle 2θ of 27.2±0.2 degrees with respect to Cu—Kα line (wavelength of 1.542 angstrom) and a peak at minimum angle of 7.3±0.2 degrees. Further, the titanyl phthalocyanine powder has no peak between the peak at 7.3 degrees and the peak at 9.4 degrees, and no peak at 26.3 degrees. FIG. 31 shows a measurement result of the titanyl phthalocyanine powder. Further, a part of the water-paste is dried for two days under 80 degrees Celcius and a reduced pressure (5 mmHg) to obtain titanyl phthalocyanine powder having lower crystal character. FIG. 32 shows a measurement result of X-ray diffraction spectrum for the titanyl phthalocyanine powder of water-paste.

Measurement condition for X-ray diffraction spectrum is follows; X-ray tube: Cu, voltage: 50 kV, current: 30 mA, scan speed: 2 degrees/min, scan area: 3 to 40 degrees, and time constant: 2 seconds.

"Preparation of Dispersion Liquid"

A dispersion liquid of synthesized titanyl phthalocyanine crystal is prepared as below. The dispersion liquid including following is prepared by a bead milling process. The dispersion liquid includes synthesized titanyl phthalocyanine crystal of 20 part; polyvinyl butyral (SEKISUI CHEMICAL CO., LTD.: BX-1) of 12 part; and 2-butanone of 368 part.

The bead milling process is conducted using a commercial bead mill dispersion machine (VMA-GETZMANN GMBH: DISPERMAT SL having rotor diameter of 45 mm and dispersion room capacity of 50 ml) and a zirconia ball having a diameter of 0.5 mm.

First, 2-butanone solution solving polyvinyl butyral is charged into a circulation tank, and circulated to fill resin solution in a circulation system, by which a return of solution to the circulation tank is confirmed. Then, titanyl phthalocyanine crystal is charged into the circulation tank, and agitated in the circulation tank. Then, the solution is circulated for 60 minutes to obtain a dispersion solution using a rotor rotating at 3000 rpm (revolution per minute). After the dispersion, mill base is removed from the bead mill dispersion machine, and then 2-butanone of 600 part is charged to dilute the dispersion solution, and remaining mill base is removed from the dispersion machine simultaneously, by which a dispersion liquid is prepared.

A photoconductor is then prepared as below. The following underlayer coating liquid, charge generation layer coating liquid, and charge transport layer coating liquid are sequentially applied and dried on an aluminum drum having a diameter of 30 mm to obtain a photoconductor having a underlayer of 3.5 μm thickness, a charge generation layer of 0.2 μm thickness, and a charge transport layer of 28 μm thickness.

The underlayer coating liquid includes titanium oxide (CR-EL: ISHIHARA SANGYO KAISHA, LTD.) of 70 part; alkyd resin (BECKOLITE M6401-50-S (solid component 50%), DIC Corporation) of 15 part; melamine resin (SUPER BECKAMINE L-121-60 (solid component 60%), DIC Corporation) of 10 part; and 2-butanone of 100 part.

The charge generation layer coating liquid includes dispersion liquid of the above titanyl phthalocyanine crystal.

The charge transport layer coating liquid includes polycarbonate (European Z 300: MITSUBISHI GAS CHEMICAL COMPANY, INC.) of 10 part; charge transport material having following structure (see chemical formula 1) of 7 part, and tetrahydrofuran of 80 part.

(Chemical formula 1)

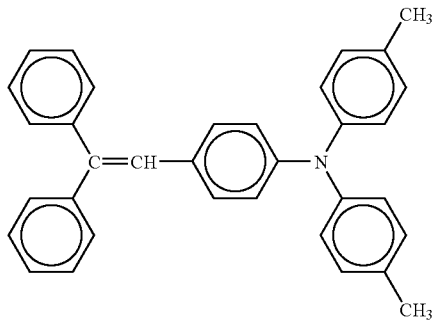

A description is now given of the scanner 300 with reference to FIG. 4. The scanner 300 includes the contact glass 31, and the first and second carriages 33 and 34. The first and second carriages 33 and 34 include a light source and mirrors to scan document placed on the contact glass 311. The first and second carriages 33 and 34 move reciprocatingly in a given direction to scan image information of the document. The scanned image information is focused on the scan sensor 36 via the focus lens 35, and read as an image signal by the scan sensor 36.

Figure 33:
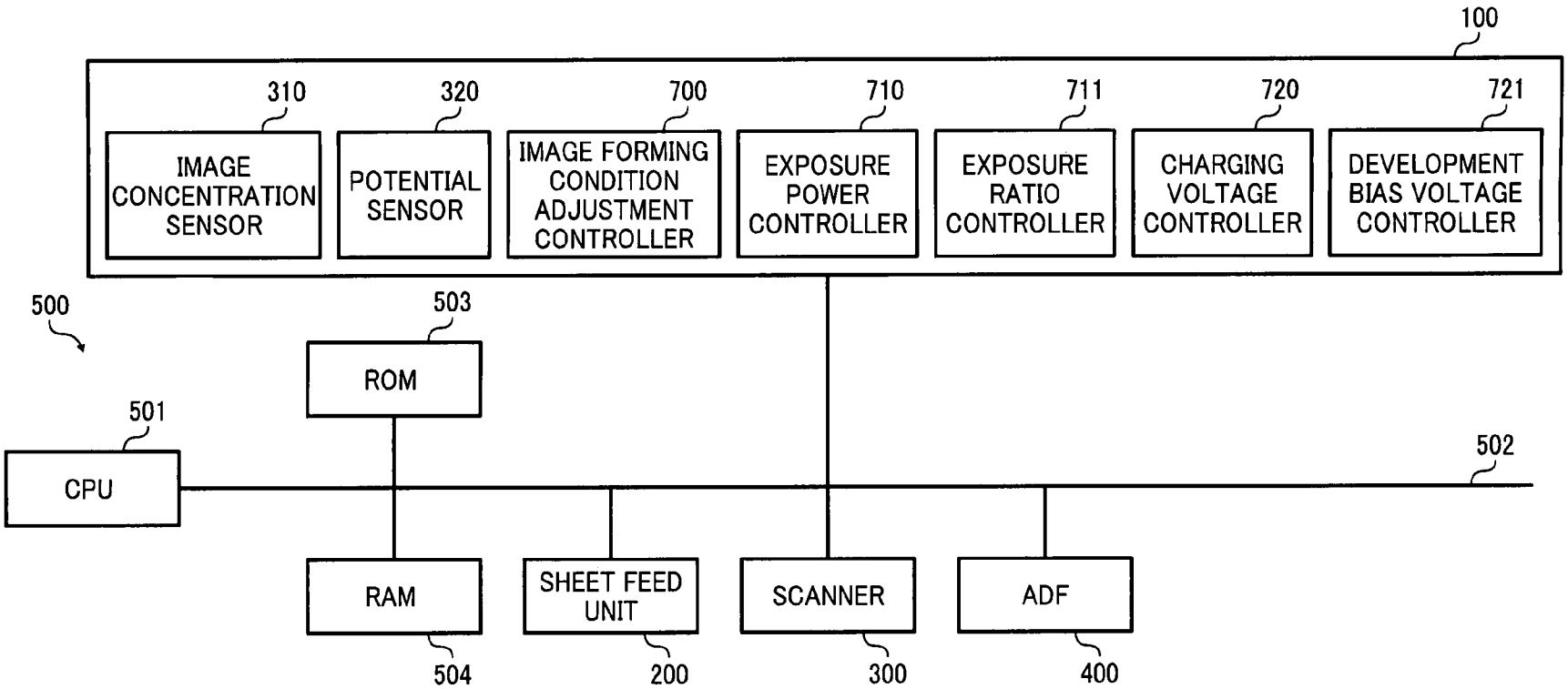
FIG. 33 shows a block diagram of units connected each other in the image forming apparatus of FIG. 4.

FIG. 33 shows a block diagram of units connected each other in the image forming apparatus 600. As shown in FIG. 33, the image forming apparatus 600 includes a main controller 500 (a computer), which controls the image forming apparatus 600 as a whole. The main controller 500 includes a CPU (central processing unit) 501, a ROM (read only memory) 503, a RAM (random access memory) 504, and a bus line 502, in which the bus line 502 connects the units. The CPU 501 controls operations and driving of units and devices. The ROM 503 stores data, such as for example computer program. The RAM 504 is used a working area of data, storing data temporally.

The ROM 503 stores a conversion table, which includes information for converting an output value of the image concentration sensor 310 to toner-adhesion amount per unit area.

The main controller 500 may be connected to the sheet feed unit 200, the scanner 300, the ADF 400, or the like of the image forming unit 100. The image concentration sensor 310 and the potentiometer 320 transmit detected information to the main controller 500.

A description is now given of an operation of the image forming apparatus 600. When copying document using the image forming apparatus 600, a document is set on a document tray 30 of the ADF 400, or the ADF 400 is opened at first and then set a document on the contact glass 31 of the scanner 300 and close the ADF 400. Then, a user presses a start switch to transport the document to the contact glass 31 when the document is set in the ADF 400. The document is scanned by moving the first carriage 33 and the second carriage 34 in the scanner 300. A light emitted from the first carriage 33 is reflected on the document set on the contact glass 31, and the reflection light is reflected by a mirror in the second carriage 34. Then the reflection light is guided to the scan sensor 36 via the focus lens 35. As such, image information of document is scanned.

Further, when the user press the start switch, one of the support rollers 14, 15, and 16 is driven by a drive motor to rotate the intermediate transfer belt 10. Simultaneously, the photoconductors 20Y, 20C, 20M, and 20K in the image forming engines 18Y, 18C; 18M, and 18K also rotate. Based on image information scanned by the scan sensor 36 of the scanner 300, the optical writing unit 900 emits a light beam to each of the photoconductors 20Y, 20C, 20M, and 20K to form a latent image on each of the photoconductors 20Y, 20C, 20M, and 20K. Then, the latent image is developed by the development units 61Y, 61C, 61M, and 61K as yellow, cyan, magenta, and black toner image on each of the photoconductors 20Y, 20C, 20M, and 20K.

Such toner images are primary transferred onto the intermediate transfer belt 10 by the first-stage transfer units 62Y, 62C, 62M, and 62K, in which toner images are superimposed one to another sequentially. Accordingly, a full color toner image is formed on the intermediate transfer belt 10. After a secondary transfer process, the belt cleaning unit 17 removes toner remaining on the intermediate transfer belt 10.

Furthers when the user presses the start switch, the transfer sheet 5 is fed from one of sheet trays 44 by rotating the sheet feed roller 42 in the sheet feed unit 200, in which the user can select types of sheets. The transfer sheet 5, separated one by one by the separation roller 45, is fed to the sheet feed route 46, and then transported along the transport route 48 using the transport roller 47. Then, the transfer sheet 5 is stopped by the registration roller 49*b*.

The registration roller 49*b* starts to rotate at a time when the full-color image is formed on the intermediate transfer belt 10 as above described and transported to a secondary transfer nip set between the intermediate transfer belt 10 and the secondary transfer roller 24*a*. The registration roller 49*b* feeds the transfer sheet 5 to the secondary transfer nip to transfer the full-color image from the intermediate transfer belt 10 to the transfer sheet 5 with an effect of the secondary transfer roller 24*a*. Then the transfer sheet 5 is transported to the fixing unit 25, in which the toner images are fixed on the transfer sheet 5 by applying heat and pressure. Then, the transfer sheet 5 is ejected to the sheet ejection tray 7 by the ejection roller 56. When another image is formed on other face the transfer sheet 5, the transfer sheet 5 is transported to the sheet reverse unit 93 by switching a sheet path using the switchover claw 55. The transfer sheet 5 is reversed in the sheet reverse unit 93, and fed to the secondary transfer nip again.

In the image forming apparatus 600, an image forming condition adjustment control is conducted at a given timing to set a preferable charging voltage/exposure power. Specifically, when power is turned ON, after a given time elapses, or after a given number of sheets are printed, a latent image potential characteristic relative to exposure power to the photoconductor may change. Such change of latent image potential is detected, and a detection result is feedbacked to set a preferable charging voltage/exposure power. Hereinafter, the latent image potential characteristic may be referred to "light attenuation characteristic."

The light attenuation characteristic of the photoconductor may vary depending on use environment, the degree of electrostatic fatigue of photoconductor, and photoconductive layer thickness, or the like. For example, even when a same charging voltage and a same exposure power are used, the light attenuation characteristic varies due to the use environment condition, such as normal-temperature/normal-humidity environment, high-temperature/high-humidity environment, and low-temperature/low-humidity environment, by which latent image potential varies, and photo-induced discharge profile has different shape.

Further, the light attenuation characteristic varies due to electrostatic fatigue of photoconductor. Specifically, when a photoconductor is used for a long period of time for charging, exposing, and developing images for a greater number of sheets (e.g., hundreds of thousands sheets), the photoconductor may degrade by repeated charging and exposure process. Accordingly, when a greater number of sheets are printed, the photoconductor may have degraded. Then, even when a same charging voltage and a same exposure power are used for the degraded photoconductor, a surface potential of the photoconductor may hard to decrease, by which latent image potential varies from a preferable reference value, and photo-induced discharge profile may have different shape depending on the degree of electrostatic fatigue of photoconductor Further, the light attenuation characteristic varies due to scraping of photoconductor. Specifically, when a photoconductor is used for a long period of time for image forming, a cleaning blade for scraping residual toner, remaining on the photoconductor after an image transfer process, may also scrape a surface portion of photoconductor gradually, by which a surface layer of the photoconductive layer may degrade over time, and a thickness of the surface layer may decrease over time. Then, even when a same charging voltage and a same exposure power are used for such surface-degraded photoconductor, a surface potential of the photoconductor varies due to a change of layer thickness, by which latent image potential varies from a preferable reference value, and photo-induced discharge profile may have different shape.

As such, light attenuation characteristic of the photoconductor may vary due to the use environment, the degree of electrostatic fatigue of photoconductor, and the layer thickness change. The photo-induced discharge profile may change in a relatively simple manner if it is assumed that only one of the use environment, the degree of electrostatic fatigue of photoconductor, and layer thickness change affect the light attenuation characteristic. However, in actual apparatuses, the use environment, the degree of electrostatic fatigue of photoconductor, and the layer thickness change by the cleaning blade may occur simultaneously, and thereby the use environment, the degree of electrostatic fatigue of photoconductor, and the layer thickness change may affect to the light attenuation characteristic in a complexed manner. Therefore, it becomes too difficult to predict a latent image potential characteristic of the photoconductor relative to exposure power based on sampled data of actual apparatuses such as for example used hours, and number of printed sheets. Accordingly, it becomes beneficial to detect a characteristic change of latent image potential of the photoconductor relative to exposure power using an image forming condition adjustment control, and to feedback a detect result to image forming condition.

Figure 34:
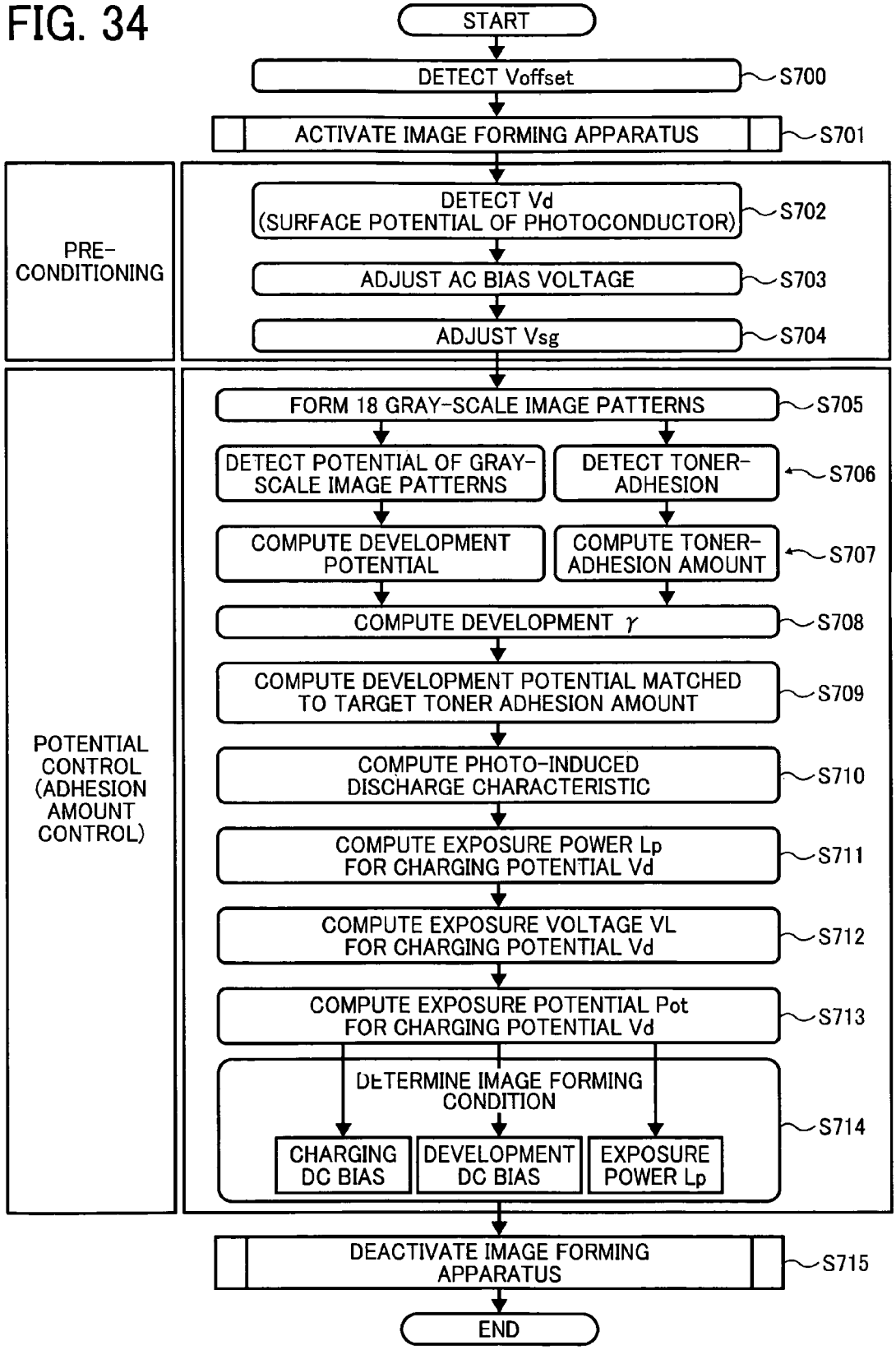
FIG. 34 shows a flowchart for self-check operation of the image forming apparatus of FIG. 4.
Figure 35:
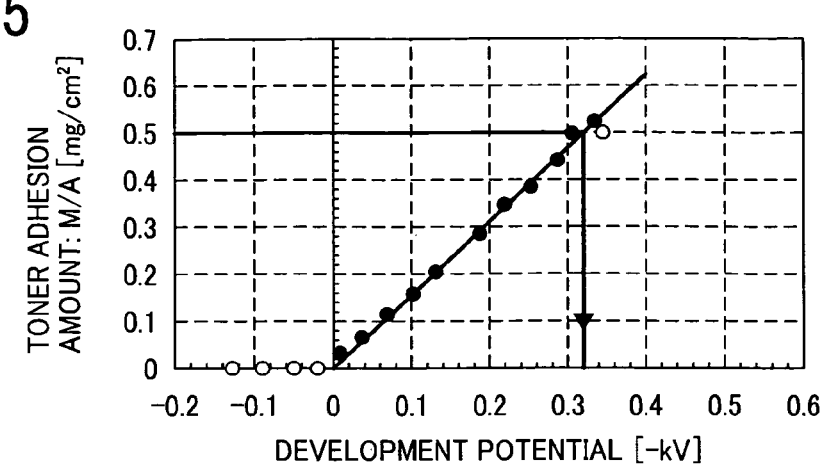
FIG. 35 shows a graph indicating a relation of development potential and toner-adhesion amount during the self-check operation.

A description is now given of an image forming condition adjustment control according to an exemplary embodiment, which may be controlled by the CPU 501 using a computer program with reference to FIGS. 34 and 35. The adjustment control of image forming condition may be referred to as "self-check operation."

In the image forming condition adjustment control, a potential control process and halftone image correction process may be conducted, for example. FIG. 6 shows gray-scale image patterns to be transferred onto the intermediate transfer belt 10. FIG. 34 shows a flowchart for the self-check operation, and FIG. 35 shows a graph indicating a relation of development potential and toner-adhesion amount when the potential control process conducted, wherein the relation can be approximated in substantially linear.

FIG. 34 shows a flowchart for the self-check operation, which may be conducted at a given timing, such as for example when an image forming apparatus is activated; after a predetermined number of sheets are printed during a continuous printing operation; after a predetermined time is elapses, but not limited these. A description is now given of self-check operation when an image forming apparatus is activated.

First, to distinguish a condition when the power is ON and a condition when a sheet jamming occurs, a fixing temperature of the fixing unit 25 is detected to determine whether the self-check operation is to be conducted. Specifically, based on input signal transmitting from a fixing temperature sensor, it is determined whether the fixing temperature of the fixing unit 25 exceeds 100 degrees Celsius or more, for example. If the fixing temperature of the fixing unit 25 does not exceed 100 degrees Celsius, the self-check operation is not conducted. If the fixing temperature of the fixing unit 25 exceeds 100 degrees Celsius, the self-check operation is conducted. As such, a temperature of fixing roller when the power is turned to ON for an image forming apparatus is checked by a control unit to determine whether the self-check operation is to be conducted. In such self-check operation, a control unit including the CPU 501 or the like can be used a determination unit to determine a condition for the self-check operation.

In the following explanation, following abbreviations may be used based on JIS Z 8105 "Glossary of colour terms," wherein the JIS is Japan Industrial Standard, for example. Vsg: output voltage of surface skin portion of transfer belt; Vsp: output voltage of each test pattern of toner image; Voffset: offset voltage (output voltage when LED_OFF); _reg.: light output for regular reflection (abbreviation of Regular Reflection); _dif.: light output for diffuse reflection (abbreviation of Diffuse Reflection); [n]: the number of array variables having a given number of data, which indicates order of each data in a data set (e.g., 18 test patters having given gradient).

In the self-check operation, before activating an image forming apparatus, two optical sensors detect output voltage value of LED when the LED is OFF condition as offset voltage Voffset (Voffset_reg, Voffset_dif) in step S700. After detecting the offset voltage Voffset, the image forming apparatus is activated in S701.

Figure 36:
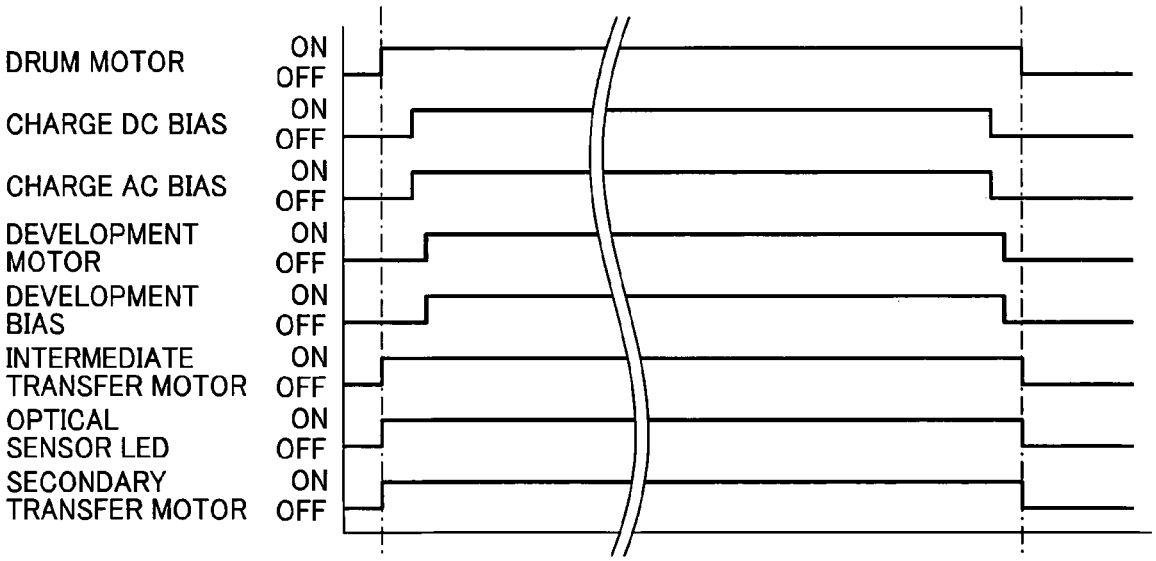
FIG. 36 shows an ON/OFF timing chart of devices in the image forming apparatus of FIG. 4.

When image forming apparatus is activated, motors and other devices used for an image forming process are activated at a given timing as shown in FIG. 36. For example, a photoconductor motor, an intermediate transfer belt motor, and a secondary transfer motor are activated; charging bias, developing, and transfer bias are activated as shown in a timing chart of FIG. 36. Further, as shown in FIG. 36, an LED of P sensor (image concentration sensor 310) is set to ON synchronously when the intermediate transfer belt motor is activated.

The P sensor (image concentration sensor 310) is set to ON synchronously when the intermediate transfer belt motor is activated because of following reasons.

Figure 37:
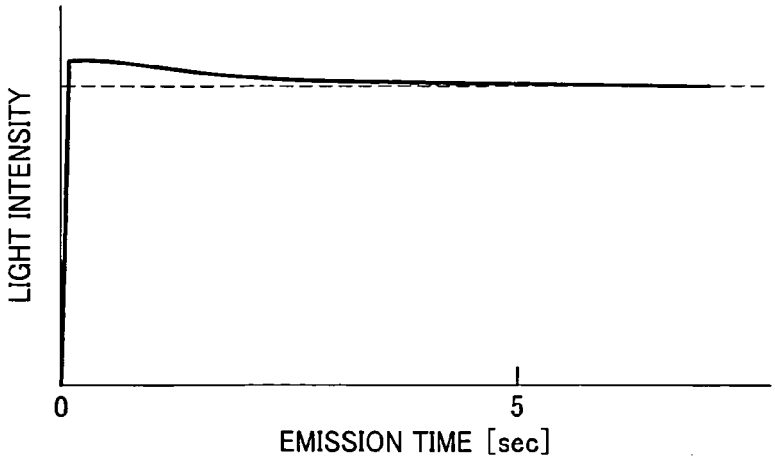
FIG. 37 shows light intensity of a light emitting device when a light emission is started.

When the image forming condition adjust control is started, the LED, used as light emitting device, is set to ON to measure a light intensity of reflection light reflected on a reference toner image. As shown in FIG. 37, a light intensity of the light emitting device may change over time from a start of light emission, for example. In FIG. 37, the light intensity becomes a maximum intensity after several tens of microseconds elapsed after activating light emission. Then, an internal resistance of the light emitting device increases due to an internal temperature rise, by which the light intensity decreases gradually over time. When the internal temperature rise is saturated, the light intensity may be stabilized. Although such stabilization may occur in several seconds, an optical reflectance of the reference toner image cannot be detected correctly during such several seconds period. Therefore, it may be required to wait stabilization of light intensity of the light emitting device to detect the optical reflectance of the reference toner image using the P sensor.

In an exemplary embodiment, the LED of the P sensor (image concentration sensor 310) is synchronously set to ON when the intermediate transfer belt motor is activated. Accordingly, the light intensity of LED of the P sensor can be stabilized until test patterns of toner images on the intermediate transfer belt 10 reaches a detection position of the P sensor. Such test patterns are formed on the photoconductor 20 and then transferred onto the intermediate transfer belt 10.

In a conventional method, test patterns may be formed on a photoconductor and detected, by which detection results are feedbacked to conduct an image forming condition adjustment precisely. However, if the test patterns are detected on the photoconductor, light-induced fatigue may occur on the photoconductor by LED light irradiation, by which a part of photoconductor irradiated by LED light may have some problem because the light-induced fatigued part of photoconductor may form stripe image having too much density or too little density. Accordingly, it is required to suppress the light-induced fatigue of the photoconductor by reducing a light-ON time of LED as little as possible. In such configuration, the LED cannot be set to ON as early as possible. Accordingly, a stabilization of the light intensity of LED by setting the LED to ON as early as possible cannot be employed.

In light of light-induced fatigue of photoconductor, in the image forming apparatus according to an exemplary embodiment, each of test patterns is detected on the intermediate transfer belt 10, but not on the photoconductor 20. In such a configuration, light-induced fatigue of the photoconductor caused by LED light irradiation can be prevented, and the LED can be set to ON at an earlier timing, by which the self-check operation can be conducted at an earlier timing and reduced time duration.

Figure 38:
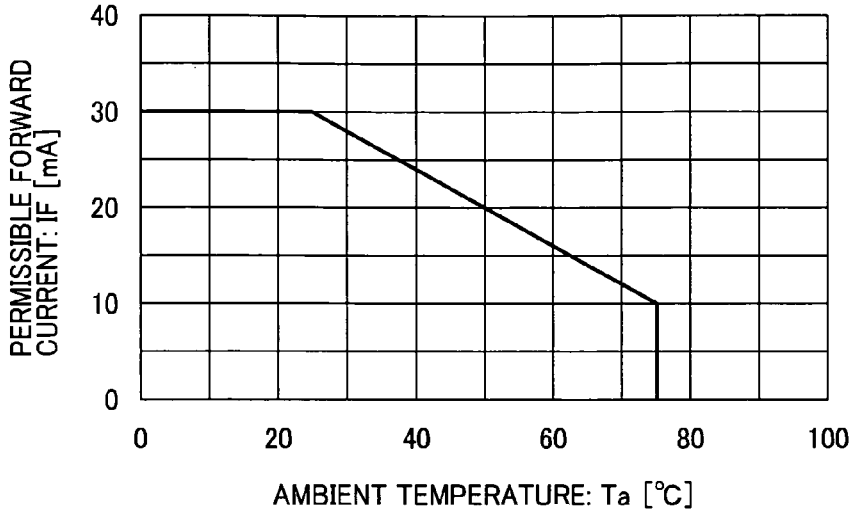
FIG. 38 shows a relation of ambient temperature Ta and permissible forward current IF of LED.

FIG. 38 is a graph showing a relation of an ambient temperature Ta for LED and permissible forward current IF of LED. As shown in FIG. 38, current value to be flown to the LED may be determined according to the ambient temperature Ta because the permissible current value for LED becomes smaller as the ambient temperature Ta rises.

If an optical reflectance of a surface portion (surface skin portion) of an intermediate transfer belt detectable by the P sensor is relatively high, a LED current value for the P sensor can be set smaller as below described. Specifically, when conducting an adjustment of "Vsg," a light receiving element needs to detect a reflection light having a given level of light intensity so that a detection result can be used effectively. Such given level of light intensity of the reflection light can be obtained by setting a given current value for the LED. If an optical reflectance of an intermediate transfer belt may be relatively higher, the given level of light intensity of the reflection light can be set smaller. Accordingly, a LED current value required for obtaining such reflection light becomes smaller. For example, a required output voltage of the P sensor (e.g., 4.0±0.2 V) can be obtained by a smaller LED current value. For example, when an intermediate transfer belt is transparent, a roller opposing the P sensor may be a metal roller having a higher mirror reflectivity (about 500 brilliance at 20 degrees Celcius, for example), and a LED light is reflected on the roller. In such a case, 4 mA to 7 mA of LED current value may be required to obtain Vsg=4.0 V, for example.

In an exemplary embodiment, the intermediate transfer belt 10 is made of a carbon-dispersed belt (120 brilliance at 20 degrees Celcius, for example), which has little variation on resistance even when temperature/humidity environment changes. The intermediate transfer belt 10 may appear as black color due to the dispersed carbon, by which a mirror reflectivity may become smaller (e.g., about one-fourth or so). If the Vsg of 4.0V is to be obtained by using the intermediate transfer belt 10, a LED current may become 20 mA to 35 mA, which is about five times when a transparent belt is used, which may be too great for LED current. Such greater LED current may be similarly required if the intermediate transfer belt 10 has a lower brilliance or greater surface roughness.

As above described, the LED current needs to be set within permissible forward current value, which can be determined based on ambient temperature. Accordingly, it is difficult to flow a greater current value (e.g., 20 mA to 35 mA) to the LED. A method of keeping the LED current within the permissible forward current value and obtaining a desired "Vsg" value can be devised by increasing a sensitivity of light receiving element of the P sensor, which means a gain of operational amplifier is increased. With such a method, "Vsg" value of 4.0 V can be obtained while keeping the LED current within the permissible forward current value. However, such method just amplifies a very weak light received by a light receiving element using an electric circuit, by which a signal to noise ratio (S/N ratio) may not become so high.

In view of such situation, in an exemplary embodiment, the LED current value is increased for the intermediate transfer belt 10 having black color compared to a belt having higher reflection rate, and a gain of operational amplifier is also increased. By increasing both of the LED current value and the gain of operational amplifier, the LED current value can be kept within the permissible forward current value, and a decrease of the S/N ratio can be suppressed.

Specifically, the LED current is set to 15 mA by assuming the ambient temperature becomes 50 degrees Celsius as a maximum temperature and light intensity decreases over time to two-thirds (⅔). Further, the gain of operational amplifier is set to "2.5 times" by assuming a variation of the LED current is from 20 mA to 35 mA (maximum variation of 15 mA). With such a configuration, a S/N ratio required for the P sensor can be obtained for the intermediate transfer belt 10 having black color, wherein such intermediate transfer belt 10 has a good transfer performance in various environmental conditions.

Figure 39:
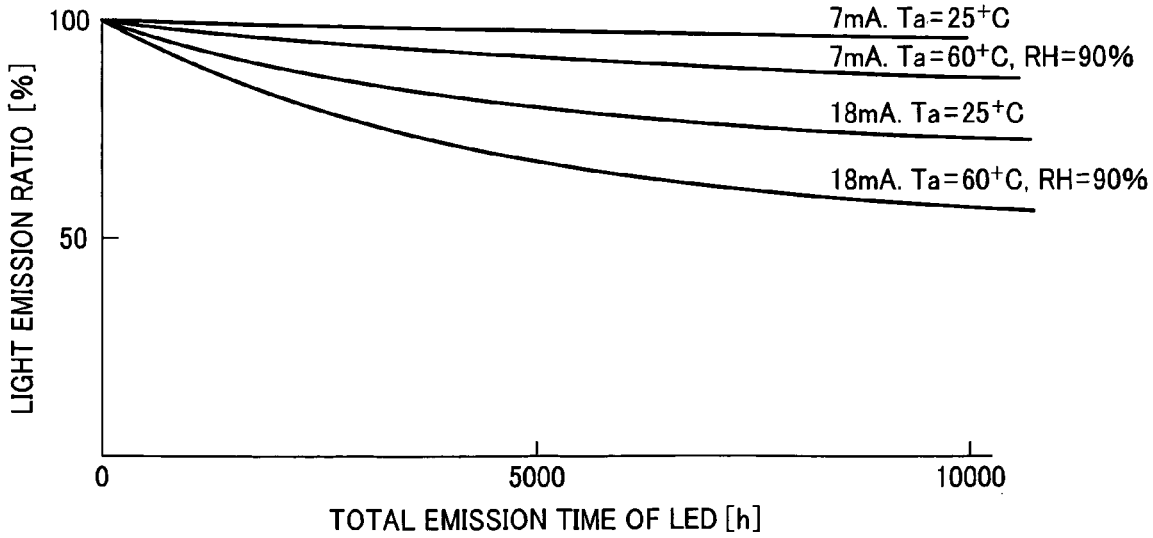
FIG. 39 shows profiles of light intensity of LED used under different conditions over time.

As shown in FIG. 39, the light intensity of LED may degrade gradually over time due to a lattice imperfection caused by light emission of LED over time. FIG. 39 shows profiles of light intensity of LED used under different conditions, in which a light emission ratio (or light intensity) of LED at the initial condition is set to 100%. The degree of decrease of light intensity may vary depending on materials used for LED. However, the degree of decrease of light intensity may typically vary depending on current to be flown in LED. Specifically, the greater the current value flown in LED, the greater the decrease of light intensity of LED over time, and further the greater the ambient temperature, the greater the degradation of LED over time as shown in FIG. 39.

In the self-check operation according to an exemplary embodiment, to decrease a waiting time, an LED is set to ON when an image forming apparatus is activated, and the LED is kept to ON until the image forming apparatus is deactivated. In such a configuration, an ON-kept time of the LED becomes longer than a conventional configuration that set an LED to ON only when an optical detection is required (e.g., LED is ON and OFF at a given time). If the ON-kept time of the LED becomes longer, the light intensity LED decreases over time as shown in FIG. 39, which may not occur for a conventional LED configuration. For example, as for the second sensor 310*b* (used as regular-reflection type sensor), the decreased light intensity may not affect the detection precision, but as for the first sensor 310*a* (used as regular/diffuse-reflection type sensor), the decreased light intensity may affect the detection precision.

In an image forming apparatus according to an exemplary embodiment, a detection result detected by the first sensor 310*a* is corrected to prevent a decrease of detection precision of the first sensor 310*a* caused by a decrease of light intensity of LED over time. As such, a variation of output signal of diffuse/reflection light caused by a decrease of light intensity of LED over time can be corrected, wherein such light intensity decrease may occur due to a change of LED current over time.

The description is back to the flowchart of FIG. 34. After step S701, the process goes to step S702.

In step S702, a surface potential of each of the photoconductors 20, uniformly charged under a given condition, is detected using the potentiometer 320 (referred to as Vd detection).

In step S703, based on the detection result of the potentiometer 320, an AC (alternative current) bias voltage of the charge unit 60 is adjusted.

Then, in step S704, the Vsg on the intermediate transfer belt 10 is adjusted. In the Vsg adjustment, the light intensity of LED is adjusted so as to set a regular reflection light "Vsg_reg" reflected from a surface skin portion of the intermediate transfer belt 10 within a given range (e.g., 4.0±0.2 V). Further, after adjusting the light intensity, an output value of "Vsg_reg and Vsg_dif" for a surface skin portion of the intermediate transfer belt 10 is stored in the RAM 504.

In steps S701 to S702, processings are conducted for each of the image forming engines 18 in parallel, and in, step S703, processings are conducted for the two P sensors 310*a* and 310*b* in parallel.

Further, a start timing for Vsg adjustment may be conducted after a given time elapses from turning the LED of the P sensor to ON until the sensor output of P sensor stabilizes (e.g., about five seconds). Therefore, the Vsg adjustment may be conducted about five seconds after steps S702 and S703.

Then, in step S705, latent images of eighteen (18) gray-scale image patterns are formed using each of the photoconductors 20 as test patterns, wherein such test patterns are latent image at this stage.

In step S706, the potentiometer 320 reads or detects potential of gray-scale image patterns on the photoconductor 20, and the output value of the potentiometer 320 is stored in the RAM 504.

In step S707, a development potential is computed based on the output value of the potentiometer 320 (i.e. potential of latent image of gray-scale image patterns), and a development bias voltage used for developing the test patterns. Image forming conditions for the latent images of 18 gray-scale image patterns is described in detail later.

The latent images formed on the photoconductors 20 are developed as toner images respectively by the development unit 61K, the development unit 61C, the development unit 61M, and the development unit 61Y. Then, as shown in FIG. 6, the toner images are primary transferred onto the intermediate transfer belt 10. As shown in FIG. 6, the 18 gray-scale image patterns for different colors are formed on given positions corresponding to the two P sensors 310*a* and 310*b*. For example, the C/M/Y toner images are formed at a front position in the belt width direction W (e.g., front position from a center for 40 mm), and the K toner image are is formed at a rear position in the belt width direction W (e.g., rear position from a center for 40 mm).

Then, in step S706, the CPU 501 instructs the P sensor (e.g., image concentration sensor 310) to detect toner-adhesion amount for gray-scale image patterns formed on the intermediate transfer belt 10. In such toner-adhesion amount detection, a regular reflection light output "Vsp_reg" and diffuse-reflection light output "Vsp_dif" for each of the test patterns of each color are stored in the RAM 504. Specifically, the "Vsp_reg" and "Vsp_dif" for "18 patterns×4 colors" are stored in the RAM 504.

Then, the toner-adhesion amount is computed in step S707. Algorithms of computing adhesion amount for black toner and non-black toner may be different each other because a black toner detection sensor and a non-black toner detection sensor may have different sensor configuration.

An adhesion amount conversion process for black toner image (black image test pattern) may be conducted as below. The black toner-adhesion amount can be computed as below: first, an output Vsg of the surface skin portion of the belt and an output Vsp of test pattern are detected to compute an output ratio of "Vsp/Vsg"; then the adhesion amount is computed using an adhesion amount conversion table stored in the ROM 503.

An adhesion amount conversion process for non-black toner image (non-black image test pattern) may be conducted as below. In an exemplary embodiment, a transfer belt of black color that needs a higher LED current is used and a diffuse-reflection type sensor is used to detect toner adhesion amount on the transfer belt having black color. When a toner-adhesion amount conversion process is conducted under such configuration, a correction process may be used for diffuse reflection light because an output of diffuse reflection light may vary due to some reasons. Such reasons may include an output decrease of sensor due to light intensity decrease of LED current over time (change of LED current), and Vsg adjustment, in which an output of regular reflection light for the surface skin portion of belt is adjusted to 4.0 V±0.2 V. The non-black toner-adhesion amount can be computed using the following steps 1 to 7.

In step 1, data sampling is conducted to compute ΔVsp and ΔVsg. First, a difference between output of regular reflection light and the offset voltage Voffset, and a difference between output of diffuse light and the offset voltage Voffset are computed for all test patters having the number of [n]. Such process is conducted to express an output increment of the sensor based on only increment caused by a change of non-black toner-adhesion amount.

The output increment of regular reflection light can be computed by a following equation.

$$\Delta Vsp_\text{reg.}[n]=(Vsp_\text{reg.}[n])-(V\text{offset_reg.})$$

Further, the output increment of diffuse reflection light can be computed by a following equation.

$$\Delta Vsp_\text{dif.}[n]=(Vsp_\text{dif.}[n])-(V\text{offset_dif.})$$

Figure 40:
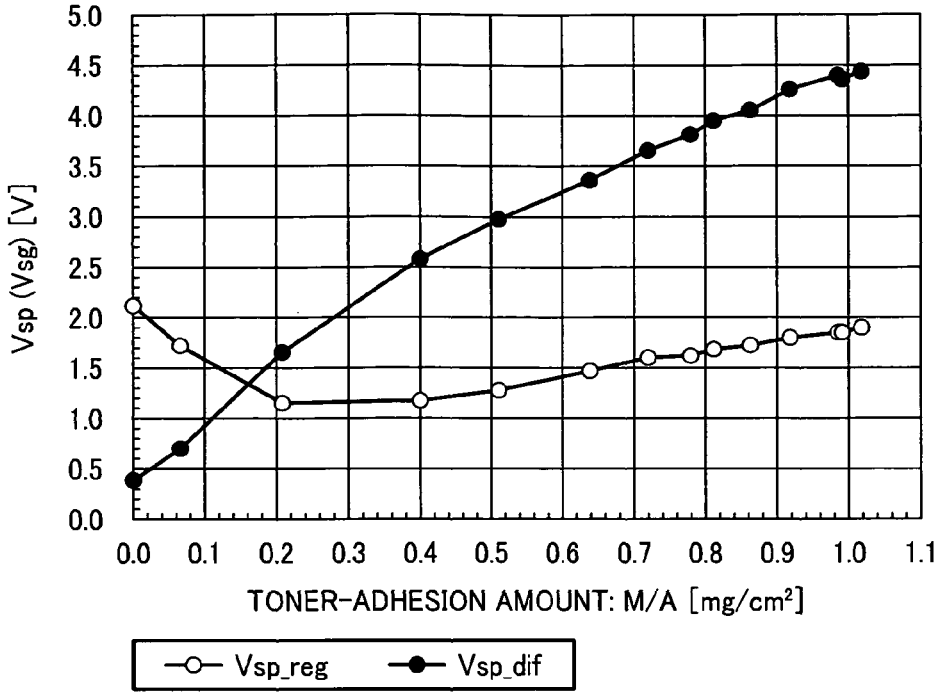
FIG. 40 shows a relation of toner-adhesion amount of test pattern and Vsp/Vsg.

However, if an output voltage of Voffset (i.e., Voffset_reg, Voffset_dif) can be set too small, which can be disregarded practically, by using a specific operational amplifier, the above described process for obtaining difference can be omitted. FIG. 40 shows an example profile of Vsp_reg and Vsp_dif obtained by step 1.

In step 2, a sensitivity correction factor α is computed. First, based on ΔVsp_reg.[n] and ΔVsp_dif.[n] obtained at step 1, "(ΔVsp_reg.[n])/(ΔVsp_dif.[n]) is computed for each of test patterns. Then, the sensitivity correction factor α is computed as below. The sensitivity correction factor α is to be multiplied to an output of diffuse light (ΔVsp_dif.[n]) when to conduct component separation of output of regular reflection light in the following step 3.

$$\alpha=\min[(\Delta Vsp_\text{reg.}[n])/(Vsp_\text{dif.}[n])]$$

Figure 41:
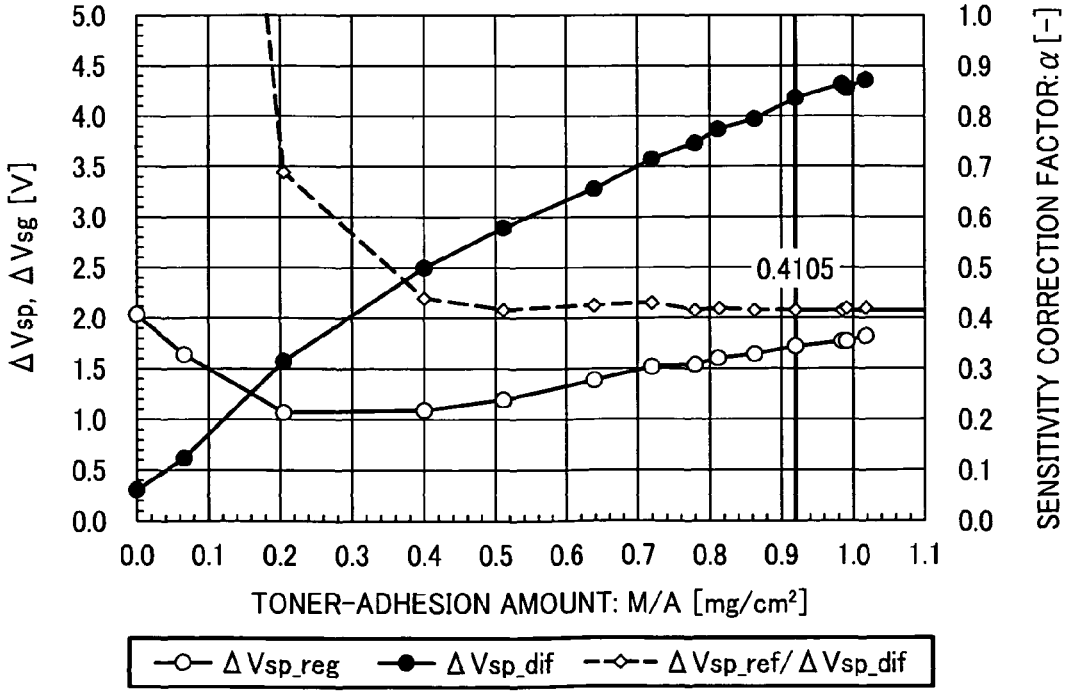
FIG. 41 shows a relation of toner-adhesion amount of test pattern, ΔVsp/ΔVsg, and sensitivity correction factor α.

FIG. 41 shows example profiles of ΔVsp_reg, ΔVsp_dif, and ΔVsp_reg/ΔVsp_dif, obtained by step 2.

The sensitivity correction factor α can be set to minimum value of (ΔVsp_reg.[n]/Vsp_dif.[n]) because a minimum value of regular reflection component of output of regular reflection light is a positive value, which is substantially close to zero.

In step 3, a regular reflection light is separated in components. A diffuse light component of output of regular reflection light can be computed as below.

$$\Delta Vsp_\text{reg._dif.}[n]=(\Delta Vsp_\text{dif.}[n])\times\alpha$$

Further, a regular reflection component of output of regular reflection light can be computed as below.

$$\Delta Vsp_\text{reg._reg.}[n]=(\Delta Vsp_\text{reg.}[n])-(\Delta Vsp_\text{reg._dif.}[n])$$

Figure 42:
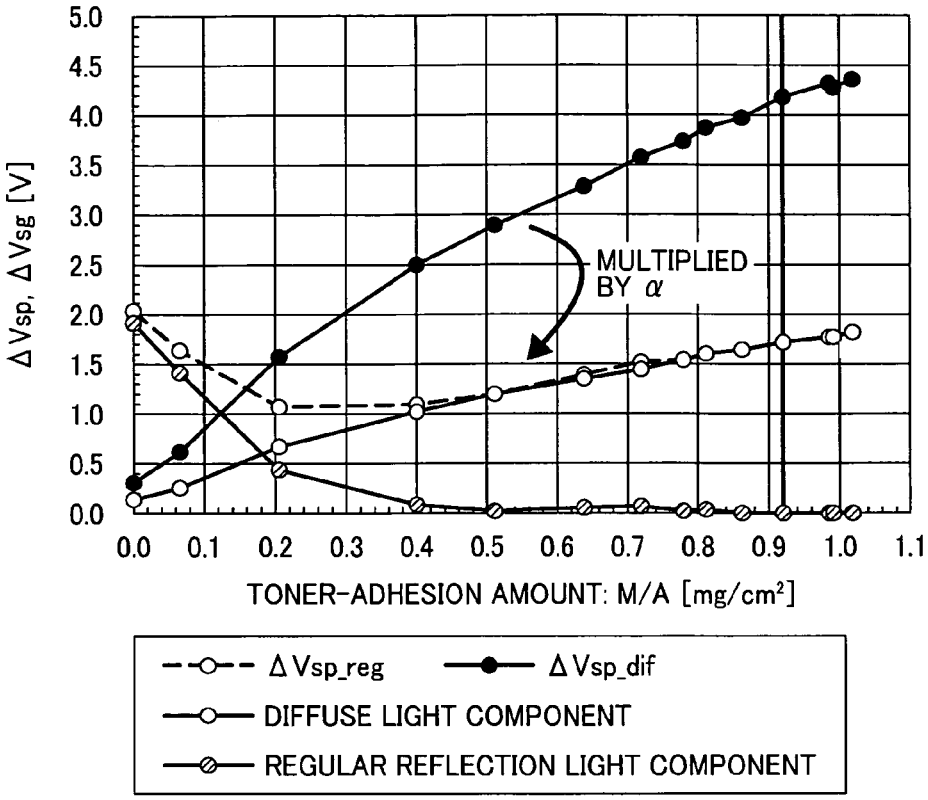
FIG. 42 shows a relation of toner-adhesion amount of test pattern, diffuse reflection component, and regular reflection component.

By conducting such component separation, the regular reflection component of output of regular reflection light can be set to zero for a test pattern detection voltage that the sensitivity correction factor α can be obtained. Based on such process, as shown in FIG. 42, the output of regular reflection light can be separated in components of "regular reflection light component" and "diffuse light component."

In step 4, the regular reflection component of output of the regular reflection light output is normalized using the following equation, in which a detection voltage of each of test patterns is compared with a detection voltage of surface skin portion of the intermediate transfer belt 10, and converted to a normalized value ranging from 0 to 1.

$$\text{Normalized value } \beta[n]=(\Delta Vsp_\text{reg._reg.})/(\Delta Vsg_\text{reg._reg})$$

(=exposed ratio of surface skin portion of intermediate transfer belt)

Figure 43:
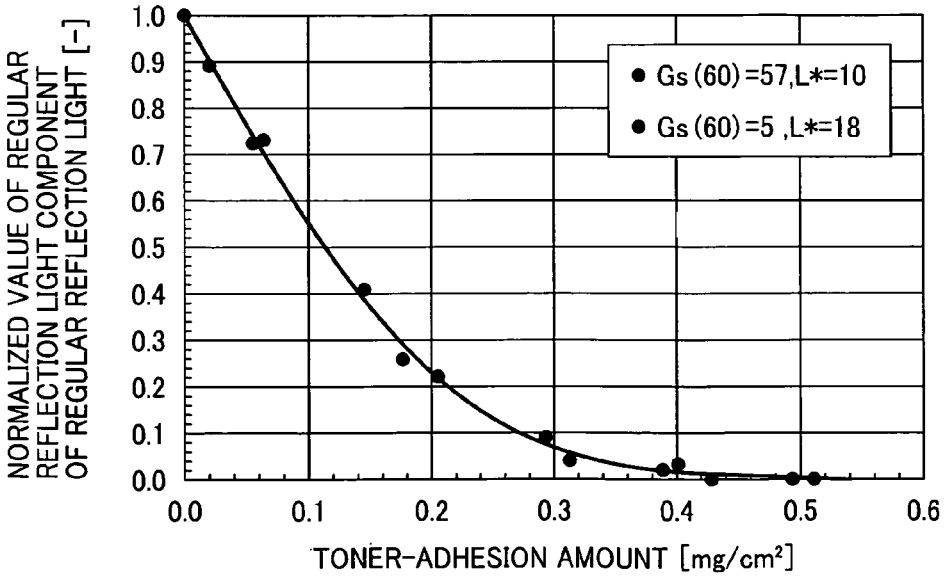
FIG. 43 shows a relation of toner-adhesion amount of test pattern and normalized value of regular reflection component for regular reflection light.

Based on step 4, as shown in FIG. 43, a profile for normalized value can be obtained.

In step 5, the variation of the output of diffuse light at the surface skin portion is corrected as below.

First, "output of diffuse light component from surface skin portion of belt" is removed from "output voltage of diffuse light" using the following equation.

$$\text{output of diffuse light after correction}=(\Delta Vsp_\text{dif}')=[\text{output voltage of diffuse light}]-[\text{detection voltage on surface skin portion}]\times[\text{normalized value of regular reflection component}]=[\Delta Vsp_\text{dif}(n)]-[(\Delta Vsg_\text{dif})\times\beta(n)]$$

Figure 44:
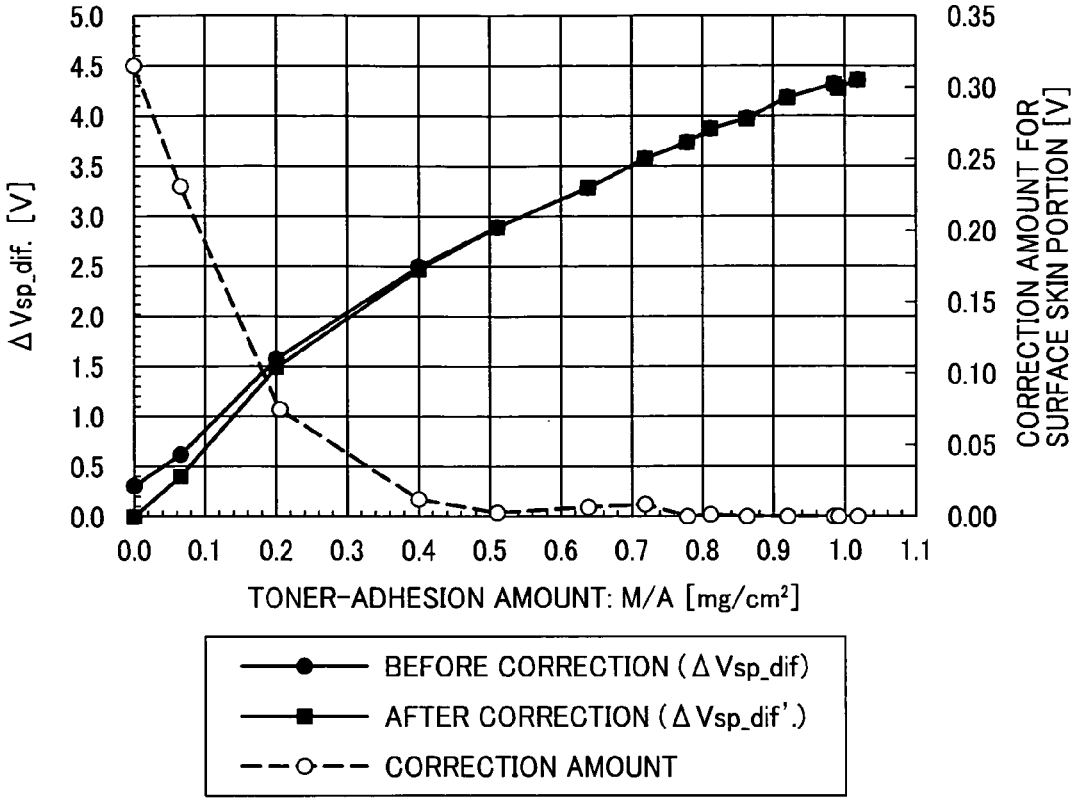
FIG. 44 shows a relation of toner-adhesion amount of test pattern, ΔVsp_dif, and variation correction value for surface skin portion.

Based on such computation, an effect of surface skin portion of the intermediate transfer belt 10 can be removed. Accordingly, in the lower adhesion amount range where the output of regular reflection light has a higher sensitivity, diffuse light component directly reflected from the surface skin portion of the belt 10 can be removed from the output of diffuse light. Based on such processing, the output of diffuse light after correction can be converted to given values, which has a linear relation with toner-adhesion amount, that is plotted along a line starting from the original point as shown in FIG. 44. Such linear relation can be set for a given toner-adhesion amount range (e.g., no toner adhesion condition and one-layer of toner-adhesion condition).

Figure 45:
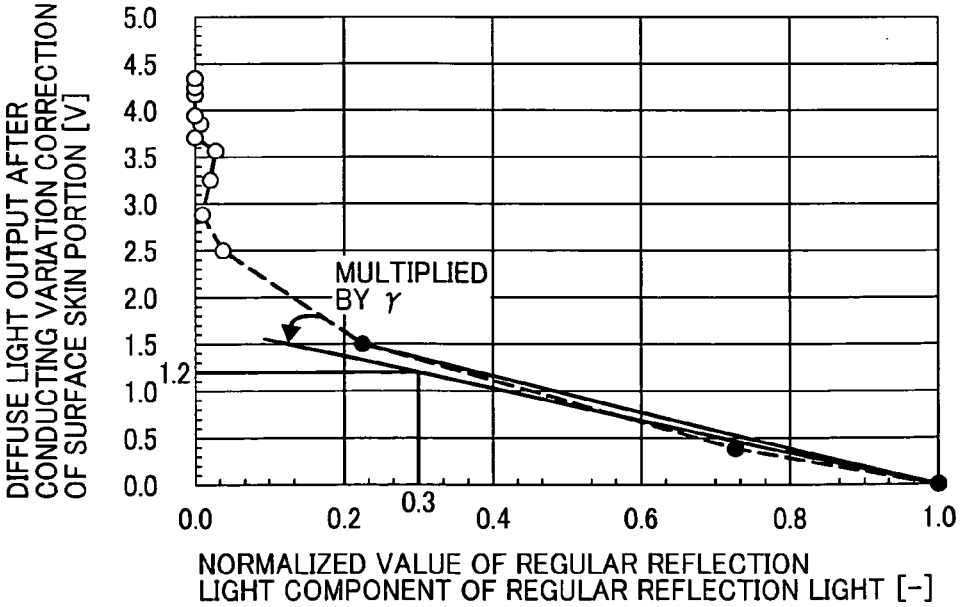
FIG. 45 shows a relation of normalized value of regular reflection component and output value of diffuse light after variation correction of surface skin portion.

In step 6, the sensitivity of output of diffuse light is corrected. Specifically, as shown in FIG. 45, the output of diffuse light from surface skin portion after conducting a variation correction is plotted against "normalized value of the regular reflection component for the regular reflection light." Based on a linear relation for lower toner adhesion amount range, the sensitivity of output of diffuse light can be, obtained.

Then, the sensitivity is corrected to a target sensitivity value. The sensitivity of output of diffuse light is a gradient of line shown in FIG. 45.

To set the output of diffuse light for surface skin portion after conducting a variation correction with respect to the given normalized value (e.g., when x=0.3, y=1.2 in FIG. 45), a correction factor to be multiplied to a present gradient is computed. Accordingly, measurement results of the output voltage value can be corrected. The gradient of line can be obtained by a least-squares method as below.

$$\text{Gradient of line}=\Sigma(x[i]-X)(y[i]-Y)/\Sigma(x[i]-X)^2;$$

X=average value of normalized value of component of regular reflection light_regular reflection;

y=Y−gradient of line×X;

x[i]=normalized value of component of regular reflection light_regular reflection (However, a range of "x" used for computing is 0.06≦x≦1);

y[i]=output of diffuse light for surface skin portion after variation correction;

Y=average value of output of diffuse light for surface skin portion after variation correction.

In an exemplary embodiment, the lower limit of "x" is set to 0.06, but other values can be set for the lower limit if such values are in the range that "x" and "y" has a linear relation. The upper limit of "x" is set to 1 because the normalized value is in the range of 0 to 1. Then, a sensitivity correction factor γ is computed using the following equation. The sensitivity correction factor γ is used to convert one normalized value "a" to another normalized value "b."

$$\text{sensitivity correction factor } \gamma=b/(\text{"gradient of line"}\times\text{"}a\text{"}+y\text{ intercept})$$

Then, the output of diffuse light for surface skin portion after the variation correction, which is obtained in step 5, is corrected by a multiplication of the sensitivity correction factor γ.

$$\text{output of diffuse light after correcting sensitivity}:(\Delta Vsp_\text{dif}'')=[\text{output of diffuse light for surface skin portion after variation correct}]\times[\text{sensitivity correction factor }\gamma]=\{\Delta Vsp_\text{dif}(n)'\}\times\gamma$$

In step 7, the sensor output value is converted to toner-adhesion amount. By taking steps 1 to 6, variation of output of diffuse reflection over time, which may be caused by a decrease of LED light intensity, is corrected. Then, the sensor output value is converted to toner-adhesion amount using the toner-adhesion amount conversion table. By conducting the above described process, toner adhesion amount can be computed for both of black toner and non-black toner in step S707. Then, development γ is computed in step S708.

FIG. 35 shows a relation of a development potential and a toner adhesion amount when the test patterns are formed in step S707 (FIG. 34). The development potential is a potential difference between the development bias voltage Vb and a surface potential of the photoconductor 20 having a unit of "−Kv," and the toner-adhesion amount has a unit of "mg/cm$^2$." The toner-adhesion amount is defined as a toner amount that adheres per unit area.

In step S708, the development γ can be computed by using a substantially linear relation shown in FIG. 35, in which the gradient is referred to development γ, and the "x intercept" is referred to as a development start voltage. Based on the substantially linear relation shown in FIG. 35, a development potential, which may be matched to a target toner adhesion amount, can be computed in step S709. Then, the charging voltage Vd, the development bias voltage Vb, and the exposure voltage VL, matched to the development potential obtained in step S709, can be computed in the following steps of S710 to S714.

Figure 46:
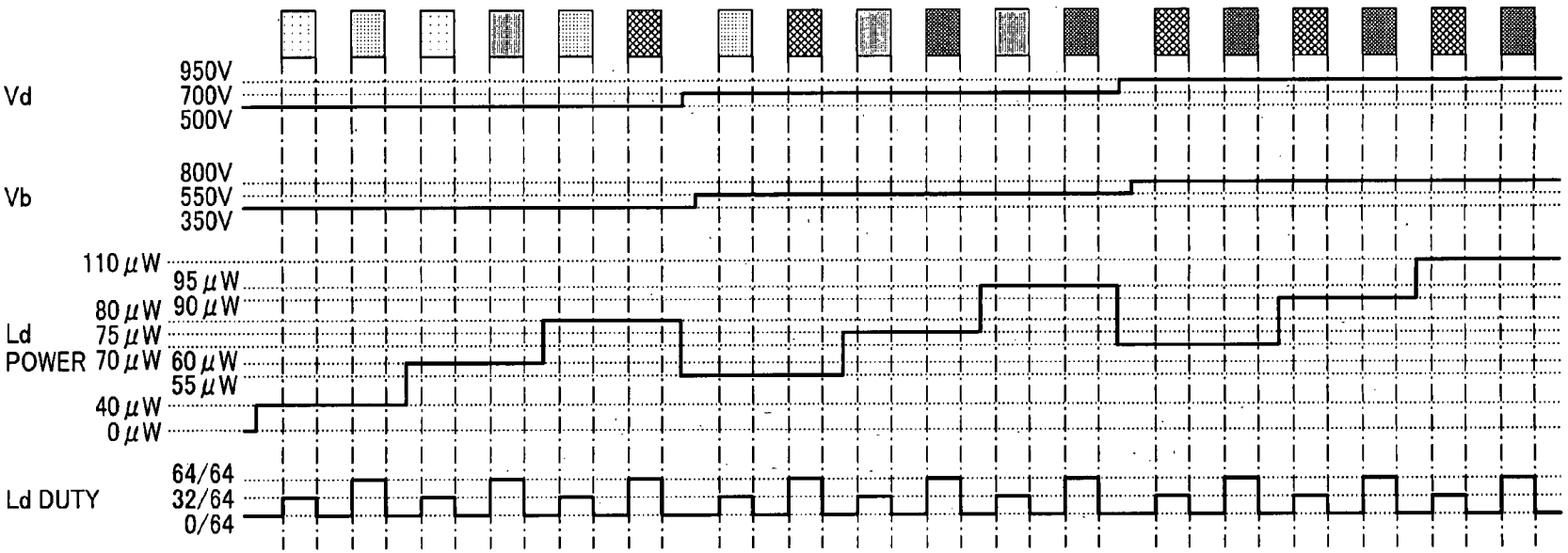
FIG. 46 shows test patterns of 18 gray-scales.

The above mentioned toner patterns having 18 gray-scale image patterns, formed in step S705 under a given image forming condition are shown in FIG. 46, in which exposure potential is changed in a given range. FIG. 46 shows the charging voltage Vd, which may be a surface potential of the photoconductor 20 when uniformly charged by the charge unit 60; the development bias voltage Vb applied to the development sleeve 65; Ld Power is exposure power applied onto the photoconductor 20 (hereinafter, may be referred to exposure power Lp); and Ld Duty is an exposure time per unit time, which can be termed as exposure duty.

A surface skin potential, which is a difference between the charging voltage Vd and the development bias voltage Vb, may be determined according to types of apparatus. For example, in some apparatuses, adequate value of the surface skin potential may change depending on a value of the charging voltage Vd. In the image forming apparatus 600, a surface skin potential can be kept at a given voltage (e.g., 150V) constantly, and the charging voltage Vd and development bias voltage Vb has a relation of "(development bias voltage Vb)=(charging voltage Vd)−150V." Accordingly, when setting image forming conditions, the development bias voltage Vb can be changed by changing the charging voltage Vd.

Specifically, the charging voltage Vd can be changed in three (3) levels, for example. The three levels of charging voltage Vd may be −500V, −700V, and −950V, for example, but not limited these. Further, the exposure power Lp can be changed in three (3) levels for each of the three levels of charging voltage Vd. For example, for Vd=−500V, the exposure power Lp can be set to 40 μW, 60 μW, and 80 μW; for V δ=−700V, the exposure power Lp can be set to 55 μW, 75 μW, and 95 μW; for Vd=−950V, the exposure power Lp can be set to 70 μW, 90 μW, and 110 μW. Further, the exposure duty per unit area can be changed in two (2) levels, for example. For example, as for an exposure process, the exposure duty per unit area (or Ld Duty) can be changed in two levels of 32/64 value and 64/64 value for each of combinations selected from a matrix of (charging voltage Vd: three levels)×(exposure power Lp: three levels).

As shown in FIG. 46, among the image forming conditions, value of Ld Duty may be changed at first, in which the Ld Duty is changed in two (2) levels by setting the charging voltage Vd and the exposure power Lp at a given constant value, respectively. Specifically, when the charging voltage Vd=−500V and the exposure power Lp=40 μW are set, two values (i.e., 32/64 value and 64/64 value) of the Ld Duty can be used. When 32/64 value (i.e., half-tone image exposure) is used, a partial area (e.g., half of area) may be exposed, and when 64/64 value (i.e., solid image exposure) is used, a solid area is exposed. The surface potential of photoconductor is checked under such condition. As for the 18 test patterns shown on a top of FIG. 46, each of the two patterns at the left end are test patterns formed by using the charging voltage Vd=−500 V and the exposure power Lp=40 μW is respectively an image for half-tone image exposure and an image for solid image exposure, for example, in which Ld Duty values is changed for each of the two patterns.

Then, the exposure power Lp may be changed from 40 μW to 60 μW, and the Ld Duty values of half-tone image exposure and solid image exposure may be used to form test patterns. Further, the exposure power Lp may be changed from 60 μW to 80 μW, and the Ld Duty values of half-tone image exposure and solid image exposure may be used to form test patterns. Similar processes may be conducted by another two levels of the charging voltage Vd to form a total of 18 gray-scale latent image patterns, defined by (charging voltage Vd: three levels)×(exposure power Lp: three levels)×(Ld Duty: two levels).

Figure 47:
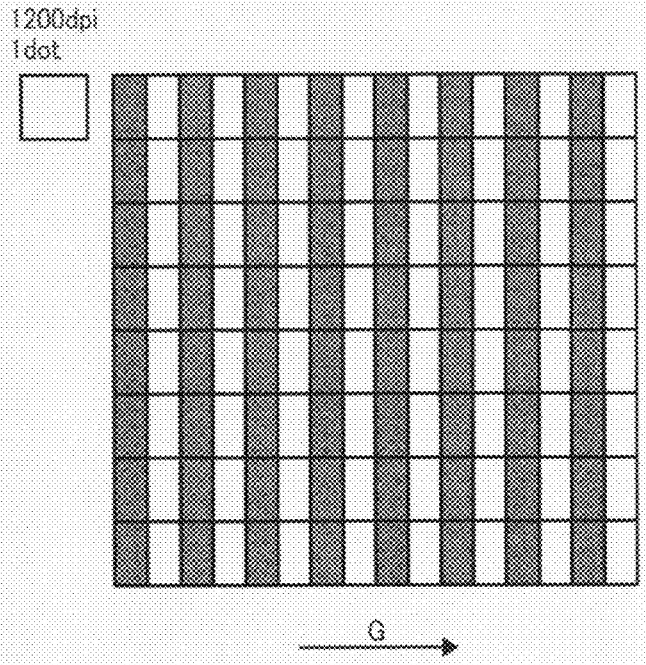
FIG. 47 shows one halftone image having an exposure duty of 32/64 value.

An exposure pattern composed of a plurality of dots can be formed using a given exposure duty per unit area. For example, FIG. 47 shows a schematic view of an exposure pattern composed of a plurality of exposed dots, in which 32/64 value of dot numbers per unit area is exposed by changing exposure for each one of single dot. In FIG. 47, an arrow G shows a main scanning direction, and black portions correspond to exposed portions exposed by a light beam emitted from a light source. As shown in FIG. 47, the dot numbers per unit area can be set to 32/64 value by conducting a pulse exposure for each one of single dot. Further, by conducting a continuous exposure of light source, the dot numbers per unit area can be set to 64/64 value. Further, in an exemplary embodiment, a unit pixel is composed of 1200 dpi×1200 dpi (dot per inch), for example.

Figure 48:
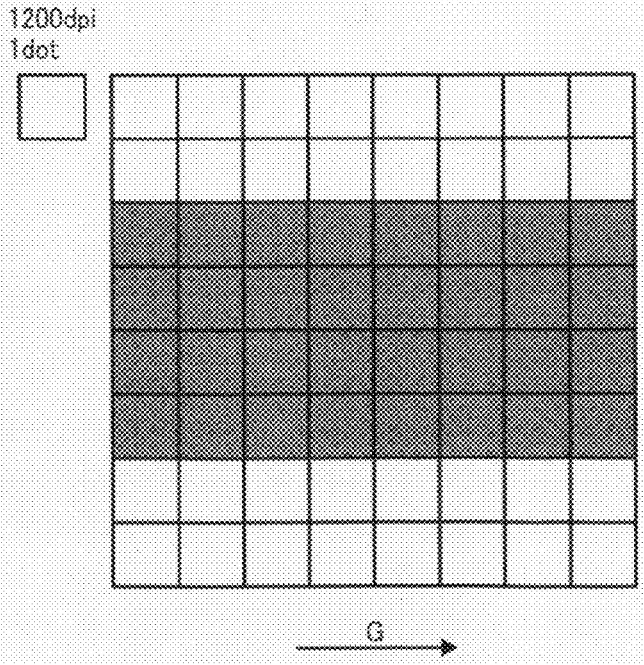
FIG. 48 shows another halftone image having an exposure duty of 32/64 value.

When to control a change of an exposure duty per unit area, a latent image of one dot is formed by setting an exposed portion and a not-exposed portion in one single dot as shown in FIG. 47. However, a latent image can be formed more stable manner by controlling exposed dot numbers per unit area using a combination of exposed dot and not-exposed dot. FIG. 48 shows a schematic view of exposure pattern composed of a plurality of dots, in which dot numbers per unit area is set to 32/64 value by a combination of exposed dots and not-exposed dots. In FIG. 48, each one of single dot is either totally exposed or not exposed.

When a high density exposure process such as 600 dpi or more is conducted by some exposure units, a latent image formed by exposing each one of dots using a pulse exposure method may not have enough level of exposure energy, by which a latent image potential may not be stabilized. On one hand, as shown in FIG. 48, if a latent image can be formed by a combination of exposed dots and not-exposed dots per unit area by changing Ld Duty, the latent image can be formed on a photoconductor in a concentrated manner, by which a latent image potential can be stabilized for FIG. 48 compared to a case shown in FIG. 47 that Ld Duty is changed within one dot.

Further, in the exposure pattern shown in FIG. 48, exposed dots are adjacently formed or concentrated each other. By concentrating the exposed dots as such, a boundary area between exposed portions and not-exposed portions can be reduced, by which a latent image condition (or exposure pattern) in FIG. 48 can be stabilized compared to the exposure pattern of FIG. 47, wherein the exposure pattern shown in FIG. 47 and the exposure pattern shown in FIG. 48 have same dot numbers per unit area of 32/64 value.

Further, in the exposure pattern of FIG. 47, the light source is alternatively set to ON and OFF for many times, by which the formed latent image condition may become unstable. On one hand, in the exposure pattern of FIG. 48, the exposed dots can be continuously formed in a main scanning direction, which means the light source can be continuously set to ON while the exposed dots are formed. Accordingly, the formed latent image condition of FIG. 48 may become stable compared to the exposure pattern of FIG. 47. FIGS. 47 and 48 show a unit pixel having 1200 dpi×1200 dpi as one example. If a unit pixel has a pixel density of 600 dpi×600 dpi or more, a latent image formed by using a pulse width modulation for each one of dots (i.e., latent image is formed only by changing Ld Duty as shown in FIG. 47) may become unstable. Accordingly, a latent image may be preferably formed by using the pattern shown in FIG. 48.

Further, an image pattern having dot numbers per unit area of 32/64 value is a halftone image, which is not a solid image exposure pattern that exposes all dots completely. A latent image pattern, which is other than a solid image exposure pattern, may not be limited to the latent image patterns shown in FIGS. 47 and 48, but other latent image patterns can be used. For example, a latent image pattern including actual halftone images of actual image forming can be used.

Figure 49:
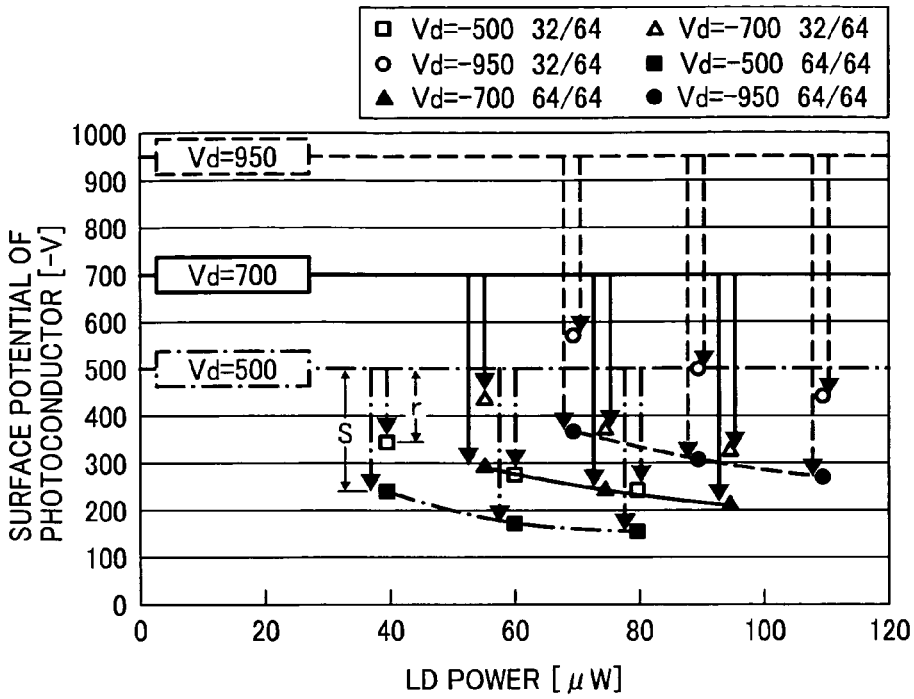
FIG. 49 shows graphs of exposure potential when toner patterns are formed at a given image forming condition.

A description is back to step S710 of computing a photo-induced discharge characteristic with reference to FIG. 49. FIG. 49 shows post-exposed voltage of photoconductor for 18 gray-scale image patterns (or latent images) shown in FIG. 46, in which the horizontal axis represents the exposure power Lp and the vertical axis represents post-exposed voltage of photoconductor. The post-exposed voltage of photoconductor means a surface potential of photoconductor after an exposure process. The surface potential of photoconductor is detected by the potentiometer 320, which outputs values for detected surface potential.

The photo-induced discharge characteristic can be defined as a ratio of a first attenuated potential having a maximum exposure duty per unit area and a second attenuated potential having a given half-tone exposure duty per unit area. In an exemplary embodiment, the first attenuated potential corresponds to a solid exposure having Ld Duty=64/64, and the second attenuated potential corresponds to Ld Duty=32/64, for example. The ratio of the first attenuated potential and the second attenuated potential can be computed using data plot in FIG. 49, in which a ratio of "(second attenuated potential corresponding to an arrow length from a charging voltage to white data point)/(first attenuated potential corresponding to an arrow length from a charging voltage to black data point)" can be computed. For example, as for one image forming condition using the charging voltage Vd=−500V and the exposure power Lp=40 μW, a potential difference "r" (second attenuated potential) and a potential difference "s" (first attenuated potential) can be used to compute a ratio of "r/s" as a photo-induced discharge characteristic under such image forming condition.

Figure 50:
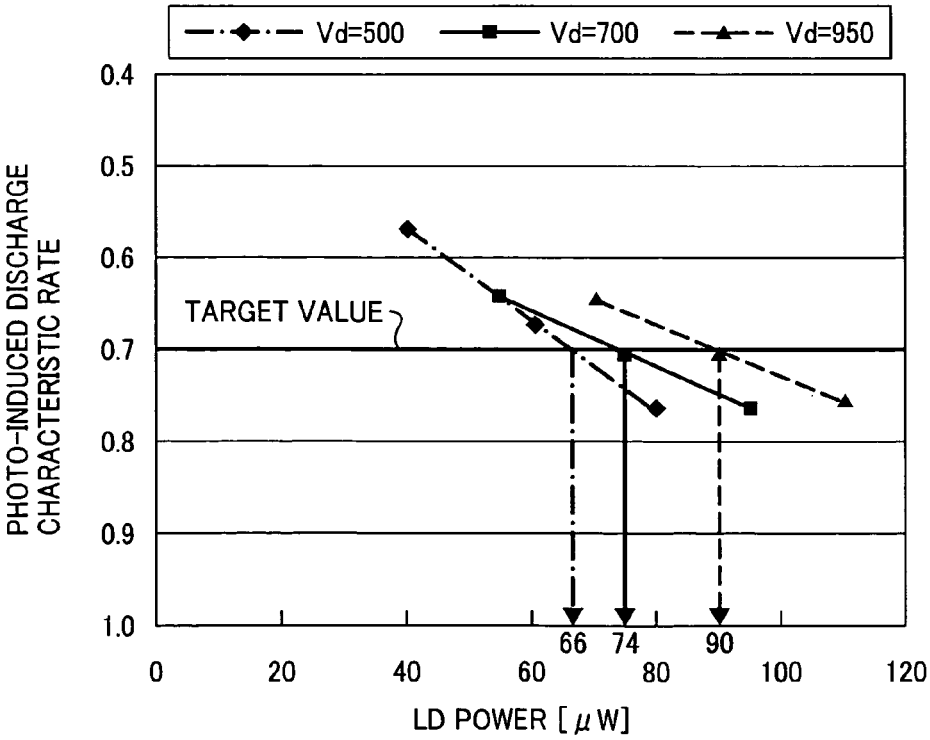
FIG. 50 shows graphs showing a relation of exposure power and photo-induced discharge characteristic.

After step S710, a suitable LD power (or exposure power Lp) for each of charging voltage conditions can be computed in step S711 with reference to FIG. 50. Based on data plot of FIG. 49, photo-induced discharge characteristic for nine image forming conditions (the charging voltage Vd of three levels, and the exposure power Lp of three levels) are plotted as shown in FIG. 50. In FIG. 50, the horizontal axis represents the exposure power Lp, and the vertical axis represents photo-induced discharge characteristic rate. As for each of the charging voltage Vd, the exposure power Lp and the photo-induced discharge characteristic may have a relation of collinear approximation.

A suitable exposure power Lp may be determined using the photo-induced discharge characteristic as a parameter. The photo-induced discharge characteristic rate is a ratio of an exposure potential for halftone image (halftone image exposure) divided by an exposure potential for a solid image formed by a solid exposure (solid image exposure), in which halftone image exposure uses an exposure duty per unit area corresponding to halftone value. Accordingly, if the photo-induced discharge characteristic can be set to a constant value, the halftone image can be formed with a given image concentration, which may be constant.

A suitable value of photo-induced discharge characteristic may vary depending on each of apparatuses, and further, depending on dot numbers per unit area of halftone image. Accordingly, the photo-induced discharge characteristic may be set to a given value in advance. In an exemplary embodiment, the photo-induced discharge characteristic rate may be set to 0.7 as a target value, for example. As shown in FIG. 50, the suitable exposure power Lp for each of the charging voltage Vd can be set as follows based on collinear approximation for each of the charging voltage Vd: when Vd=−500V, a suitable exposure power Lp is 66 μW; when Vd=−700V, a suitable exposure power Lp is 74 μW; and when Vd=−950V, a suitable exposure power Lp is 90 μW, for example.

As such, the greater the charging voltage Vd, the greater the suitable exposure power Lp. Therefore, when test patterns of toner images are formed using a greater charging voltage Vd, the exposure power Lp may be preferably set to a greater value in the three levels because an exposure power Lp corresponding to a target value (e.g., 0.7) of photo-induced discharge characteristic rate can be set within a preferable value range of exposure power Lp under such condition, and the suitable exposure power Lp for each of the charging voltage Vd can be computed precisely.

Figure 51:
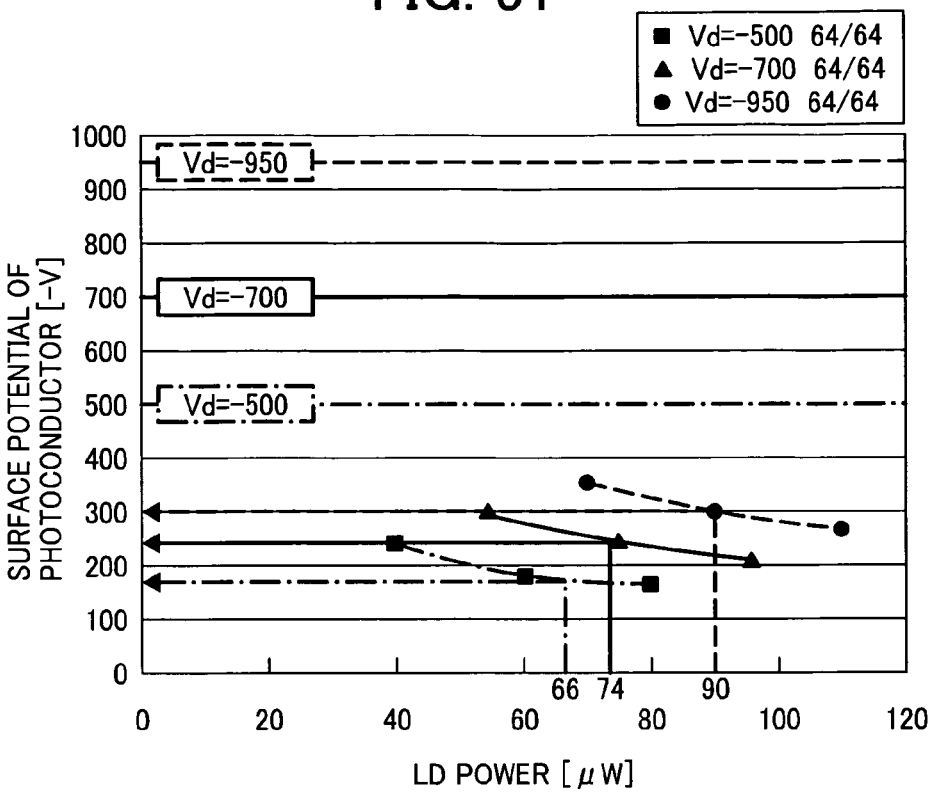
FIG. 51 shows graphs for computing exposure potential based on exposure power.

After step S711, the exposure voltage VL for each of charging voltage Vd is computed in step S712. FIG. 51 shows data plot of the post-exposed voltage when an exposure duty per unit area is set to maximum value (i.e., solid image exposure). In FIG. 51, the horizontal axis represents the exposure power Lp, and the vertical axis represents the post-exposed voltage (i.e., surface potential of photoconductor after an exposure process). The post-exposed voltage of FIG. 51 may be same as the post-exposed voltage for 64/64 value shown in FIG. 49.

Although the photo-induced discharge profile cannot be approximated by a quadratic approximation over a broader range, the photo-induced discharge profile can be approximated by a quadratic approximation in a limited range. For example, the photo-induced discharge profile can be approximated precisely in a range of the exposure power Lp, typically set for an image forming process.

Based on the result of quadratic approximation and the suitable exposure power Lp for each of the charging voltage conditions, computed in step S711 (FIG. 50), the exposure voltage VL for the solid image exposed by the suitable exposure power Lp can be obtained from an approximate expression for the profile shown in FIG. 51.

The exposure voltage VL for the solid image exposed by the suitable exposure power Lp for each of charging voltage Vd can be set based on the approximate expression as below, for example.

When the charging voltage Vd=−500V, the exposure power Lp=66 μW becomes a suitable exposure power Lp, and the post-exposed voltage of the photoconductor of −180 V, obtained using the exposure power Lp=66 μW, becomes the exposure voltage VL for the solid image exposed by the suitable exposure power Lp. Similarly, when the charging voltage Vd=−700V, the exposure voltage VL=−240 V, and when the charging voltage Vd=−950V, the exposure voltage VL=−300V.

After step S712, an exposure potential Pot for each of charging voltage conditions is computed in step S713. The exposure potential Pot (V) can be obtained by an equation of "Vd−VL (V)." For example, a suitable exposure potential for each of charging voltage conditions may be as follows: when the charging voltage Vd=−500V, the exposure potential Pot=320V; when the charging voltage Vd=−700V, the exposure potential Pot=460V; when the charging voltage Vd=−950V, the exposure potential Pot=650V. Table 2 shows the charging voltage Vd, the exposure power Lp, the exposure voltage VL, and the exposure potential Pot, which are obtained by steps S710 to S713, in which suitable exposure power Lp (Ld power), exposure voltage VL for solid image, and exposure potential Pot for each of the charging voltage Vd are shown.

TABLE 2

| Charging voltage Vd (−V) | Ld power for light attenuation of 0.7 (μW) | Exposure voltage VL (−V) | Exposure potential Pot: Vd − VL (−V) |
|---|---|---|---|
| 500 | 66 | 180 | 320 |
| 700 | 74 | 250 | 450 |
| 950 | 90 | 300 | 650 |

Figure 52:
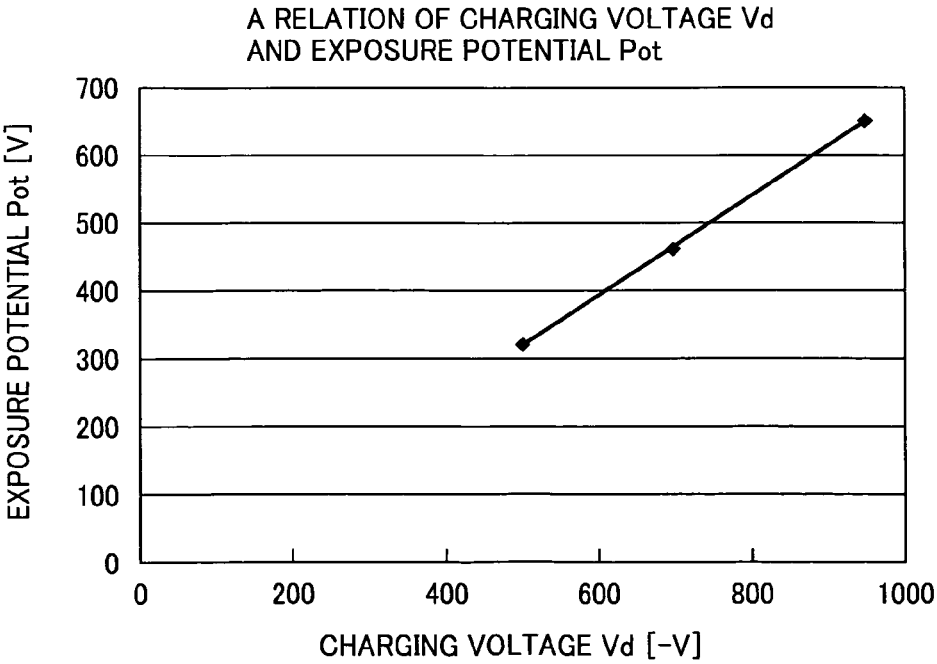
FIG. 52 shows a graph showing a relation of charging voltage and exposure potential.

A relation of the charging voltage Vd and the corresponding suitable exposure potential Pot shown in Table 2 can be plotted in a graph as shown in FIG. 52. As indicated by the graph, the charging voltage. Vd and the suitable exposure potential Pot may have a relation of collinear approximation. Based on such collinear approximation relation, an exposure potential Pot corresponding to a given charging voltage Vd can be computed. In an exemplary embodiment, a relation of the charging voltage Vd and the corresponding suitable exposure potential Pot can be approximated as a collinear approximation by changing the charging voltage Vd for three levels, but such collinear approximation can be established by changing the charging voltage Vd for two levels. However, from a viewpoint of higher precision for process control, it may be preferable to change the charging voltage for three levels or more.

After step S713, image forming condition is determined in step S714. Based on the above described development γ, a development potential required for obtaining a target toner adhesion amount can be computed in step S709, by which a suitable development potential can be computed by an equation of "development potential=exposure potential−surface skin potential."

In an exemplary embodiment, because the surface skin potential is set to 150V, for example, the surface skin potential of 150V can be added to the development potential computed in step S709 to compute a suitable exposure potential Pot1. As above described with reference to FIG. 52, the charging voltage Vd and the exposure potential Pot may have a collinear approximation relation. Accordingly, a suitable exposure potential Pot for a given charging voltage Vd can be computed using the graph of FIG. 52. Specifically, based on the collinear approximation relation of FIG. 52, a suitable charging voltage Vd1 corresponding the suitable exposure potential Pot1 can be computed.

Further, by subtracting the surface skin potential from the computed suitable charging voltage Vd1, a suitable development bias voltage Vb1 can be computed.

Figure 53:
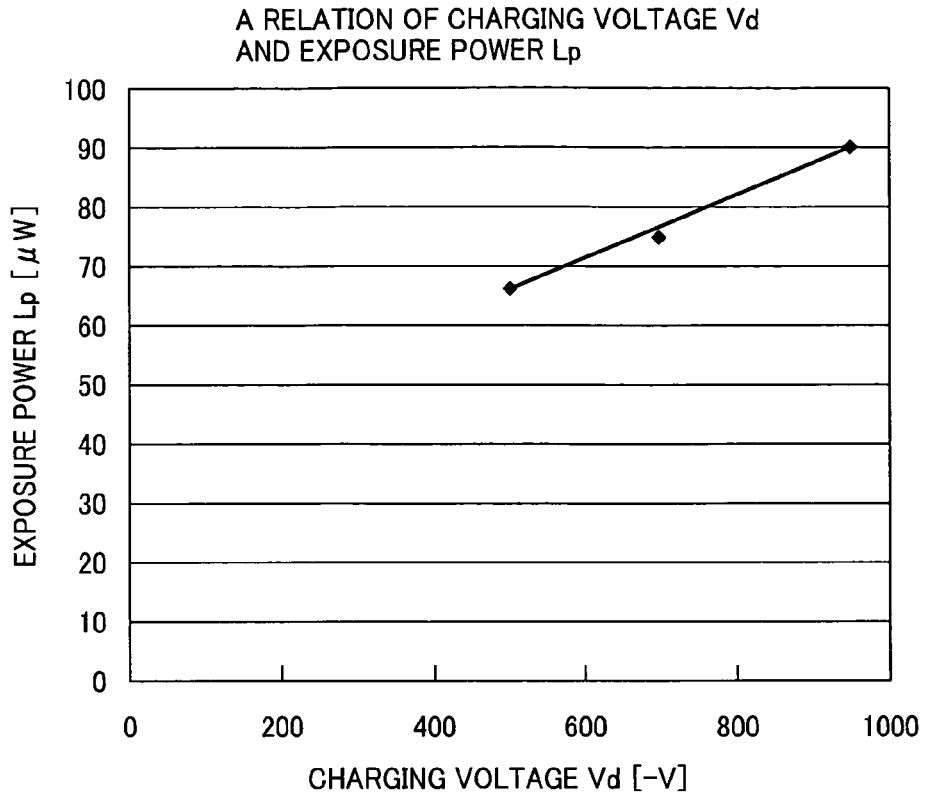
FIG. 53 shows a graph showing a relation of charging voltage and exposure power.

Further, the charging voltage Vd and the exposure power Lp in Table 2 may have a collinear approximation relation as shown in FIG. 53. Accordingly, based on the collinear approximation relation (see graph of FIG. 53), a suitable exposure power Lp1 corresponding to the suitable charging voltage Vd1 can be computed. By which, the charging voltage Vd, the development bias voltage Vb, and the exposure power Lp used for image forming process can be determined.

Based on the charging voltage Vd, a charge voltage having direct current DC to be applied by the charge unit 60 can be determined, and based on the development bias voltage Vb, a development voltage having direct current DC to be applied to the development sleeve 65 can be determined as image forming conditions.

In an exemplary embodiment, a relation of the charging voltage Vd and the corresponding suitable exposure power Lp can be approximated as a collinear approximation by changing the charging voltage Vd for three levels, but such collinear approximation can be established by changing the charging voltage Vd for two levels. However, from a viewpoint of higher precision a viewpoint of higher precision for process control, it may be preferable to change the charging voltage for three levels or more.

Further, the charging voltage Vd can be approximated as a collinear approximation with any one the exposure potential Pot and the exposure power Lp by changing the charging voltage Vd for three levels, but such collinear approximation can be established by changing the charging voltage Vd for two levels. However, from a viewpoint of higher precision a viewpoint of higher precision for process control, it may be preferable to change the charging voltage for three levels or more.

In an exemplary embodiment, the development γ is computed in step S708 by using 18 gray-scale image patterns shown in FIG. 46. Then the development potential required for obtaining a target toner adhesion amount can be computed in step S709 using the development γ computed in step S708. As above described, a total of 18 gray-scale image patterns can be formed using a combination of (charging voltage Vd:three levels)×(exposure power Lp:three levels)×(Ld Duty:two levels).

In step S706, a potential of each of test patterns of latent images on the photoconductor 20 can be detected by the potentiometer 320, by which a surface potential of photoconductor having each of test patterns of latent images can be computed as shown in FIG. 49. Based on the surface potential of photoconductor for each of test patterns (latent images) and a development bias voltage for each of test patterns, a development potential for each of test patterns can be computed, by which a potential conversion can be conducted (step S707).

On one hand, after detecting a potential for each of test patterns, the latent image is developed as a toner image, and primary transferred onto the intermediate transfer belt 10. Then the image concentration sensor 310 (P sensor) detects the toner image formed on the intermediate transfer belt 10 (step S706). Based on the detection result, a toner-adhesion amount conversion is conducted (step S707), by which toner-adhesion amount for each of test patterns can be computed.

A relation of such computed development potential and toner-adhesion amount for each of 18 gray-scale image patterns can be collinear approximated as shown in FIG. 35, by which the development γ can be computed (step S708).

By completing step S714, the self-check operation can be completed, and then a process of deactivating the image forming apparatus is conducted in step S715 to end an image forming condition adjustment control.

In an exemplary embodiment, a first process of obtaining a required development potential (step S705 to S709), and a second process of obtaining the charging voltage Vd, exposure power Lp, and development bias voltage Vb suitable for the development potential and obtaining a relation of the charging voltage Vd, exposure power Lp, and development bias voltage Vb (step S710 to S714) are sequentially conducted, but the first process and the second process can be computed concurrently.

For example, in the self-check operation, if the 18 gray-scale image patterns are formed and detected, suitable charging voltage Vd, exposure power Lp, and development bias voltage Vb can be obtained without a process of optimizing only the exposure power Lp, in which the exposure power Lp is set to maximum level, and residual potential is detected.

Figure 54:
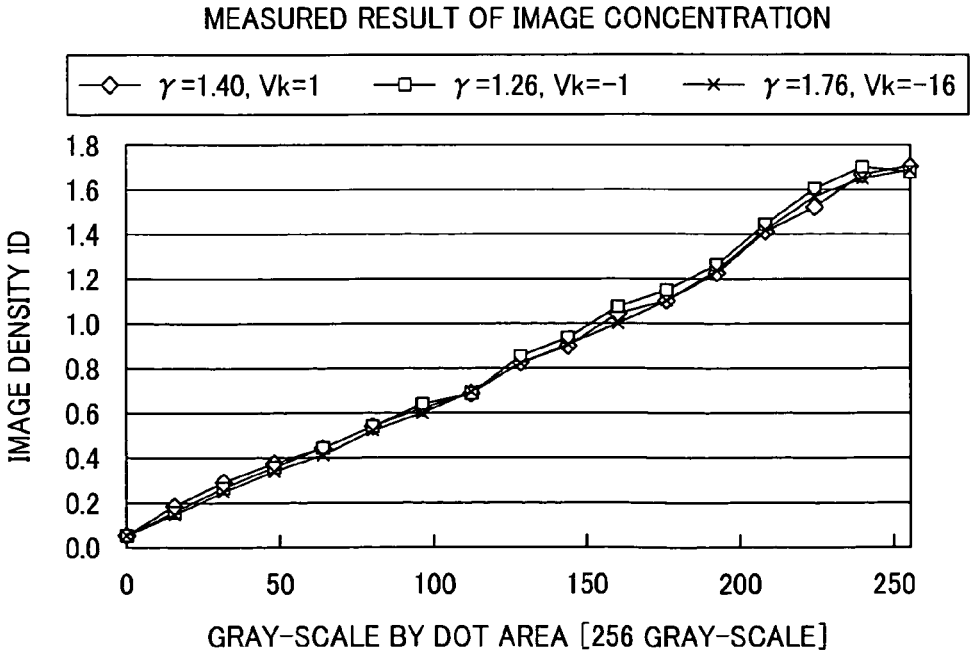
FIG. 54 shows a graph showing measurement result of image concentration.

FIG. 54 shows a result of image concentration (or image density) obtained by an image forming condition adjustment control. In FIG. 54, the horizontal axis represents gray-scale by dot area, and the vertical axis represents image concentration. The result indicates that a development performance can be effectively controlled for halftone image concentration and solid image concentration from a smaller development performance (e.g., development γ=1.26) to a greater development performance (e.g., development γ=1.76).

In an exemplary embodiment, an exposure power Lp, which corresponds to a target value of the photo-induced discharge characteristic (e.g., 0.7 or so) is set, and then a photoconductor may be exposed using a combination of a given charging-voltage Vd and the exposure power Lp set for the target value of photo-induced discharge characteristic. Accordingly, the exposure power Lp may not need a greater light intensity that can measure the residual potential Vr.

In a conventional image forming apparatus, when a photoconductor fatigues, the residual potential Vr may increase, such increase can be detected. Such increase of residual potential Vr is added to a charging voltage. In such a condition, to detect the residual potential Vr with higher precision, an exposure power $Lp_{vr}$ needs to be set to a given level that a post-exposed voltage may not change even if the exposure power may change in some degree.

When an exposure potential $Pot_{}_{Vr}$ is set as a difference between the charging voltage Vd and the residual potential Vr, and then an exposure potential $Pot_{}_{Vr}'$ is set as a potential when the exposure power Lp is defined by "$LP_{Vr}\times 0.9$," $Pot_{Vr}$ and $Pot_{}_{Vr}'$ may have a relation of following equation (2).

$$Pot_{}_{Vr}' \geqq 0.99 \times Pot_{}_{Vr} \quad (2)$$

Therefore, even the exposure power decreases by 10%, a change of the exposure potential $Pot_{}_{Vr}$ (a difference between the charging voltage Vd and the residual potential Vr) may be limited to 1% or less by setting the exposure power $Lp_{Vr}$ that is a stronger exposure power. By setting the stronger exposure power $Lp_{Vr}$, even if a further stronger exposure power is applied to a photoconductor, the exposure voltage VL may not change so much (for example, even the exposure power Lp is increased by 10%, the exposure voltage VL changes within 1%), by which the residual potential Vr can be detected correctly. Accordingly, in a conventional image forming apparatus, to saturate a surface potential of photoconductor that can satisfy the relation of the equation (2), the exposure power needs to be greater.

On one hand, in an exemplary embodiment, a combination of charging voltage Vd and exposure power Lp, which can obtain a target value of the photo-induced discharge characteristic (e.g., 0.7), can be obtained directly with a consideration on characteristic change due to photoconductor fatigue. Accordingly, the residual potential Vr may not need to be detected. Therefore, in the image forming apparatus 600 according to an exemplary embodiment, the photoconductor may not need to be exposed by a greater exposure power Lp, which may be need for a conventional image forming apparatus.

In the above description, a reflection-type sensor is used as an optical sensor or photosensor, in which a light, emitting from a light emitting device (LED), is reflected on a face of a given object, and a light receiving element receives the reflection light. However, a light transmissive sensor can be used instead of the reflection-type sensor. In case of the light transmissive sensor, the intermediate transfer belt 10 may be made of an optical transparency material, and a light, emitting from a light emitting device (LED), is transmitted through the intermediate transfer belt 10, and then a light receiving element receives the transmitted light. Based on light intensity of the transmitted light received by the light receiving element, a toner-adhesion amount of test patterns can be obtained.

Figure 55:
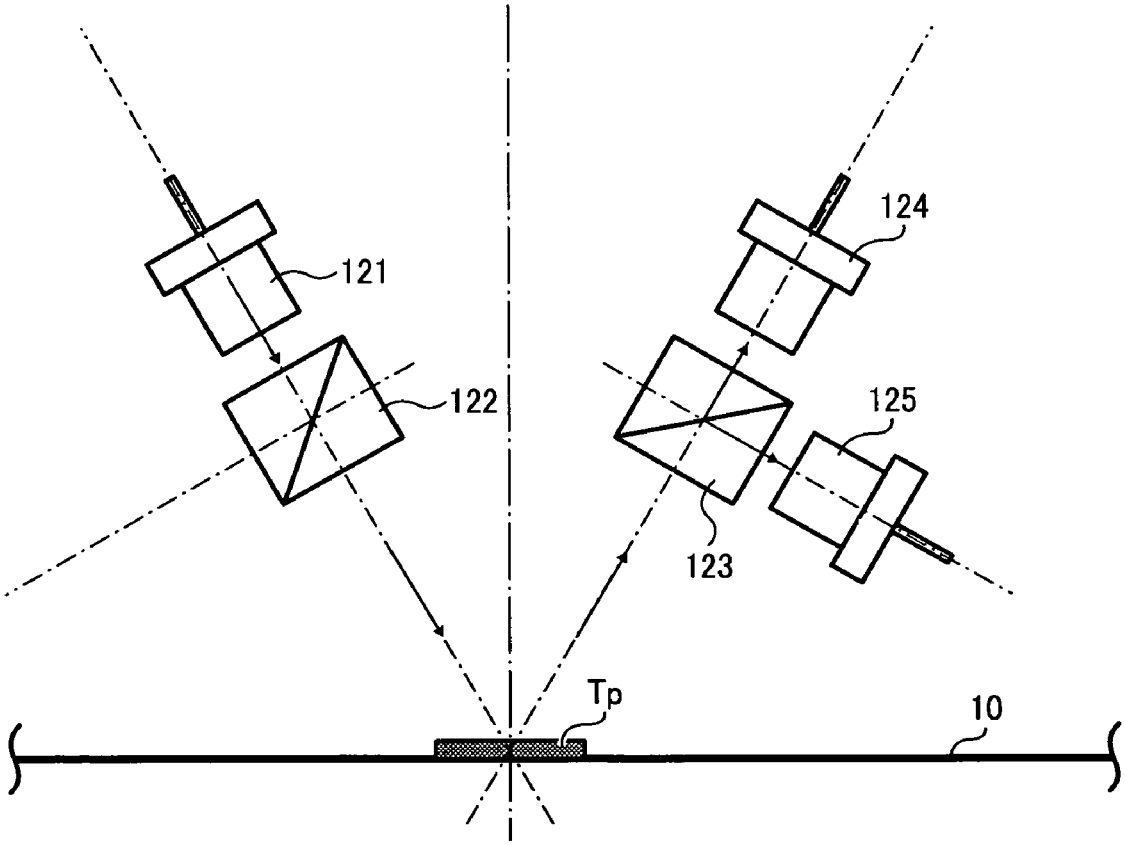
FIG. 55 shows an expanded view of an optical sensor including a beam splitter.

Further, another optical sensor shown in FIG. 55 can be used as an optical sensor. In FIG. 55, an LED 121 used as a light emitting device emits a light having P polarized-light component and S polarized-light component. When the light passes a polarizing filter 122, the S polarized-light component is cancelled, and then only the P polarized-light component reflects on a face of object Tp as a reflection light. Due to the reflection, a light polarization is changed, by which the reflection light again includes P polarized-light component and S polarized-light component. When the reflection light passes a beam splitter 123, the P polarized-light component goes to the same direction of the reflection light, and the S polarized-light component goes to another direction inclined by 90 degrees from the reflection light direction, by which the P polarized-light component and the S polarized-light component can be separated. The P polarized-light component passed through the beam splitter 123 is received by a first light receiving element 124. Further, the S polarized-light component passed through the beam splitter 123 is received by a second light receiving element 125.

In the above description, a toner image formed on the photoconductor 20 (used as latent image carrier) is transferred to the intermediate transfer belt 10 (used as an endlessly moving belt), and further transferred to the transfer sheet 5 (used as a recording medium), but other configuration can be used. For example, a sheet transport belt (used as an endlessly moving belt) can be faced to a photoconductor, and a toner image formed on the photoconductor can be directly transferred to the transfer sheet 5 transported by the sheet transport belt. In such a configuration, test patterns can be transferred onto surface of the sheet transport belt, and the test patterns can be detected by an optical sensor.

Further, in the above description, a color image forming apparatus which produces a multi-color image using a plurality of toner images can be used. However, the configuration according to an exemplary embodiment can be employed for an image forming apparatus producing single color image (e.g., black image).

Figure 56:
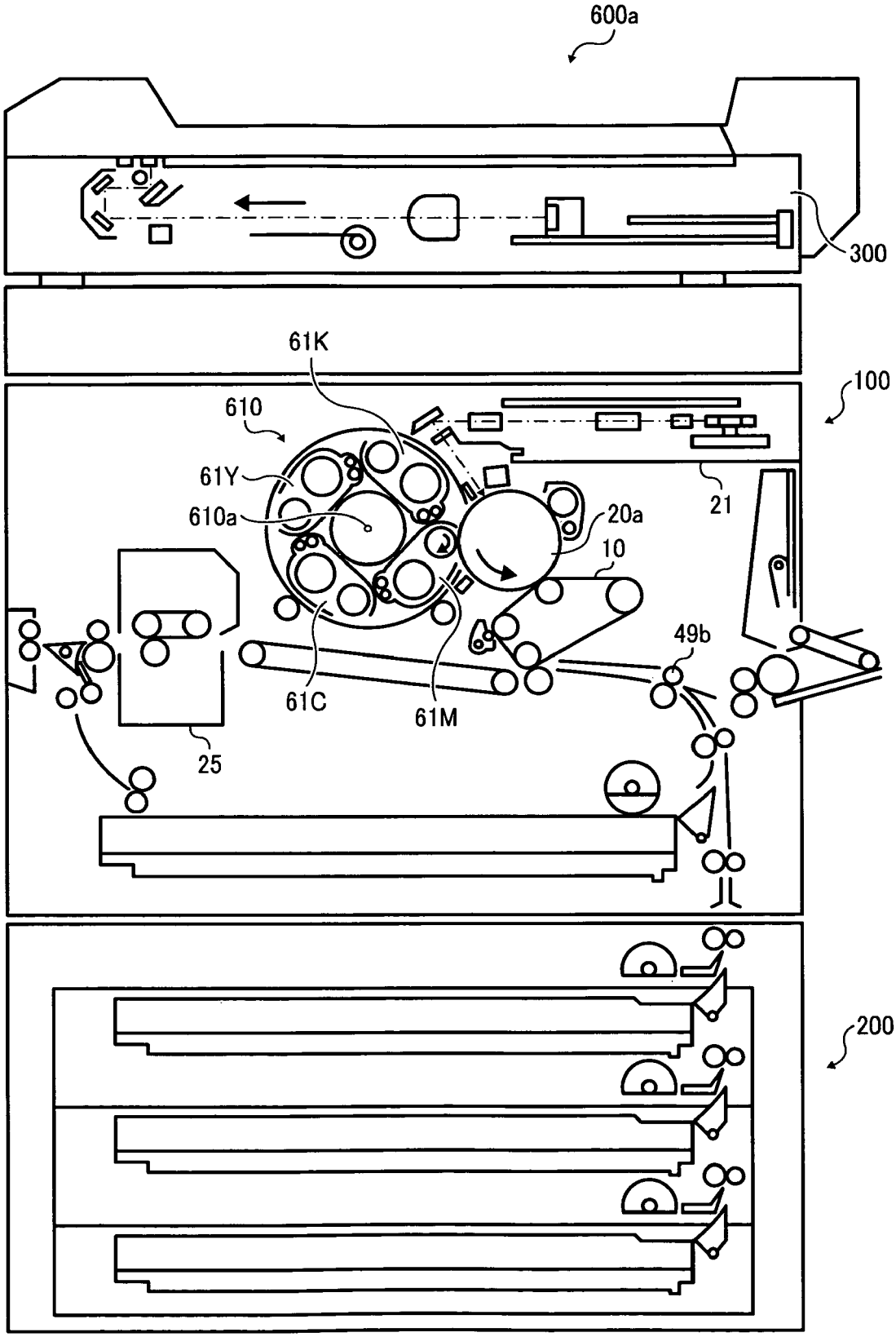
FIG. 56 shows a schematic configuration of image forming apparatus using a rotatable development unit.

Further, in the above description, the image forming apparatus 600 uses four photoconductors arranged in tandem, in which each color of toner images are formed on the respective photoconductors, and then the toner images are transferred on a transfer belt to form a full-color toner image. However, an image forming apparatus can employ other configuration using one single photoconductor for forming a full-color toner image as shown in FIG. 56, in which several devices are assigned with reference numbers used in FIG. 4 because they can be used similarly in FIG. 56. An image forming apparatus 600*a* in FIG. 56 includes one single photoconductor 20*a* over the intermediate transfer belt 10, and the development process unit 610 next to the photoconductor 20. The development process unit 610 includes the development unit 61Y, the development unit 61C, the development unit 61M, and the development unit 61K around a rotation shaft 610*a*. The development process unit 610 can be rotated about the rotation shaft 610*a*. When the development process unit 610 rotates about the rotation shaft 610*a*, one of the development units can be set to a development position facing the photoconductor 20*a*. After forming latent images of Y, C, M, and K on the surface of the photoconductor 20 sequentially, each of the latent images can be sequentially developed as toner images using the respective development units by rotating the development process unit 610. The developed Y, C, M, and K toner images can be transferred on the intermediate transfer belt 10 superimposingly.

Figure 57:
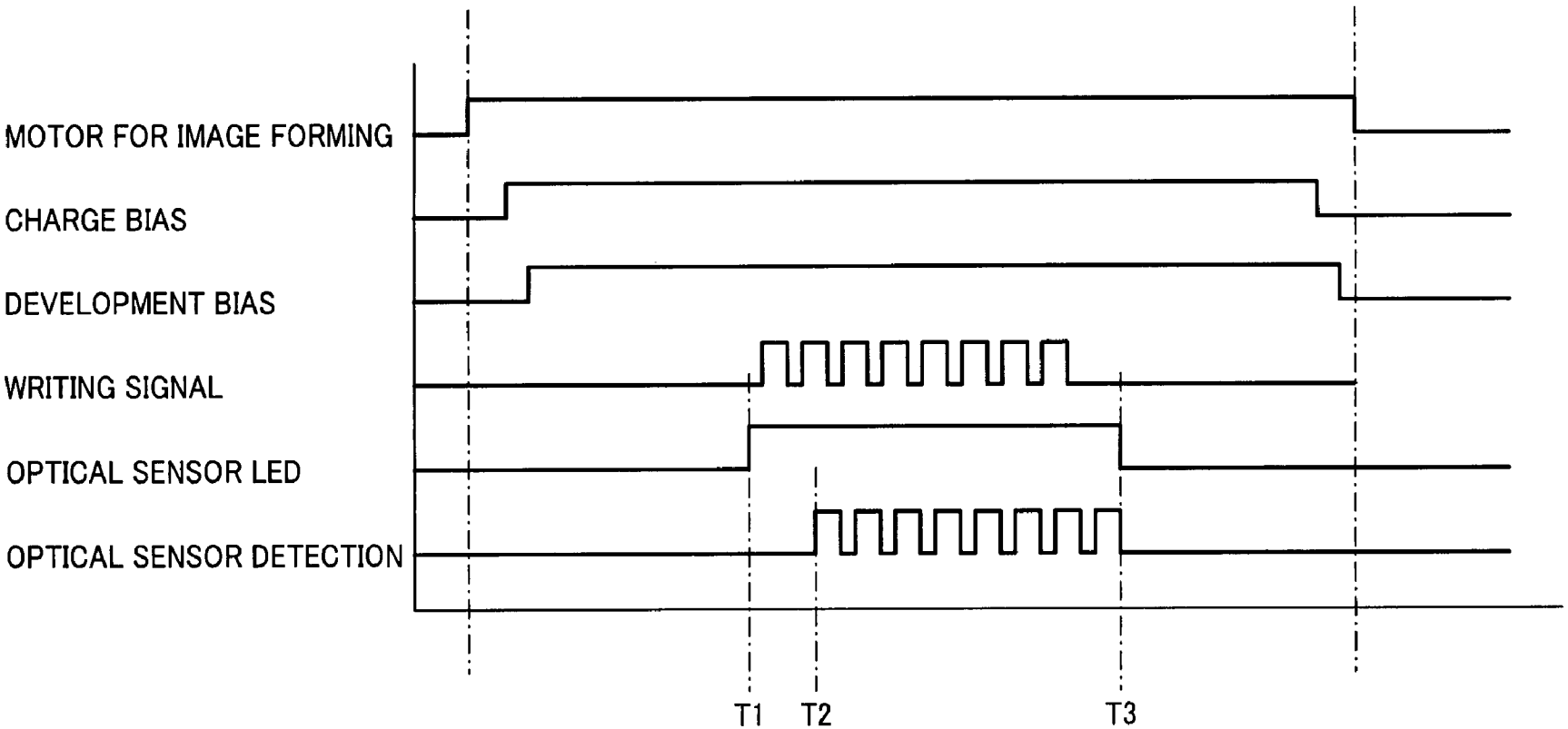
FIG. 57 shows a timing chart for concentration detection on photoconductor.

As for the image forming apparatus 600*a* of FIG. 56, a potentiometer for detecting potential of a latent image (test pattern) formed on the surface of the photoconductor 20*a*, and a concentration sensor for detecting a toner image concentration of test pattern formed on the intermediate transfer belt 10 can be disposed. With such a configuration, the image forming condition adjustment control described for the image forming apparatus 600 of FIG. 4 can be similarly conducted for the image forming apparatus 600*a*. Further, in the image forming apparatus 600*a*, all toner images are formed on the surface of the photoconductor 20*a*. Therefore, a concentration sensor can be disposed at a position which can detect test pattern formed on the surface of the photoconductor 20 to detect toner image concentration. FIG. 57 shows a timing chart for test pattern detection on the photoconductor 20*a* of the image forming apparatus 600*a* of FIG. 56. As shown in FIG. 57, a LED of P sensor (optical sensor) is set to ON before inputting a writing signal. By setting the LED to ON before the P sensor conducts a detection process, a light intensity of the LED can be effectively stabilized.

As above described, in an exemplary embodiment, the image forming apparatus 600 includes the photoconductor 20 (used as a latent image carrier), the charge unit 60, and the optical writing unit 900 (used as a exposure unit), for example. The charge unit 60 charges the surface of the photoconductor 20. The optical writing unit 900 exposes the surface of the photoconductor 20, charged by the charge unit 60, to form a latent image on the photoconductor 20. Further, the image forming apparatus 600 includes the potentiometer 320 (used as an exposure voltage detector), and the development unit 61. The potentiometer 320 detects a latent image potential of test pattern formed on the photoconductor 20 by using the optical writing unit 900. The development unit 61 includes the development sleeve 65 used as a developer carrier, which carries the developer including toner. The development unit 61 develops the latent image as a toner image by supplying toner from the development sleeve 65 to the latent image on the photoconductor 20 using a potential difference between the development sleeve 65 and the latent image. Further, the image forming apparatus 600 includes the image concentration sensor 310 used as a concentration detector. The image concentration sensor 310 detects an image concentration of a toner image of test pattern.

Further, the image forming apparatus 600 includes the main controller 500, which controls operations in the image forming apparatus 600. Specifically, the main controller 500 may communicate with the exposure power controller 710, the exposure ratio controller 711, the charging voltage controller 720, the development bias voltage controller 721, and the image forming condition adjustment controller 700 to set a suitable image forming condition.

The main controller 500 may control the exposure power controller 710, which may control an output of the light source 914 of the optical writing unit 900 to control the exposure power Lp.

The main controller 500 may control the exposure ratio controller 711, which may control an exposure duty per unit area by controlling ON/OFF timing of the light source 914 of the optical writing unit 900.

The main controller 500 may control the charging voltage controller 720, which may control the charge unit 60 to set a given charging voltage Vd, which can set a given surface potential on the photoconductor 20 after the charge process.

The main controller 500 may control the development bias voltage controller 721, which may control the development bias voltage Vb, which can set a given a surface potential on the development sleeve 65.

Further, the main controller 500 may control the image forming condition adjustment controller 700, which may adjust an image forming condition based on detection results of the potentiometer 320 and the image concentration sensor 310, wherein the potentiometer 320 and the image concentration sensor 310 detect conditions of test patterns. The test patterns may be formed by changing the charging voltage Vd for three levels; by changing the exposure power Lp for three levels; and by changing the exposure duty per unit area (Ld Duty) for two levels, for example. Accordingly, changing combinations of such levels defined by "3 times 3 times 2=18" can form a total of 18 gray-scale test patterns, for example.

Further, because the Ld Duty can be changed for two levels, the photo-induced discharge characteristic can be computed under a condition that the charging voltage Vd and the exposure power Lp are respectively set to a constant value.

Further, as above described with reference to FIG. 50, a relation of the exposure power Lp and photo-induced discharge characteristic can be approximated as a collinear approximation under a condition that the charging voltage Vd is set to a constant value. In the image forming apparatus 600, the exposure power Lp can be changed in three levels, for example, and the number of combinations of the exposure power Lp and the photo-induced discharge characteristic becomes three under a condition that the charging voltage Vd is set to a constant value. Accordingly, a relation of the exposure power Lp and the photo-induced discharge characteristic can be computed (or approximated) as a collinear approximation. Based on the collinear approximation and a suitable photo-induced discharge characteristic set in advance, a suitable exposure power Lp for the charging voltage Vd having three levels can be computed.

Further, as above described with reference to FIG. 51, a relation of the exposure power Lp and the exposure voltage VL under a condition that the charging voltage Vd is set to a constant value can be approximated as a quadratic approximation if the exposure power Lp is set in a given range typically set for an image forming process. In the image forming apparatus 600, the exposure power Lp can be changed in three levels, for example, and the number of combinations of the exposure power Lp and the exposure voltage VL becomes three under a condition that the charging voltage Vd is set to a constant value. Accordingly, a relation of the exposure power Lp and the exposure voltage VL can be computed (or approximated) as a quadratic approximation. Based on the quadratic approximation and the suitable exposure power Lp (computed based on FIG. 50) for the charging voltage Vd having three levels, a suitable exposure voltage VL for the charging voltage Vd can be computed.

Further, as above described with reference to FIG. 52, a relation of the charging voltage Vd and the exposure potential Pot can be approximated as a collinear approximation, in which an exposure process can be conducted using a suitable exposure power Lp for a given charging voltage Vd. In the image forming apparatus 600, the charging voltage Vd can be changed in three levels, for example, and the number of combinations of the charging voltage Vd and the exposure potential Pot becomes three. Accordingly, a relation of the charging voltage Vd and the exposure potential Pot, when a suitable exposure is conducted, can be computed (or approximated) as a collinear approximation. Based on the collinear approximation and the exposure potential Pot, wherein the exposure potential Pot is obtained by adding a surface skin potential (e.g., 150V), determined by a configuration of specific apparatus, to a development potential value required for obtaining a given toner-adhesion amount, a charging voltage Vd1, which is to be used for image forming condition adjustment control, can be computed. Then, based on a difference between the computed charging voltage Vd1 and the surface skin potential (e.g., 150V), a development bias voltage Vb1, which is to be used for image forming condition adjustment control, can be computed.

Further, as above described with reference to FIG. 53, a relation of the charging voltage Vd and the suitable exposure power Lp can be approximated as a collinear approximation. In the image forming apparatus 600, the charging voltage Vd can be changed in three levels, for example, and the number of combinations of the charging voltage Vd and the suitable exposure power Lp becomes three. Accordingly, a relation of the charging voltage Vd and the suitable exposure power Lp can be computed (or approximated) as a collinear approximation. Based on the collinear approximation and the computed charging voltage Vd1, an exposure power Lp1, which is to be used for image forming condition adjustment control, can be computed.

As such, as for the image forming apparatus 600, the charging voltage Vd can be set to three levels, the exposure power Lp can be set to three levels, and the Ld Duty (or exposure time per unit area) can be set to two levels, for example, by which 18 gray-scale test patterns can be formed by changing combinations defined by "3 times 3 times 2" as image forming conditions. With such a configuration, a suitable charging voltage Vd and a suitable exposure power Lp can be computed without using an exposure power having too great value. Further, each of the 18 gray-scale test patterns can be formed on the photoconductor 20 without using an exposure power having too great value that the surface potential of the photoconductor 20 is saturated.

As such, the charging voltage Vd1, the exposure power Lp1, and the development bias voltage Vb1 suitable for the image forming apparatus 600 can be computed without using an exposure power Lp having too great value in any of the above first to eighth steps. Therefore, without relevancy to the charging voltage Vd, an exposure power Lp for exemplary embodiment can be set smaller than an exposure power used in a conventional control process that saturates a value of the exposure voltage VL, which is a surface potential of photoconductor after an exposure process. Further, using such exposure power Lp, which is desirable due to its lower power, a suitable charging voltage Vd1 and exposure power Lp1 can be set for an image forming condition.

Further, even the charging voltage Vd is changed, an exposure power Lp having too great value that can change the exposure voltage VL may not be used, by which the image forming condition adjustment control can be conducted for an apparatus using for example a VCSEL (Vertical Cavity Surface Emitting LASER), which is hard to use a greater exposure power. Further, the image forming condition adjustment control can be effectively used to other unit (e.g., end-face emitting laser), which does not use VCSEL, by which durability (e.g., service life) of a laser or a photoconductor can be extended.

Further, in the image forming apparatus 600, the main controller 500 may control the exposure ratio controller 711 to change an exposure duty per unit area for test patterns by changing exposed dot numbers per unit area as shown in FIG. 48, or by changing exposed dot numbers per unit area and exposure duty for each single dot as shown in FIG. 47. With such a control, two levels of exposure duty per unit area can be set (e.g., halftone image having exposure duty of 32/64 value, and solid image exposure duty of 64/64 value).

Further, in the image forming apparatus 600, a pattern composed of exposed dot numbers per unit area can be changed from FIG. 47 to FIG. 48. In FIG. 48, a test pattern composed of exposed dots arranged adjacently each other, by which a latent image of test pattern condition can be stabilized.

Further, as for the image forming apparatus 600, the main controller 500 may compute an exposure potential Pot, which is a difference between the charging voltage Vd and the exposure voltage VL, wherein the exposure voltage VL is a post-exposed voltage of photoconductor (or a latent image potential of test pattern) detectable by the potentiometer 320. Accordingly, the main controller 500 may be used as an exposure potential computer. Further, the main controller 500 may compute a development potential, which is a difference between the exposure voltage VL and the development bias voltage Vb. Accordingly, the main controller 500 may be used as a development potential computer.

Further, Ld Duty condition includes two levels, for example. One level of Ld Duty condition is a solid exposure condition, in which all area of test pattern is exposed by maximizing an exposure duty per unit area, in which exposure condition Ld Duty is set to 64/64 value, for example. Such condition is referred as "solid exposure (or 1st Ld Duty)". The other one level of Ld Duty condition is referred as 2nd Ld Duty, in which test pattern is exposed by using Ld Duty of 32/64 value, for example. Such condition may be referred to as "half-tone image exposure). By setting the charging voltage Vd and the exposure power Lp at constant values and changing the Ld Duty between the 1st Ld Duty (e.g., 64/64 value) and the 2nd Ld Duty (e.g., 32/64 value), the main controller 500 can compute a photo-induced discharge characteristic obtained by the following equation (3). Accordingly, the main controller 500 can be used as a photo-induced discharge characteristic computer.

photo-induced discharge characteristic=(exposure potential for *Ld* Duty of 32/64)/(exposure potential for *Ld* Duty of 64/64) (3)

Following first to eighth step may be conducted as an image forming condition adjustment control to set a preferable image forming condition for the image forming apparatus 600.

In a first step, a photo-induced discharge characteristic for the 2nd Ld Duty (32/64 value) is computed as shown in FIG. 49. Then, a relation of two levels of Ld Duty and three levels of the exposure power Lp under a condition that the charging voltage Vd is set at a constant value is computed. Then, an exposure power Lp matched to a target value of photo-induced discharge characteristic (e.g., 0.7) is computed. Such computation is conducted for each of three levels of the charging voltage Vd as shown in FIG. 50. Then, based on a combinations of the computed exposure power Lp, matched to the target value of photo-induced discharge characteristic (e.g., 0.7) and the charging voltage Vd having three levels, a suitable exposure power Lp for a given charging voltage Vd can be computed.

In a second step, as described with reference to FIG. 35, based on a relation of toner image concentration of test patterns detected by the image concentration sensor 310 and a development potential, a development potential required for obtaining a corresponding target image concentration can be computed.

In a third step, based on the suitable exposure power Lp computed in the first step for the given charging voltage Vd, an exposure potential Pot suitable for the given charging voltage Vd can be computed as shown in FIG. 51; and then a suitable relation of the charging voltage Vd and the exposure potential Pot can be computed as shown in FIG. 52.

In a fourth step, based on the suitable exposure power Lp computed in the first step for the given charging voltage Vd, a suitable relation of the charging voltage Vd and the exposure power Lp can be computed as shown in FIG. 53.

In a fifth step, based on the development potential computed in the second step, a required exposure potential Pot can be computed.

In a sixth step, based on a suitable relation of the charging voltage Vd and the exposure potential Pot computed in the third step (FIG. 52), a charging voltage Vd1, suitable to the required exposure potential Pot computed in the fifth step, can be computed.

In a seventh step, based on a suitable relation of the charging voltage Vd and the exposure power Lp computed in the fourth step, an exposure power Lp 1, suitable to the charging voltage Vd1 computed in the sixth step, can be computed.

In a eighth step, based on a relation of the charging voltage Vd and development bias voltage Vb, which may be determined by the image forming apparatus 600 (i.e., development bias voltage=charging voltage−surface skin potential; surface skin potential can be determined by a configuration of specific apparatus), a development bias voltage Vb1, corresponding to the charging voltage Vd1 computed in the sixth step, can be computed.

By conducting the above first to eighth steps, the charging voltage Vd1, the exposure power Lp1, and the development bias voltage Vb1 suitable a present condition of the image forming apparatus 600 can be computed.

As such, the charging voltage Vd1, the exposure power Lp1, and the development bias voltage Vb1 suitable for the image forming apparatus 600 can be computed without using an exposure power having too great value in any of the above first to eighth steps. Therefore, without relevancy to the charging voltage Vd, an exposure power Lp for exemplary embodiment can be set smaller than an exposure power used in a conventional control process that saturates a value of the exposure voltage VL, which is a surface potential of photoconductor after an exposure process. Further, using such exposure power Lp, which is desirable due to its Lower power, a suitable charging voltage Vd1 and exposure power Lp1 can be set for an image forming condition.

Further, in the image forming apparatus 600, under a condition that the charging voltage Vd is kept at constant in the first step, a relation of two levels of Ld Duty and three levels of the exposure power Lp can be approximated as a collinear approximation (FIGS. 49 and 50). Based on such collinear approximation, a photo-induced discharge characteristic, corresponding to a given exposure power Lp can be computed under a condition that the charging voltage Vd is kept at a constant value.

By using such collinear approximation, a charging voltage Vd, which can obtain suitable photo-induced discharge characteristic, can be computed even if the number of combinations of Ld Duty and exposure power Lp is relatively small. Accordingly, the number of test patterns can be reduced.

Further, in the image forming apparatus 600, as shown in FIG. 46, as for a combination of three levels of the charging voltage Vd and three levels of the exposure power Lp, when the charging voltage Vd is set to a higher level of three levels, the exposure power Lp may be also set to a higher level of three levels to make a combination (e.g., highest level of three levels). In an actual image forming, when the charging voltage Vd is set higher, the exposure power Lp may be set greater. Accordingly, by making a combination having a higher charging voltage Vd and a greater exposure power Lp among the three levels, test patterns which are close to an actual image forming condition can be prepared.

Further, in the image forming apparatus 600, under a condition that the charging voltage Vd is kept at a constant value, a relation of the exposure power Lp and the exposure voltage VL can be approximated as a quadratic approximation (FIG. 51). Using such quadratic approximation relation, under a condition that the charging voltage Vd is kept at a constant value, an exposure voltage VL corresponding to a given exposure power Lp can be computed. By using such quadratic-approximation, the exposure voltage VL, corresponding to a given exposure power Lp, can be computed even if the number of combinations of the exposure power Lp and the exposure voltage VL is relatively small. Accordingly, the number of test patterns can be reduced.

The photoconductor 20 may include a photoconductive layer including titanyl phthalocyanine crystal, for example. Such photoconductor 20 can be effectively used with the light source 914), such as for example VCSEL, having a longer wavelength (e.g., 720 nm or more). Further, the optical writing unit 900 may include a monitoring unit to monitor light intensity of light flux emitted from the light source 914 (see FIG. 14). The monitoring unit includes the first opening plate 923 (used as a light-splitting optical device), the second opening plate 926 (used as a light-limiting device), and the photodiode 925. The first opening plate 923 has an opening portion in its center portion to pass through a light flux having a greater light intensity emitted from the light source 914, and a reflection portion around the opening portion to reflect a light flux as a light flux for monitoring.

The second opening plate 926 has an opening portion in its center portion to pass through the light flux for monitoring reflected at the first opening plate 923. The opening portion of second opening plate 926 is used to limit a beam diameter. The photodiode 925, used as a light receiving element, receives the light flux for monitoring passed through the opening portion of the second opening plate 926.

As shown in FIG. 42, the opening portion of the first opening plate 923 has the width D1 and the width D2, in which the width D1 is perpendicular to the width D2 and the D1 is set longer than the D2. As shown in FIG. 16, the opening portion of the second opening plate 926 has the width D3 and the width D4, in which the width D3 is set smaller than the width D1, and the width D4 is set longer than the width D2.

Further, with an isotropical change of an diverging angle of the light flux emitted from the light source 914 light intensity of light flux passed through the opening portion of the first opening plate 923 may change from "Ps" to "Ps+ΔPs," and light intensity of light flux passed through the opening portion of the second opening plate 926 may change from "Pm" to "Pm+ΔPm," and then a ratio of "[Ps+ΔPs]/(Pm+ΔPm)]/(Ps/Pm) may become from 0.97 to 1.03.

Further, the monitoring unit includes the imaging lens 924, which is a condenser lens to focus the light flux for monitoring reflected from the first opening plate 923 on the photodiode 925. A light path between the imaging lens 924 and the photodiode 925 may be set to 0.95 times of a focal length of the imaging lens 924 or less, or 1.05 times of a focal length of the imaging lens 924 or more. With such a configuration, detection sensitivity can be set to a substantially constant value.

Further, if the optical writing unit 900 uses a plane emission laser such as for example VCSEL (Vertical Cavity Surface Emitting LASER) as the light source 914, a multiple-beam scanning can be conducted, by which an image forming process can be conducted at a higher productivity under higher linear velocity, and the rotation speed of a polygon scanner can be decreased, and furthermore, electrical power consumption can be reduced.

As such, the charging voltage Vd1, the exposure power Lp1, and the development bias voltage Vb1 suitable for the image forming apparatus 600 can be computed without using an exposure power Lp having too great value in any of the above first to eighth steps. Therefore, without relevancy to the charging voltage Vd, an exposure power Lp for exemplary embodiment can be set smaller than an exposure power used in a conventional control process that saturates a value of the exposure voltage VL, which is a surface potential of photoconductor after an exposure process. Further, using such exposure power Lp, which is desirable due to its lower power, a suitable charging voltage and an exposure power can be set for an image forming condition.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

a charge unit to charge a surface of a latent image carrier;

an exposure unit to irradiate the charged surface of a latent image carrier using a light beam to form a latent image on the latent image carrier, the latent image being formed as a test pattern;

an exposure voltage detector to detect a potential of the latent image formed on the latent image carrier;

a development unit, including developer carrier carrying toner, to develop the latent image as a toner image by supplying the toner to the latent image on the latent image carrier using a potential difference between the latent image carrier and the developer carrier;

a concentration detector to detect an image concentration of the test pattern developed as the toner image;

an exposure power controller controlling an exposure power emitted by the exposure unit;

an exposure ratio controller controlling an exposure duty per unit area exposed by the exposure unit;

a charging voltage controller controlling a charge bias voltage applied to the charge unit to set a surface potential of the latent image carrier at a given charging voltage after a charging process;

a development bias voltage controller controlling a development bias voltage, which is a surface potential of the developer carrier; and an image forming condition adjustment controller adjusting an image forming condition based on detection results of the exposure voltage detector and the concentration detector, wherein the charging voltage controller changes the charging voltage in two levels or more, the exposure power controller changes the exposure power in three levels or more, and the exposure ratio controller changes the exposure duty per unit area in two levels or more, wherein the test pattern is formed under image forming conditions using combinations set by 2×3×2 levels or more, to obtain a suitable combination of the charging voltage, the exposure power, and the development bias voltage.

2. The image forming apparatus according to claim 1, wherein the exposure ratio controller changes the exposure duty per unit area of the test pattern by changing the number of dots per unit area exposed by the light beam.

3. The image forming apparatus according to claim 2, wherein the test pattern is formed of exposed dots that are adjacently exposed.

4. The image forming apparatus according to claim 2, wherein the exposure ratio controller changes the exposure duty per unit area of the test pattern by changing the number of dots per unit area exposed by the light beam and an exposure time for each one of single exposed dot.

5. The image forming apparatus according to claim 1, further comprises:

an exposure potential computer;

a development potential computer; and a photo-induced discharge characteristic computer, the exposure potential computer computing an exposure potential, which is a difference between a post-exposed voltage of latent image of the test pattern detected by the exposure voltage detector and the charging voltage, the development potential computer computing a development potential, which is a difference between the post-exposed voltage and the development bias voltage, the photo-induced discharge characteristic computer computing photo-induced discharge characteristic by setting two levels or more of the exposure duty per unit area which includes one level for a solid image exposure condition and another one level for a half-tone image exposure condition, under a condition that the charging voltage and the exposure power are kept at constant, in the solid image exposure condition, the test pattern is totally exposed by maximizing the exposure duty per unit area, and in the half-tone image exposure condition, the test pattern is partially exposed, the exposure duty per unit area is changed between the solid image exposure condition and the half-tone image exposure condition, the photo-induced discharge characteristic defined by a following: photo-induced discharge characteristic is obtained by dividing an exposure potential for half-tone image exposure condition by an exposure potential for solid image exposure condition.

6. The image forming apparatus according to claim 1, wherein the latent image carrier comprises a photoconductor having a photoconductive layer including titanyl phthalocyanine crystal.

7. The image forming apparatus according to claim 1, wherein the exposure unit includes a monitor unit to monitor light intensity of light flux emitted from a light source, the monitor unit including:

a light-splitting optical device having a first opening portion and a peripheral portion around the first opening portion, light flux having maximum light intensity emitted from the light source passes a center of the first opening portion, and light flux reflected at the peripheral portion is used as light flux for monitoring;

a light-limiting device having a second opening portion to limit a beam diameter of the light flux for monitoring reflected by the light-splitting optical device;

a light receiving element to receive the light flux for monitoring passed through the second opening portion of the light-limiting device; and a condenser lens to focus the light flux for monitoring on the light receiving element, wherein the first opening portion of the light-splitting optical device has a width D1 extending in a first direction and a width D2 extending in a second direction perpendicular to the first direction, the width D1 is set longer than the width D2, wherein the second opening portion of the light-limiting device has a width D3 extending correspondingly in the first direction and a width D4 perpendicular to the width D3 and extending correspondingly in the second direction, the width D3 is set shorter than the width D1, and the width D4 is set longer than the width D2, wherein with an isotropical change of an diverging angle of the light flux emitted from the light source, the light intensity of light flux passed through the first opening portion of the light-splitting optical device changes from Ps to Ps+ΔPs, and the light intensity of light flux passed through the second opening portion of the light-limiting device changes from Pm to Pm+ΔPm, in which a ratio of [(Ps+ΔPs)/(Pm+ΔPm)]/(Ps/Pm) is set to a value within a range of from 0.97 to 1.03, wherein a light path distance between the condenser lens and the light receiving element is set to 0.95 times or less of a focal length of the condenser lens, or 1.05 times or more of the focal length of the condenser lens.

8. The image forming apparatus according to claim 1, wherein the exposure unit comprises a plane emission laser light source.

9. A control method for computing a suitable combination of a charging voltage, an exposure power, and a development bias voltage for a present condition of an image forming apparatus, the image forming apparatus comprising:

a charge unit to charge a surface of a latent image carrier;

an exposure unit to irradiate the charged surface of a latent image carrier using a light beam to form a latent image on the latent image carrier, the latent image being formed as a test pattern;

an exposure voltage detector to detect a potential of the latent image formed on the latent image carrier;

a development unit, including developer carrier carrying toner, to develop the latent image as a toner image by supplying the toner to the latent image on the latent image carrier using a potential difference between the latent image carrier and the developer carrier;

a concentration detector to detect an image concentration of the test pattern developed as the toner image;

an exposure power controller;

an exposure ratio controller;

a charging voltage controller;

a development bias voltage controller; and an image forming condition adjustment controller, the exposure power controller controlling an exposure power emitted by the exposure unit, the exposure ratio controller controlling an exposure duty per unit area exposed by the exposure unit, the charging voltage controller controlling a charge bias voltage applied to the charge unit to set a surface potential of the latent image carrier at a given charging voltage after a charging process, the development bias voltage controller controlling a development bias voltage, which is a surface potential of the developer carrier, the image forming condition adjustment controller adjusting an image forming condition based on detection results of the exposure voltage detector and the concentration detector, wherein the charging voltage controller changes a charging voltage in two levels or more, the exposure power controller changes the exposure power in three levels or more, and the exposure ratio controller changes the exposure duty per unit area in two levels or more, wherein the test pattern is formed under image forming conditions using combinations set by 2×3×2 levels or more, to obtain a suitable combination of the charging voltage, the exposure power, and the development bias voltage, the control method for computing a suitable combination of the charging voltage, the exposure power, and the development bias voltage for a present condition of the image forming apparatus comprising:

in a first step, obtaining the photo-induced discharge characteristic, and under a condition that the charging voltage is kept at a constant level, and based on a relation of two levels of the exposure duty per unit area and three levels or more of the exposure power, an exposure power matched to a target value of the photo-induced discharge characteristic is computed for each of two levels or more of the charging voltage, and based on two levels or more of combination of the exposure power matched to the target value of the photo-induced discharge characteristic and the charging voltage, a suitable exposure power corresponding to a given charging voltage is computed;

in a second step, computing, based on a relation of toner image concentration of test pattern detected by the concentration detector and the development potential, a development potential required for obtaining a corresponding target image concentration;

in a third step, computing, based on the suitable exposure power computed in the first step for the given charging voltage, an exposure potential suitable for the given charging voltage, and then computing a suitable relation of the charging voltage and the exposure potential;

in a fourth step, computing, based on the suitable exposure power computed in the first step for the given charging voltage, a suitable relation of the charging voltage and the exposure power;

in a fifth step, computing, based on the development potential computed in the second step, a required exposure potential;

in a sixth step, computing, based on a suitable relation of the charging voltage and the exposure potential computed in the third step, a charging voltage suitable to the required exposure potential computed in the fifth step;

in a seventh step, computing, based on a suitable relation of the charging voltage and the exposure power computed in the fourth step, an exposure power suitable to the charging voltage computed in the sixth step; and in an eighth step, computing, based on a relation of a charging voltage and development bias voltage determined by types of the image forming apparatus, a development bias voltage, corresponding to the charging voltage computed in the sixth step, is computed, wherein the charging voltage, the exposure power, and the development bias voltage suitable for a present condition of the image forming apparatus, are computed by conducting the first to eight steps.

10. The control method according to claim 9, wherein under a condition that the charging voltage in the first step is kept constant, a relation of the exposure duty per unit area having two levels or more and the exposure power having three levels or more is approximated as a collinear approximation, and based on the collinear approximation, a photo-induced discharge characteristic corresponding to a given exposure power under the given charging voltage is computed.

11. The control method according to claim 9, wherein, when the charging voltage two levels or more is set to a higher level, the exposure power three levels or more is set to a higher level.

12. The image forming apparatus according to claim 9, wherein under a condition that the charging voltage is kept at constant, a relation of the exposure power and the post-exposed voltage is approximated as a quadratic approximation, and based on the quadratic approximation, a post-exposed voltage corresponding to a given exposure power under the given charging voltage is computed.

13. The image forming apparatus according to claim 9, wherein a relation of the charging voltage and the exposure potential is approximated as a collinear approximation.

* * * * *